United States Patent [19]

Maynard

[11] 3,961,688

[45] June 8, 1976

[54] TRANSPORTATION SYSTEM WITH MALFUNCTION MONITOR

[75] Inventor: John T. Maynard, New Berlin, Wis.

[73] Assignee: Armor Elevator Company, Louisville, Ky.

[22] Filed: Apr. 29, 1974

[21] Appl. No.: 465,271

[52] U.S. Cl. ..... 187/29 R
[51] Int. Cl.[2] ..... B66B 5/02
[58] Field of Search ..... 187/29

[56] References Cited

UNITED STATES PATENTS

| | | | |
|---|---|---|---|
| 3,584,706 | 6/1971 | Hall et al. | 187/29 |
| 3,587,785 | 6/1971 | Krauer et al. | 187/29 |
| 3,720,292 | 3/1973 | Magee | 187/29 |
| 3,741,348 | 6/1973 | Caputo | 187/29 |
| 3,779,346 | 12/1973 | Winkler | 187/29 |

*Primary Examiner*—Robert K. Schaefer
*Assistant Examiner*—W. E. Duncanson, Jr.
*Attorney, Agent, or Firm*—Andrus, Sceales, Starke & Sawall

[57] ABSTRACT

A transportation system such as an elevator utilizes a static power converter to directly energize a D.C. drive motor and another static power converter to directly energize a friction type braking element and automatically selects a mode of operation best suited for safe operation from a plurality of modes including a normal operation, a reduced speed operation, an emergency landing operation and an emergency operation in response to certain sensed malfunctions within the system including a decrease in the source voltage to a predetermined magnitude, an increase in the armature current of the D.C. motor to a predetermined magnitude, a decrease in the field current of the D.C. motor below a predetermined magnitude, an increase of an error signal as sensed by an error detector to a predetermined magnitude, a malfunctioning of the error detector, an increase in the velocity of the vehicle as sensed by a velocity detector exceeding certain predetermined magnitudes, the malfunctioning of the velocity detector, a decrease in the source current to a predetermined magnitude, a loss of a phase of source energy as sensed by a phase detector, a failure of a rectifying element within the phase detector, an improper sequential order of the source alternating phases, a predetermined temperature within a gated rectifying circuit, an improper electrical connection by a circuit connector, and the movement of the vehicle to a first position adjacent to a landing at which a stop is being made and a subsequent movement to second position. The system responds to a sensed malfunction by providing a plurality of redundant sequences and fail-safe circuits in selecting the mode best suited for safe operation.

218 Claims, 14 Drawing Figures

L1
L2
L3
5
UV
BK-1
UV-1
TRANSFORMER AND RECTIFIER
57
106
107
108
109
140
INS
SUP
SDP
CA
S
SU
SD
UVA
L
TIMER
HR
M
MT
DBA
DB
SDP-1
SUA-1
UC-1
SUP-1
PA-1
SDP-2
SUP-2
SDA-1
DC-1
CA-1
ELA-1
PA2
RA-1
CA-2
V-1
DO-1
RA-2
FC-1
HR-1
SUP-3
141
142
SDP-3
143
144
HR-2
UVA-1
UV-2
S-1
SU-1
SD-1
PA-3
LUD-1
FC-2
DO-2
UV-3
PA-4
SA-1
HR-3
145
ELA-2
DB-2
M-1
148
146
147
L-1
DBA-1
TO FIG. 3
TO FIG. 3

FROM FIG.2
FROM FIG.2
106
108
107
BK
PA-5
U-1
D-1
-86
-87
149
LUD
LU
LUA
SU-2
INS-1
SD-2
-88
LD
LDA
-89
2L
2LA
-90
3L
3LA
-91
4L
4LA
-92
4LA-1
PA-6
-93
GOV-1
E
EX-1
-94
EL
E-1
OC-1
ELA-3
4L-2
ELX-1
150
-95
151
3L-1
-96
ELA
SAF-1
PA-7
EL-1
SAF-2
-97
ELA-4
E-2
-98
152
159
LU-1
LD-1
-99
160
ELA-5
157
INS-2
-100
154
155
DOOR LOCKS
PA
U
D-2
SU-3
EL-2
INS-3
-101
153
153
U-2
E-3
-102
4L-3
D-3
U-3
SD-3
D
-103
156
158
-104
LD-2
LU-2
2L-1
EL-3
-105

L1
L2
L3
L-2
L-3
L-4
-110
TRANSFORMER
132
133
135
136
138
139
OSX-1
OSXA
OVX-1
OVXA
+VDC
-VDC
PA-8
K1X
PAX
M-2
MT-1
K3X
K4X
K5X
ELX-2
ELAX
LU-3
LD-3
2L-2
LVX
U-4
UX
D-4
DX
2L-3
2LX
3L-2
3LX
4L-4
4LX
INS-4
ISX
HR-4
HRX
UVA-2
S-2
UX-1
URX
INS-5
DX-1
DRX
UVA-3
BK-3
LUD-2
-111
-112
-113
-114
-115
-116
-117
-118
-119
-120
-121
-122
-123
-124
-125
-126
-127
-128
-129
-130
-131

+VDC
-VDC
OVX
OSX
ELAX-3
ELAX-2
L1
L2
L3
$V_T$

FROM REFERENCE TRANSFORMER
584
OVXA-1
OSXA-1
ELX
EX
EX-2
ELX-3
PAX-1

TRANSPORTATION SYSTEM WITH MALFUNCTION MONITOR

BACKGROUND OF THE INVENTION

This invention relates to a transportation system in which a transport vehicle is moved relative to a structure for serving a plurality of spaced landings and includes a malfunction monitor for safely operating the vehicle.

Transportation systems, such as elevator systems, have been designed to move transport vehicles for carrying passengers and other items in both vertical and horizontal directions to serve a plurality of spaced landings. Elevator systems have been mounted to move a car or platform vertically along a guided path defined by guide rails or the like from one landing to another while subways, trains or the like have utilized rails to support and guide a vehicle for horizontal movement while other horizontally movable vehicles are supported by compressed air and restrained by guides for defined movement to travel in a path extending adjacent to landings for permitting passenger transfer at selected landings.

Many prior transportation systems have sensed one or more malfunctions to immediately stop the vehicle and prevent further operation. Such an immediate stoppage in an elevator system results in the vehicle being stalled in the shaft possibly between landings where the passengers would be stranded and isolated until the malfunction has been corrected. Some malfunctions require the attendance of service personnel frequently resulting in delays before the vehicle can be moved to an adjacent landing for passenger transfer.

Many transportation systems such as elevator systems have sensed a malfunction to operate a suicide circuit, such as in the U.S. Pat. No. 3,584,706 issued on June 15, 1971, which connects a generator armature to a generator shunt field thereby causing the armature current to flow in a manner to produce flux opposing any buildup in the generator while also setting a brake to immediately cease further vehicle movement. Such a system utilizes a generator to supply a variable voltage to an armature circuit of the hoist motor in which the shunt field of the generator is controlled to provide a speed control for the vehicle.

While it is sometimes desirable to immediately stop and stall a vehicle to prevent further movement to an adjacent landing for a serious malfunction occurring within the system, other less serious malfunctions might not require a total stoppage and stalling of the vehicle between transfer points particularly where the malfunction would not result in an extremely dangerous condition if continued vehicle movement were permitted under highly controlled and regulated conditions.

Some elevator type transportation systems have utilized auxiliary motors and/or auxiliary power sources which are selectively connected and operated in response to a sensed malfunction to move the vehicle to an adjacent landing to permit passenger transfer. Such additional motors and/or power sources require added and expensive equipment needing additional space for their presence. Such additional equipment can not be preferrably utilized with elevator systems which are constructed of modular prefabricated blocks because the uppermost modular penthouse block containing the motive equipment is frequently limited by size and weight requirements.

Many elevator type transportation systems require an attendant or serviceman to walk to the penthouse or other control area and manually energize a circuit from an auxiliary power source to lift the brake and permit the vehicle to travel to an adjacent landing after the vehicle has stopped and stalled within the shaft in response to a malfunction. Such systems frequently provide an auxiliary motor to facilitate the movement of the stalled vehicle which must also be manually operated from the penthouse or other control area.

Other elevator type transportation systems have permitted continued operation when sensing a malfunction by limiting or reducing the supply of energy to the elevator prime mover thereby operating the vehicle at a declining or reduced speed until reaching a landing at which a stop can be made. Such systems frequently energize the drive motor or prime mover by electric power supplied by a Ward-Leonard motor-generator control apparatus. One known system operates in response to a malfunction to let the rotor which energizes the generator to continue rotation through its inertia so that the generator continues to supply energizing voltage to the prime mover to move the vehicle to a landing in the direction in which the vehicle had been previously traveling. Another known elevator type transportation system operates in response to a malfunction and disconnects the energization of a first section of the shunt field of a generator supplying variable voltage to an armature of the hoist motor while continuing to energize the second section of the generator shunt field to continually supply driving power to the prime mover for continued travel, such as shown in U.S. Pat. No. 3,584,706. Such systems thus utilize a motor-generator type control apparatus widely utilized in many prior elevator type transportation systems which are difficult to utilize in modular type constructions because of their bulk and are relatively expensive units of the transportation system.

While many prior transportation systems have sensed malfunctions to modify their operation, the prior malfunction monitors together with the associated interconnected control systems would not be adaptable to a system in which a D.C. motor acting as the prime mover is coupled to receive energizing power directly from a static power converter which is utilized to transform an alternating current electrical input to a direct current electrical output used to energize and operate the motor. Because of the nature of such static power converters, a malfunction monitoring system must be able to quickly respond to varying operating conditions including transient conditions occurring within various stages of the power supply and control system to quickly modify the operation of the static power converter and other sequences and devices of the system.

SUMMARY OF THE INVENTION

This invention relates to a transportation system such as an elevator system, for example, in which a transport vehicle is mounted for movement relative to a structure in a path extending adjacent to a plurality of landings and including a malfunction monitor.

The transportation system of the present invention provides a control means which is connected to a source of energy and cooperates with a motive means for controlling the movement of the vehicle relative to the structure and including the stopping of the vehicle at a selected landing. A monitoring means is coupled to detect one or more malfunctions within the transportation system and is operative through a transfer means to modify the operation of the control means to provide a safe mode of operation selected from a plurality of modes including a normal operation, a reduced speed operation, an emergency landing operation and an emergency operation in response to a sensed malfunction occurring within the transportation system.

The invention thus provides a highly desirable transportation system including a number of operating modes for providing a selected safe operation. Thus in one aspect of the invention, the control means provides a first mode operating the vehicle under a first predetermined maximum velocity limitation to provide normal service between the plurality of landings, a second mode operating the vehicle under a second predetermined maximum velocity limitation in response to a sensed first malfunction, and a third mode in response to a sensed second malfunction rendering the motive means inoperative for supplying a driving force to the vehicle and guiding the vehicle to one of the landings.

In another aspect of the invention, the control means provides a first mode operating the vehicle under a first predetermined maximum velocity limitation for providing normal service between a plurality of landings, a second mode operating the vehicle under a second predetermined maximum velocity limitation in response to a sensed first malfunction of a decrease in the energy supplied from the source to a predetermined magnitude, and a third mode rendering the motive means inoperative for supplying a driving force to the vehicle and stopping the vehicle in response to a sensed second malfunction.

In a further aspect of the invention, the control means provides a first mode operating the vehicle to provide normal service between the plurality of landings, a second mode rendering the motive means inoperative for supplying a driving force to the vehicle and guiding the vehicle to one of the landings in response to a sensed first malfunction, and a third mode rendering the motive means inoperative for supplying a driving force to the vehicle and stopping the vehicle in response to a sensed second malfunction.

In a preferred form of the invention, the system transfers into a reduced speed mode of operation in response to the monitoring means sensing a decrease in the source energy to a first predetermined magnitude. The system also preferrably transfers into an emergency landing mode of operation in response to a sensed one of a plurality of possible malfunctions including the energy supplied to an armature circuit of the motive means increasing to a predetermined magnitude, the energy supplied to a field circuit of the motive means decreasing below a predetermined magnitude, the error signal derived as a difference between an output proportional signal of the motive means and a command signal as sensed by an error detector exceeding a predetermined magnitude, and the malfunctioning of the error detector. The system also preferrably transfers into an emergency mode of operation in response to a sensed one of a plurality of possible malfunctions including the velocity of the vehicle as sensed by a velocity detector exceeding a predetermined magnitude, the malfunctioning of the velocity detector, the energy supplied from the source decreasing to a second predetermined magnitude, the loss of a phase of energy supplied from the source as sensed by a phase detector, the failure of a rectifying element within the phase detector, the improper sequential order of a plurality of alternating phases of energy supplied from the source, a predetermined temperature within a gated rectifying circuit, an improper electrical connection by a circuit connector, and the movement of the vehicle to a first position adjacent to a landing at which a stop is being made and the subsequent movement to a second position.

In another aspect of the invention, the transportation system operates to transfer from a first mode providing normal service between a plurality of landings to a second mode in response to a sensed malfunction and renders the motive means essentially inoperative for supplying a driving force to the vehicle and automatically operates a braking means as essentially the sole control for guiding the vehicle to one of the landings.

A highly desirable brake control circuit is provided which controls a braking means having a friction braking element selectively coupled to the motive means output for permitting vehicle movement and retarding movement and retaining the vehicle in a stopped position with respect to the structure. A transfer means operates in response to a sensed malfunction to modify the operation of the brake control circuit to selectively lift and set the braking element to operate the vehicle within a predetermined velocity.

The selective operation of the braking element in response to a sensed malfunction guides the vehicle to one of the landings in accordance with the predetermined velocity restriction. In addition to selectively lifting and setting the braking element when guiding the vehicle to a landing in response to a sensed malfunction, the brake control circuit operates to selectively vary the braking force exerted by the friction element upon the motive means output when in an established set or braking condition.

The brake control circuit functions in response to one or more sensed conditions within the transportation system whenever the system operation has been modified in response to certain sensed malfunctions. Specifically, three sequences each operate to independently connect a monitoring circuit into effective operation in response to a sensed malfunction to sense the operation of the transportation system and control the operation of the braking element. In a preferred form of the invention, the brake control circuit operates in response to the sensed velocity of the vehicle and the sensed armature voltage to maintain vehicle movement below the predetermined velocity by controlling the operation of the braking means in response to the sensed malfunction.

In another aspect of the invention, the control means provides first and second outputs in response to sensed first and second functions or conditions, respectively, of the transportation system to operate the vehicle in response to a sensed malfunction below a first pedetermined velocity in response to the first and second outputs and below a second predetermined velocity in response to the first output and the loss of the second output.

In a preferred form of the invention, an armature voltage signal and a velocity signal are both supplied to the brake control circuit and are operative in response to a sensed malfunction to maintain the vehicle below a first predetermined speed. The loss of either the velocity signal or the armature voltage signal is effective to maintain the vehicle movement below a second predetermined velocity different than the first predetermined velocity when operating in response to the sensed malfunction.

In a preferred form of the invention, the brake control circuit includes a gated rectifying circuit coupled to a source of energy and to the friction braking element for selectively supplying energy to operate the braking element. The conduction of energy by the gated rectifying circuit is selectively controlled by a summing circuit which operatively receives a command signal to lift the braking element and permit movement of the vehicle and is operatively connected to receive the velocity signal and the armature voltage signal in response to a sensed malfunction for modifying the operation of the gated rectifying circuit and thus the friction braking element to maintain the vehicle below the predetermined velocity.

In the preferred form of operation, the transfer means operates in response to a sensed malfunction and selectively connects a circuit receiving the velocity signal and the armature voltage signal to operatively control the operation of the brake gated rectifying circuit. A first summing circuit operatively receives the velocity signal and the armature voltage signal which, in turn, is selectively coupled to a second summing circuit through a unipolar circuit to supply a modulating control signal to the second summing circuit having a proper polarity for combination with the command signal.

The brake control circuit also monitors the energy supplied to the braking means and provides a signal proportional to the monitored brake energy to the second summing circuit for summation with the modulating signal and the command signal. The gated rectifying circuit is connected to the second summing circuit through a gating control circuit which operates to control the conduction of the gated rectifying circuit in response to the output of the second summing circuit. The brake gating control circuit also monitors the source for selectively rendering the gated rectifying circuit conductive in response to the phase sequence of the energy supplied by the source.

The transportation system further operates when modifying the operation of the brake control circuit in response to a sensed malfunction to operate the vehicle within a predetermined velocity to render the motive means inoperative for supplying a driving force to the vehicle thus permitting the vehicle to travel in either direction according to the inertia of the moving system and the gravity forces acting thereon.

Various sequences are provided by the control means and are operatively coupled to control the operation of the braking means and the movement of the vehicle during a normal mode of operation. A first sequence means is operatively coupled to the braking means to permit vehicle movement from one of the landings, a second sequence means is operatively coupled to the braking means to permit vehicle movement until arriving at a first position adjacent to a landing at which a stop is to be made, and a third sequence means is operatively coupled to the braking means in response to the vehicle arriving at a second position with respect to a landing at which a stop is to be made to permit vehicle movement. A sensed malfunction operatively disconnects or removes the first and third sequences from effective operation while permitting continued operative control by the second sequence means to guide the vehicle to one of the landings. Another sensed malfunction is effective for operatively removing or disconnecting the first, second and third sequences from effective operation to immediately stop the vehicle from continued operation.

An energy dissipating circuit is selectively connected under certain conditions to an armature circuit of the motive means which directly receives energy from a gated rectifying circuit. Specifically, a control means selectively connects the energy dissipating circuit to the armature circuit in response to a selected sensed malfunction and provides a dynamic braking to the vehicle.

In another aspect of the invention, a first sequence means operates in response to a first sensed malfunction and maintains the dissipating circuit disconnected from the armature circuit while a second sequence means operates in response to a sensed second malfunction and connects the energy dissipating circuit to the armature circuit for providing dynamic braking. The energy dissipating circuit is preferably maintained in a disconnected condition when operating in response to the sensed first malfunction until the vehicle at least arrives at a first position adjacent to a landing at which a stop is to be made.

In another aspect of the invention, a timing means is operatively coupled to selectively connect the energy dissipating circuit to the armature circuit at a predetermined time after the vehicle has stopped at a landing when operating under a normal mode of operation. The transfer means operates in response to a sensed malfunction to modify the operation of the timing means so that the energy dissipating circuit is connected to the armature circuit substantially at the time the vehicle is stopped at the landing.

The invention provides a highly desirable system for rendering the motive means essentially inoperative for supplying a driving force to the vehicle and automatically operating the braking means as essentially the sole control for guiding the vehicle to one of the landings in response to a sensed malfunction. Specifically, a transfer means renders the motive means inoperative for supplying a driving force to the vehicle independent of the braking means in response to the sensed malfunction. In this regard, the transfer means includes a circuit coupled to the malfunction monitor and directly coupled to a gating control circuit which controls the operation of a gated rectifying circuit and is effective to terminate the supply of energy between the source and the motive means in response to a sensed malfunction. When operating in response to a sensed malfunction, the transfer circuit supplies a disable signal to a switching circuit within the gating control circuit which, in turn, operates from a first condition to a second condition to operatively supply a disabling control signal to render the gated rectifying circuit inoperative.

In another aspect of the invention, a coupling circuit is connected between the gated rectifying circuit and the motive means and is operatively coupled to the transfer means so that a sensed malfunction is effective for opening the coupling circuit to disconnect the gated rectifying circuit from the motive means.

A pattern circuit within the control means is operative for generating a command signal which operatively controls the conduction of energy between the source and the motive means for commanding movement of the vehicle and is selectively rendered inoperative in response to a sensed malfunction. Specifically, the transfer means is coupled to a command circuit to operatively transfer the circuit output from a run signal to a stop signal in response to a sensed malfunction. The transfer means also responds to a sensed malfunction to transfer a circuit output within the pattern circuit from a certain maximum velocity limitation to a zero maximum velocity limitation. The pattern circuit further includes integrating amplifiers which are operatively coupled to formulate a command signal during a normal operation but are rendered inoperative by the transfer means in response to a sensed malfunction. One integrating amplifier rendered ineffective generaly provides an output signal commanding a predetermined velocity by the vehicle under a normal mode of operation while another integrating amplifier provides an output signal commanding a predetermined acceleration by the vehicle under a normal mode of operation.

In another aspect of the invention, a leveling circuit becomes operative for generating a command signal which operatively controls the conduction of energy between the source and the motive means for commanding movement of the vehicle when the vehicle approaches one of the landings at which a stop is to be made and is rendered inoperative in response to a sensed malfunction. Specifically, an integrating amplifier in the leveling circuit is rendered inoperative for generating a leveling command signal in response to a sensed malfunction. In addition, a modifying circuit within the leveling circuit which operates to provide a leveling command signal in response to the sensed position of the vehicle is operatively disconnected from a position sensor in response to the sensed malfunction. The leveling circuit also includes a circuit which provides a maximum velocity limitation and is rendered inoperative and, in essence, imposes a zero velocity limitation in response to a sensed malfunction. The leveling circuit further includes a releveling control circuit which operatively returns the vehicle to a landing at which a stop is to be made when the vehicle has passed the landing and is rendered inoperative in response to a sensed malfunction.

The control means of the present invention provides a pair of sequence means each effective for rendering the pattern circuit ineffective in response to a sensed malfunction thus insuring a safe operation.

The transportation system further provides an error circuit which is connected to receive a command signal from the pattern circuit and a motive means output proportional signal for generating an error signal operatively connected to control the conduction of energy between the source and the motive means thus controlling the movement of the vehicle. The transfer means of the system operates in response to a sensed malfunction to disconnect the pattern circuit from the error circuit to insure a safe operation.

An amplifying means is connected to receive the error signal from the error circuit during a normal mode of operation while the transfer means is operatively connected for rendering the amplifying means inoperative to control the conduction of energy between the source and the motive means in response to a sensed malfunction. One amplifying circuit is directly connected to receive the error signal while another amplifying circuit is connected to receive the error signal through a summing circuit which, in turn, is also connected to operatively receive a signal indicative of the energy conducted between the source and the motive means. A pair of sequences are each operable for rendering the amplifying means ineffective.

The transfer means of the present invention preferrably provides a first response corresponding to a sensed first malfunction and a second response corresponding to a sensed second malfunction to initiate a transfer from a first mode providing normal service between a plurality of landings and a second mode of operation rendering the motive means essentially inoperative for supplying a driving force to the vehicle and guiding the vehicle to one of the landings. Specifically, the first response of the transfer means provides a first sequence pattern while the second response provides a second sequence pattern.

The malfunction monitoring system of the present invention is coupled to receive operating energy from a source through a coupling circuit in response to the system operating within the normal mode of operation. A sequence means is provided for maintaining the supply of energy to the monitoring circuits to continually sense a second malfunction until the vehicle arrives within a first position adjacent to a landing at which a stop is to be made even though the system has transferred to the second mode in response to a sensed first malfunction. A timing means is operatively connected to the coupling circuit and maintains the supply of operating energy to the monitoring circuit for a predetermined time after the vehicle has stopped at a landing when operating within the first mode. The transfer means operates in response to a sensed malfunction to render the timing means ineffective for maintaining the supply of energy to the monitoring circuit for the predetermined time.

The transfer means within the invention is operative to provide a first output for conditioning the control means to provide a first mode of normal operation and a second output in response to a sensed malfunction to condition the control means to provide a second mode of operation which renders the motive means inoperative for supplying a driving force to the vehicle and guides the vehicle to one of the landings. An interlock circuit operates in response to the second output and is coupled to maintain the second output to continually provide the second mode of operation. In a preferred form of the invention, the transfer means automatically switches from the first output to the second output in response to a sensed malfunction and includes a selectively manually operable means which permits the transfer means to switch from the second output to the first output in response to the lack of the malfunction.

In another aspect of the invention, means is provided which operably senses the registration of demands for service at the landings and stops the vehicle at the selected landing to service the required demand. The demand sensing means is operatively modified in response to a sensed malfunction and simulates a demand for service at a pair of adjacent landings. Such a demand simulation is effective to condition the control circuit to stop the vehicle at either of the adjacent landings in response to the sensed malfunction. In addition, the simulation of an artificial demand for service renders a position sensing means operative to initiate a stop of the vehicle when arriving at a predetermined distance from one of the adjacent landings. Such a position sensing device preferably includes a leveling sensor.

A sequence means is operatively coupled to the demand simulating means and maintains a demand simulation for vehicle service at an adjacent landing in response to the sensed malfunction until the vehicle arrives at a first position adjacent to the landing at which a stop is to be made.

A monitor within the present invention senses the energy flowing between the source and an armature circuit of the motive means and transfers the system operation from a first mode providing normal service between a plurality of landings and a second mode which guides the vehicle to one of the landings in response to the armature energy signal increasing to or exceeding a predetermined magnitude.

The armature energy monitor preferrably includes a summing circuit connected to receive the energy signal and a reference signal supplied from a reference circuit to initiate the transfer from the first mode to the second mode whenever the energy signal increasing to a magnitude having a predetermined relationship with respect to the reference signal. In a preferred form of the invention, the energy signal is directly proportional to the armature current.

In another aspect of the invention, the transportation system supplies controlled amounts of energy between the source and the armature circuit of the motive means by the use of a gated rectifying circuit which operates in response to a gating control circuit. The monitor senses the energy flowing between the source and the armature circuit and responds to the armature energy increasing to or exceeding a predetermined magnitude to operatively disable the gating control circuit and render the gated rectifying circuit incapable of conducting energy between the source and the armature circuit.

In a preferred form of the invention, a transfer means includes a switching circuit such as a transistor, for example, connected to the summing circuit of the armature current monitor and provides a first output supplying a first disable signal to a gating control circuit through a connector circuit and a second output supplying a second disable signal through a sample and hold circuit to the gating control circuit through the connector circuit in response to the armature energy signal increasing to the predetermined magnitude to render the rectifying circuit incapable of supplying energy to the motive means armature circuit.

The transfer means also operatively opens a coupling circuit to disconnect the gated rectifying circuit from the armature circuit in response to the sensed malfunction.

In another aspect of the invention, the armature current monitor includes a memory means operable from a first condition to a second condition in response to the armature energy signal exceeding a predetermined magnitude and maintains the second condition for a predetermined time after the energy signal decreases below the predetermined magnitude to provide a continued disable of the armature gating circuit.

The armature current monitor includes a unipolar circuit coupled to receive the armature energy signal and provides a varying signal having a plurality of repetitive negative polarity portions proportional to the armature current. The armature current monitor responds to one negative polarity portion increasing to the predetermined magnitude to transfer the system operation from the first mode to the second mode. The monitor thus quickly responds because the one negative polarity portion occurs within a single electrical cycle of the source frequency. The armature current monitor is very accurate because the reference circuit provides a constant magnitude positive polarity reference signal.

In another aspect of the invention, the transfer means responds to the energy flow between the source and the motive means increasing to a predetermined magnitude by operatively modifying the operation of a brake control circuit to selectively operate a braking element to maintain the vehicle below a predetermined velocity for safe operation.

The transportation system provides a pair of sequences for transferring from a first mode providing normal service between a plurality of landings and a second mode established in response to a sensed malfunction guiding the vehicle to one of the landings. Specifically, a transfer means provides a first sequence means operatively providing the second mode in response to the energy flowing between the source and an armature circuit of the motive means exceeding a first predetermined magnitude and a second sequence means operatively providing the second mode in response to the energy flowing between the source and the armature circuit exceeding a second predetermined magnitude.

In another aspect of the invention, the transportation system provides motive means including an armature circuit and a field circuit separately coupled to a source of energy and a monitor coupled to sense the energy flowing between the source and the field circuit. The system operatively transfers from a first mode of operation providing normal service between a plurality of landings and a second mode of operation established in response to the field energy or signal decreasing below a predetermined magnitude to guide the vehicle to one of the landings.

The field energy monitor senses the predetermined magnitude of field energy which is required for mode transfer at a substantially constant level during both an accelerating sequence and a maximum velocity sequence of the transportation system.

The field energy monitor includes a summing circuit connected to receive a field energy signal preferrably proportional to the field current and a reference signal supplied from a reference circuit. The monitor operates to initiate a transfer from the first mode to the second mode in response to the field energy signal decreasing to a predetermined magnitude with respect to the reference signal. The transfer means preferrably includes a switching circuit connected to the field energy monitor and selectively provides a first output conditioning the control means to provide the first mode and a second output in response to the field energy decreasing below the predetermined magnitude conditioning the control means to provide the second mode. A gated rectifying circuit associated with the motive means is rendered inoperative in response to the second output to terminate the flow of energy between the source and the motive means. Specifically, the transfer means operates in response to the field energy decreasing to the predetermined magnitude to render a gating control circuit inoperative through a disable circuit and to open a coupling circuit to disconnect the gated rectifying circuit from the motive means armature circuit.

In another aspect of the invention, the field energy monitor operatively modifies the operation of a brake control circuit in response to the field energy decreasing below a predetermined magnitude to selectively operate a braking element to maintain the vehicle below a predetermined speed and guide the vehicle to one of the landings.

The field energy monitor operatively responds to a command for vehicle movement. Specifically, the control means includes a first sequence means supplying energy from the source to the field circuit and a second sequence means supplying a reference signal to the field energy monitor in response to a command for vehicle movement. The transfer means operates to maintain a braking element of the braking means in a set condition in response to the field energy signal varying to a magnitude having a predetermined relationship with respect to the reference signal to prevent vehicle movement.

The transportation system thus provides a highly desirable field energy monitor which checks the buildup and sufficiency of field energy upon receiving a movement command before the vehicle is allowed to move. In a preferred construction, the energy signal is directly proportional to the field current while the reference signal includes a first signal portion varying from a zero magnitude to a second predetermined magnitude within a predetermined time and a second signal portion remaining substantially at the second predetermined magnitude.

In another aspect of the invention, the field energy monitor compares a field energy indicative signal with a reference signal to selectively modify the operation of the control means in response in the difference between the field signal and the reference signal exceeding a predetermined value.

In a preferred embodiment, the field energy monitor includes a summing circuit connected to receive the field energy signal and the reference signal from a reference circuit in response to the conditioning of the control means to initiate vehicle movement. The transfer means responds to the field energy signal varying to a magnitude having a predetermined relationship with respect to the reference signal and is coupled through a disable circuit to supply a disable signal to a gating control circuit to render a gated rectifying circuit inoperative to prevent the flow of energy between the source and the motive means.

In another aspect of the invention, an error circuit is operatively connected to receive a command signal from a pattern circuit and a motive means output proportional signal to provide an error signal which is operatively connected to control the operation of the motive means to move the vehicle relative to the structure and to stop the vehicle at a selected landing. A malfunction monitor senses the error signal and operatively transfers the system operation from a first mode providing normal service between a plurality of landings and a second mode rendering the motive means inoperative for supplying a driving force to the vehicle and operates the braking means and guides the vehicle to one of the landings in response to the error signal increasing to a predetermined magnitude. In a preferred embodiment, a tachometer is utilized to provide the output proportional signal.

The error signal monitor preferrably utilizes a summing circuit to receive the error signal and a reference signal from a reference circuit to provide an output signal operatively coupled to transfer the system operation from the first mode to the second mode whenever the error signal increases to a predetermined magnitude with respect to the reference signal. The error signal monitor preferrably utilizes two sensing channels with a first channel coupled to sense a positive polarity error signal which commands a first output by the motive means and a second channel coupled to sense a negative polarity error signal which commands a second output by the motive means. The monitor is effective for transferring from the first mode to the second mode whenever either the positive portion or the negative portion of the error signal increases in absolute value to a predetermined magnitude. The two channels are connected to the error circuit through a logic OR circuit. The first channel includes a first summing cricuit connected to receive a positive error signal and a negative polarity reference signal from a first reference circuit to provide a first output in response to the positive error signal increasing to a predetermined magnitude with respect to the negative reference signal. The second channel includes a second circuit connected to receive a negative error signal and a positive polarity reference signal from a second reference circuit to provide a second output in response to the negative error signal increasing to a predetermined magnitude with respect to the positive reference signal. The first and second outputs from the first and second summing circuits, respectively, are each effective for transferring the system operation from the first mode to the second mode.

The transfer means is coupled to the error signal monitor and includes a switching circuit having a first output operatively providing a first mode of operation and a second output operatively providing a second mode of operation in response to the error signal increasing to a predetermined magnitude. The transfer means includes a disable circuit connected to supply a disable signal to a gating control circuit operatively rendering the motive means gated rectifying circuit inoperative to prevent energy from flowing between the source and the motive means. In addition, the second output of the transfer means operatively opens a coupling circuit to disconnect the gated rectifying circuit from the motive means to render the motive means inoperative for supplying a driving force to the vehicle.

The error signal monitor is operatively coupled to modify the operation of the brake control circuit in response to the error signal increasing to a predetermined magnitude to selectively operate the braking element to maintain the vehicle below a predetermined speed for operation within the second mode.

The error signal could increase very rapidly to the predetermined magnitude thereby initiating a transfer to the second mode of operation when the output proportional signal is lost or becomes disconnected, particularly when the pattern circuit is providing a substantial command signal to the error circuit.

In another aspect of the invention, the error signal monitor operatively senses a malfunction occurring within itself. Specifically, the error signal monitor switches from a first output to a second output in response to a malfunction sensed within the error signal monitor while the vehicle is moving to operatively provide the second mode of operation. One such malfunction within the monitor could include the loss of operating power supplied from the source to the monitor.

In another aspect of the invention, the error signal monitor senses its own malfunction as soon as the transportation system receives a command to initiate vehicle movement and operatively prevents the vehicle from leaving the landing. Specifically, the error signal monitor either switches from a first output to a second output or maintains the second output in response to a sensed malfunction within its own circuitry to modify the operation of a brake sequence means to maintain the braking means in a set condition to prevent vehicle movement from a landing. If during the initial checkout stage the error signal monitor does not sense a malfunction within its own circuitry such as the loss of operating power supplied from the source, the monitor will positively switch to provide the first output in response to the command for vehicle movement which operatively conditions the brake sequence means to provide a brake lifting operation and permit vehicle movement from the landing.

In another aspect of the invention, a monitor is coupled to sense the position of the vehicle whenever it approaches a landing at which a stop is to be made. The position monitor operates in response to the vehicle arriving at a first position adjacent to a landing at which a stop is to be made and the subsequent movement of the vehicle to a second position having a greater distance from the landing than the first position to operatively transfer the system operation from a first mode providing normal service between a plurality of landings and a second mode wherein a braking element is set to prevent further movement of the vehicle.

In a preferred form of the invention, the control means provides a first sequence means operatively coupled to the braking means and permits the vehicle to move until it arrives at a first position adjacent to a landing at which a stop is to be made and a second sequence means operatively coupled to the braking means in response to the vehicle arriving at a third position with respect to the landing at which the stop is to be made to permit continued vehicle movement. The position monitor senses the improper movement of the vehicle to transfer the system operation to the second mode wherein the second sequence means is rendered inoperative for permitting vehicle movement. In a preferred construction, the third position is spaced from the landing by a greater distance than the first and second positions and the first sequence means is also rendered inoperative for permitting vehicle movement in response to the sensed improper vehicle movement.

In another aspect of the invention, monitoring means operatively senses a number excessive velocities to selectively control the operation of the braking means. Specifically, a sensed first predetermined velocity renders a first sequence means within the control circuit operative for transferring a braking element from a lifted condition to a set condition, a sensed second predetermined velocity renders a second sequence means operative for transferring the braking element from the lifted condition to the set condition and a sensed third predetermined velocity renders a third sequence means operative for transferring the braking element from the lifted condition to the set condition. In a preferred construction, the monitoring means includes a tachometer coupled to sense the first predetermined velocity, a governor to sense the second predetermined velocity and a safety clamp to sense the third predetermined velocity. Such redundant velocity sensing provides a highly desirable system for insuring a safe elevator operation.

In another aspect of the invention, a gated rectifying circuit is rendered inoperative to supply energy to a braking means in response to a sensed malfunction to stop the vehicle. In a preferred construction, a gating control circuit includes a switching circuit operable between a first condition and a second condition to selectively supply a gating control signal to the gated rectifying circuit to control the supply of energy to the braking means. A transfer means includes a disable means coupled to a malfunction monitor to supply a disable signal to the gating control circuit to transfer the switching circuit from the first condition to the second condition in response to a sensed malfunction thereby terminating the supply of energy to the braking means to stop the vehicle. The transfer means also provides a second disable means which operatively opens a coupling circuit to disconnect the gated rectifying circuit from the braking means in response to a sensed malfunction to stop the vehicle.

In another aspect of the invention, a gated rectifying circuit is rendered inoperative to supply energy to a braking means in response to a first sensed malfunction to stop the vehicle and is conditioned for operation to selectively supply energy to the braking means in response to a sensed second malfunction to permit continued vehicle movement. The gated rectifying circuit is conditioned to supply varied controlled amounts of energy to the braking means in response to the sensed second malfunction.

In another aspect of the invention, a velocity monitor operatively controls a brake gating control circuit which selectively supplies energy from a source to a braking means through a controlled brake gated rectifying circuit. The monitor responds to the vehicle exceeding a predetermined velocity and operatively modifies the operation of the gating control circuit to terminate the supply of energy to the braking means and stop the vehicle.

The velocity monitor is also operatively coupled to a motive means gating control circuit which controls the operation of an associated gated rectifying circuit and the selective conduction of energy between a source and the motive means. The monitor operatively modifies the operation of the gating control circuit in response to the velocity exceeding a predetermined magnitude to terminate the flow of energy between the source and the motive means.

The control means in a preferred construction includes a first coupling circuit connecting the brake gated rectifying circuit to the braking means and a second coupling circuit connecting the motive means gated rectifying circuit to the motive means. A transfer means is coupled to the velocity monitor and operably opens the first and second coupling circuits to disconnect the braking means and the motive means from the source in response to the vehicle exceeding a predetermined velocity.

The velocity monitor in a preferred construction includes a summing circuit connected to operatively receive a velocity signal from a tachometer coupled to the output of the motive means and to receive a reference signal from a reference circuit. The velocity monitor operatively modifies the operation of the system whenever the velocity signal increases to a predetermined magnitude with respect to the reference signal. The velocity monitor also includes a unipolar circuit connected between the summing circuit and the tachometer so that the velocity signal being summed with the reference signal remains at the same polarity irrespective of the direction of vehicle travel.

A transfer means in a preferred construction includes a switching circuit coupled to the velocity monitor which transfers from a first output to a second output in response to the velocity signal increasing to a predetermined magnitude with respect to the reference signal. The first output of the switching circuit is operative to condition the control means to provide both a first mode providing normal service between a plurality of landings and a second mode established in response to a first malfunction which guides the vehicle to one of the landings. The second output of the switching circuit is effective for operatively providing a third mode in response to the vehicle exceeding a predetermined velocity constituting a second malfunction which modifies the operation of the brake gating control circuit to terminate the supply of energy to the braking means to stop the vehicle.

In another aspect of the invention, the transportation system provides a first mode providing normal service between a plurality of landings and a second mode established in response to a sensed first malfunction which guides the vehicle to one of the landings and a third mode which stops the vehicle. A malfunction monitor operatively transfers the system operation from the first mode to the third mode in response to a sensed first predetermined velocity and operatively transfers from the second mode to the third mode in response to a sensed second predetermined velocity of the vehicle.

In a preferred construction, the malfunction monitor includes a first coupling circuit sensing the first predetermined velocity and a second coupling circuit sensing the second predetermined velocity. In operation, the first coupling circuit senses the vehicle velocity when the system is operating within the first mode and the second coupling circuit senses the vehicle velocity when the system is operating in the second mode. The coupling circuits are selectively connected to supply a velocity proportional signal to a summing circuit which, in turn, also receives a reference signal for controlling the operation of the system.

In another aspect of the invention, a malfunction monitor operatively transfers the system operation from a first mode providing normal service between a plurality of landings and a second mode established in response to a sensed first malfunction which guides the vehicle to one of the landings and a third mode established in response to a sensed second malfunction of the energy source to stop the vehicle.

In a preferred embodiment, a friction braking element is selectively operated between a set condition and a lifted condition to guide the vehicle to one of the landings for operation within the second mode while the braking element is transferred to the set condition to stop the vehicle when operating in the third mode in response to a sensed malfunction of the energy source.

The source monitor in a preferred embodiment operatively modifies the operation of a brake gating control circuit in response to a sensed malfunction of the energy source to stop the energy flow from the brake gated rectifying circuit to the braking means thus setting the braking element to stop the car. The source monitor also operatively modifies the motive means gating control circuit in response to a sensed malfunction of the energy source to stop the energy flow between the associated gated rectifying circuit and the motive means. A transfer means includes a first disable means coupled to operatively disable the brake gating control circuit and the motive means gating control circuit and a second disable means coupled to operatively open first and second coupling circuits to disconnect the brake gated rectifying circuit from the braking means and the motive means gated rectifying circuit from the motive means in response to a sensed malfunction of the energy source. The first disable means is preferrably constructed to supply first and second disable signals to the brake and motive means gating control circuits in response to a sensed malfunction of the energy source.

The transfer means in a preferred embodiment provides a switching circuit coupled to the source monitor to provide a first output to condition the control means to provide the first and second modes and a second output to condition the control means to provide the third mode in response to a sensed malfunction of the energy source. The transfer means also provides a memory means operable from a first condition to the second condition in response to the second output of the switching circuit and operatively maintains the second output for a predetermined time after the loss of the energy source malfunction.

The energy source monitor operatively transfers the system operation to the third mode to stop the vehicle in response to a sensed source energy decreasing to a predetermined magnitude. In a preferred construction, a summing circuit receives a first polarity reference signal and a second polarity signal proportional to the sensed energy to provide an output signal operatively coupled to the transfer means to provide the third mode in response to the second signal decreasing to a magnitude having a predetermined relationship with respect to the first signal in response to the energy decreasing to the predetermined magnitude. The reference signal preferrably remains at a substantially constant magnitude when monitoring the system.

The energy source monitor operatively transfers the system operation to the third mode to stop the vehicle in response to a sensed loss of one of the phases of energy provided by the source. In a preferred construction, the source monitor provides a summing circuit receiving a first polarity reference signal and a second polarity signal responsive to the plurality of alternating phases of energy provided by the source and supplies an output signal operatively coupled to the transfer means to provide the third mode in response to the second signal decreasing to a magnitude having a predetermined relationship with respect to the first signal in response to the loss of one of the phases. The reference signal preferrably remains at a substantially constant magnitude when monitoring the system.

The energy source monitor includes a circuit having a plurality of rectifying elements which sense the plurality of alternating phases of energy. The transfer means operates in response to a sensed failure of one of the rectifying elements within the monitor to transfer the system operation to the third mode to stop the vehicle.

The energy source monitor transfers the system operation to the third mode to stop the vehicle in response to a sensed improper phase sequence of the alternating phases of energy. In a preferred construction, the energy source monitor provides a summing circuit receiving a first reference signal and a second signal responsive to the sequential order of the plurality of alternating phases of energy and supplies an output signal operatively coupled to the transfer means to provide the third mode in response to the second signal changing in response to the sensed improper phase sequence to a magnitude having a predetermined relationship with respect to the first signal. The reference signal preferrably remains at a substantial constant magnitude when monitoring the system.

Certain common circuitry is utilized to sense a plurality of malfunctions which might occur within the source of energy. In a preferred construction, the energy source monitor provides a summing circuit receiving a first reference signal from a reference circuit, a second signal continually responsive to a number of a plurality of alternating phases of energy supplied from the source and a third signal continually responsive to the sequential order of the plurality of alternating phases of energy. The three signals are combined to operatively provide a first output conditioning the control means to provide the first and second modes of operation and a second output conditioning the control means to provide the third mode in response to a sensed abnormal condition existing within the alternating phases. The summing circuit also operatively senses the magnitude of the energy source by sensing the second signal.

In another aspect of the invention, the transportation system operatively transfers between a first mode providing normal service between a plurality of landings and a second mode established in response to a sensed first malfunction guiding the vehicle to one of the landings and a third mode established in response to a second malfunction of a predetermined temperature sensed within the control means stopping the vehicle.

In a preferred construction, the monitor is coupled to sense the temperature at or near a gated rectifying circuit which selectively supplies varying amounts of energy between a source and the motive means.

The transfer means includes a switching circuit operatively coupled to the temperature monitor and provides a first output conditioning the control circuit to provide the first and second modes and a second output operatively providing the third mode in response to the sensed temperature increasing to the predetermined magnitude. The transfer means in a preferred embodiment also provides a disable means responsive to the second output of the switching circuit and operative to directly disable the brake gating control circuit and the motive means gating control circuit to terminate the supply of energy from the source to the braking means and between the source and the motive means in response to the sensed temperature increasing to the predetermined magnitude. The transfer means provides a second disable means operatively coupled to open a pair of coupling circuits to disconnect the brake gated rectifying circuit from the braking means and the motive means gated rectifying circuit from the motive means in response to the sensed temperature increasing to the predetermined magnitude.

In another aspect of the invention, the transportation system selectively operates to provide a first mode providing normal service between a plurality of landings and a second mode established in response to a first malfunction to guide the vehicle to one of the landings and a third mode established in response to a second malfunction to stop the vehicle. The malfunction monitor includes means for sensing the proper electrical connection of a circuit connector within the control means and is coupled to condition the transfer means to provide a first output in response to a sensed proper electrical connection for conditioning the control means to provide the first and second modes and a second output in response to a sensed improper electrical connection for conditioning the control means to provide the third mode.

In a preferred embodiment, the circuit connector whose connection is being monitored is located between a gating control circuit and a gated rectifying circuit operable to control the supply of armature current between the source and the motive means. The transfer means in a preferred embodiment provides a switching circuit operative to selectively provide the first and second outputs and a disable means coupled to control a brake gating control circuit and the motive means gating control circuit to operatively render the brake gated rectifying circuit and the motive means gated rectifying circuit inoperative for supplying energy from the source to the braking means and between the source and the motive means in response to a sensed improper circuit connection. The transfer means also provides a second disable means operatively coupled to open two coupling circuits to disconnect the braking means from the associated gated rectifying circuit and the motive means from the associated gated rectifying circuit in response to the improper circuit connection.

In another aspect of the invention, the malfunction monitor provides a velocity detector operatively connected to sense a malfunction within itself to modify the operation of the system. In this regard, a control means provides a first mode providing normal service between the plurality of landings and a second mode established in response to a sensed first malfunction to guide the vehicle to one of the landings and a third mode established in response to a sensed second malfunction to prevent the movement of the vehicle. A transfer means coupled to the velocity detector operatively provides a first output in response to a proper operating velocity and conditioning the control means to provide the first and second modes and a second output in response to an improper predetermined velocity operatively providing the third mode. The transfer means is responsive to a sensed malfunction of the velocity detector and provides the second output to operatively provide the third mode.

The system operates to continually sense a malfunction in the velocity detector during movement of the vehicle and also upon receiving a command for vehicle service prior to vehicle movement. A malfunction of the velocity detector prior to vehicle movement operatively prevents the vehicle from leaving a landing. One such malfunction includes the loss of operating power supplied from the source to the detector.

In a preferred construction, a sensed malfunction in the velocity detector prior to vehicle movement operatively modifies a brake operating sequence means in response to the second output of the transfer means to maintain the brake element in a set condition and prevent movement of the vehicle from one of the landings. The first output of the transfer means operatively conditions the sequence means to permit the braking element to lift and permit vehicle movement from one of the landings.

In another aspect of the invention, a control means provides a sequence means operatively coupled to a braking means and permits vehicle movement until the vehicle arrives at a first position adjacent to a landing at which a stop is to be made. A transfer means responds to the operation of a monitor and selectively conditions the sequence means to provide continued operative control over the braking means in response to a sensed first malfunction and renders the sequence means inoperative for controlling the braking means in response to a second sensed malfunction.

In a further aspect of the invention, the control means provides a second sequence means operatively coupled to the braking means and permits vehicle movement from one of the landings. The second sequence means is rendered inoperative by the transfer means for controlling the braking means in response to either the first sensed malfunction or the second sensed malfunction. In addition, the control means provides a third sequence means operatively coupled to the braking means in response to the vehicle arriving at a second position with respect to the landing in which a stop is to be made to permit vehicle movement. The third sequence means is rendered inoperative by the transfer means for controlling the braking means in response to either the first sensed malfunction or the second sensed malfunction.

In another aspect of the invention, an interlock circuit operates in response to a plurality of modes of operation including a first mode providing normal service between a plurality of landings and a second mode rendering the motive means inoperative for supplying a driving force to the vehicle and guiding the vehicle to one of the landings and a third mode which stops the vehicle. Specifically, the transfer means provides a first output to condition the control means to provide the first mode and a second output in response to a sensed first malfunction to condition the control means to provide the second mode and a third output in response to a sensed second malfunction to condition the control means to provide the third mode and the interlock circuit operatively establishes the second output in response to the third output. In a preferred form of the invention, the interlock circuit operatively transfers from a first condition to a second condition in response to the second output and is coupled to maintain the second output in response to the second condition. The interlock circuit preferrably automatically transfers from the first condition to the second condition in response to the second output and includes a selectively manual means operatively transferring the interlock circuit from the second condition to the first condition in response to the lack of the first and second malfunctions. The interlock circuit preferrably includes first and second sequence means each operatively responding to the second output and providing the second condition.

In another aspect of the invention, a gated rectifying circuit is controlled to selectively conduct energy between a source of energy and a motive means while a monitor senses the energy supplied by the source. A transfer means responds to the monitor and transfers the system operation from a first mode operating the vehicle under a first predetermined maximum velocity limitation and providing normal service between a plurality of landings to a second mode operating the vehicle under a second predetermined maximum velocity limitation in response to the sensed energy decreasing to a predetermined magnitude.

In a preferred construction, the gated rectifying circuit directly supplies energy to an armature circuit of the motive means while the monitor operatively senses the electrical voltage of the source energy for regulating the maximum velocity limitation for the vehicle. The monitor provides a circuit which senses the source energy and provides a first output in response to the energy existing above a predetermined magnitude operatively conditioning the control means to provide the first mode and a second output in response to the energy decreasing to the predetermined magnitude operatively conditioning the control means to provide the second mode. In a preferred construction, the control means includes a pattern circuit generating a first pattern command signal having the first predetermined maximum velocity limitation for operation in the first mode and a second pattern command signal having the second predetermined maximum velocity limitation for operation in the second mode.

The transportation system preferably transfers from a first mode providing a first predetermined maximum velocity limitation to a second mode providing a second predetermined maximum velocity limitation by a transfer means switching from a first output to a second output in response to a movement command signal and a decrease of the source energy to a predetermined magnitude. The transfer means further provides a latching circuit operable in response to the second output to maintain the second output after the removal of the movement command signal.

In another aspect of the invention, a transfer means operatively provides a first output conditioning a control means to provide a first mode operating the vehicle under a first predetermined maximum velocity limitation and a second output conditioning the control means to provide a second mode operating the vehicle under a second predetermined maximum velocity limitation in response to the source energy decreasing to a predetermined magnitude. A coupling means operates in response to the operation of a braking means and operatively transfers the transfer means from the second output to the first output when the source energy increases above the predetermined magnitude. Such switching of the transfer means from the second output to the first output is thus accomplished by the operation of the braking means such as when the vehicle stops at a landing thereby transferring from the second mode to the first mode of operation.

In another aspect of the invention, the transportation system provides a first sequence means operatively coupled to a braking means to set a braking element in response to the vehicle traveling beyond a terminal landing by a first predetermined distance when operating within a first mode and a second sequence means operatively coupled to the braking means in response to the source energy decreasing to a predetermined magnitude to set the braking element in response to the vehicle traveling beyond the terminal landing by a second predetermined distance when operating within a second mode. In a preferred construction, the first sequence means includes a high speed limit switch while the second sequence means includes a reduced speed limit switch.

In another aspect of the invention, a control means operatively commands a first maximum speed when moving the vehicle from one landing to an immediately adjacent landing and a second maximum speed when moving the vehicle from one landing to a landing spaced from the immediately adjacent landing. A transfer means operating in response to a sensed malfunction modifies the operation of the control means and operates the vehicle at the first maximum speed when moving the vehicle from one landing to a landing spaced from the immediately adjacent landing. In a preferred construction, a decrease in the source energy to a predetermined magnitude operatively modifies the operation of the control means for operation under the first maximum speed which is less than the second maximum speed. Such a modifying sequence is very desirable for use with multiple speed motors such as a two speed D.C. motor.

In another aspect of the invention, a control means provides a first sequence means initiating a stop of the vehicle in response to the vehicle arriving at a first predetermined distance from a landing at which a stop is to be made and a second sequence means including a leveling position monitor stopping the vehicle in response to the vehicle arriving at a second predetermined distance from the landing at which a stop is to be made. A transfer means operatively transfers the operation from the first sequence means to the second sequence means to initiate a stop in response to a sensed malfunction. In a preferred construction, the system operation is transferred from the first sequence means to the second sequence means when the sensed source energy decreases to a predetermined magnitude. In addition, the first predetermined distance in the preferred embodiment is greater than the second predetermined distance and the leveling position monitor includes a sensor operative when sensing the arrival of the vehicle at a position adjacent to a landing at which a stop is to be made. The first sequence means preferrably includes a speed pattern circuit operatively initiating a stopping sequence by generating a deceleration pattern signal controlling the conduction of energy between the source and the motive means and the second sequence means preferrably includes a leveling pattern circuit operatively initiating a stopping sequence in response to the sensed malfunction by generating a decelerating pattern signal controlling the conduction of energy between the source and the motive means.

Certain aspects of the invention may thus be utilized with any type of prior transportation system while other aspects are preferrably utilized with systems employing static power converters which convert alternating power to constant power for directly energizing a prime mover. A highly desirable transportation system is thus provided which is capable of sensing a plurality of possible malfunctions within the system to selectively provide one of a plurality of modes of operation best suited for a safe operation.

BRIEF DESCRIPTION OF THE DRAWINGS

The drawings furnished herewith illustrate a preferred construction of the present invention in which the above advantages and features are clearly disclosed as well as others which will be clear from the following description.

In the drawings.

DESCRIPTION OF THE PREFERRED EMBODIMENT OF THE INVENTION

Figure 1:
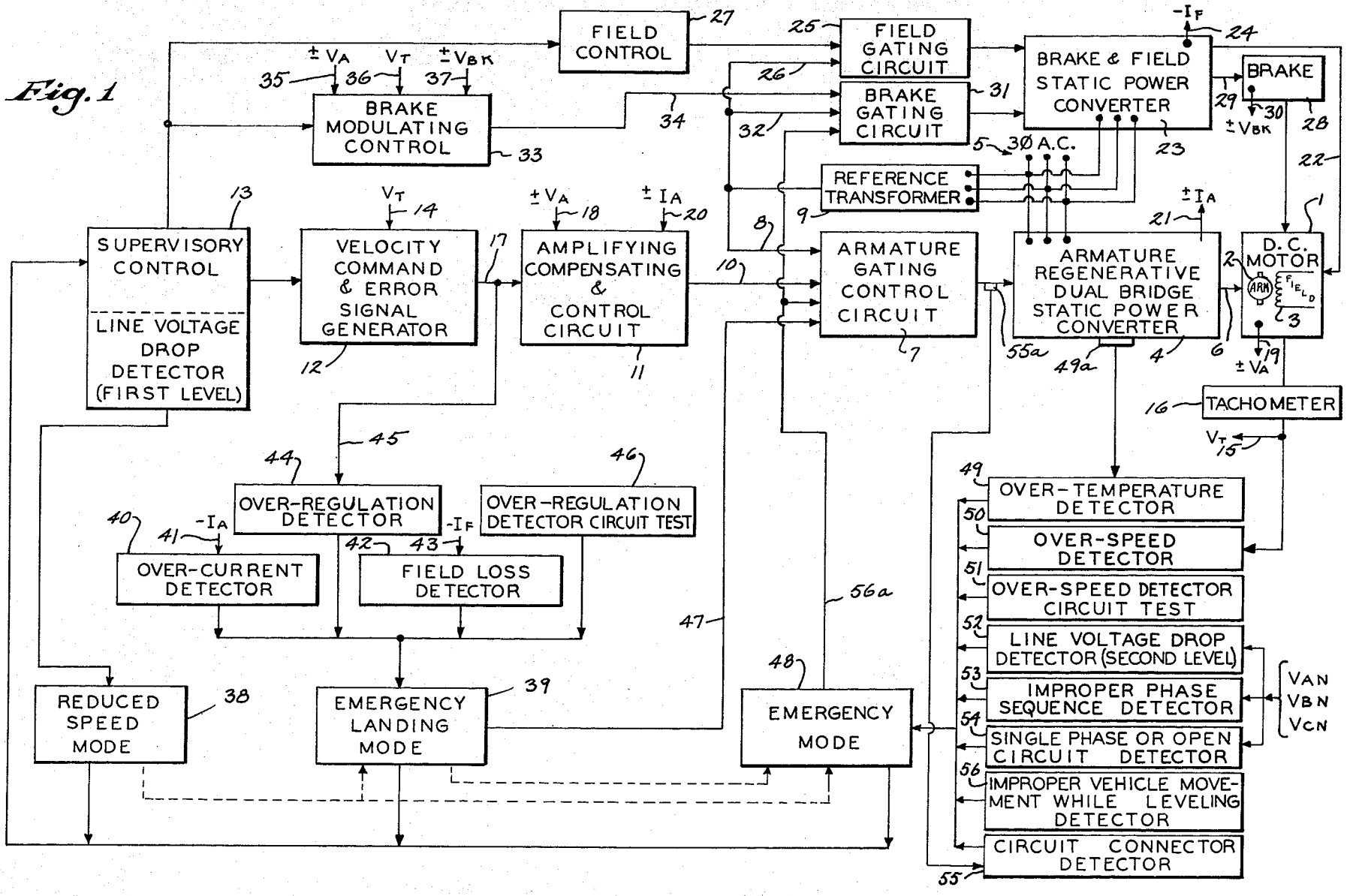
FIG. 1 is a block diagrammatical view illustrating an elevator system incorporating the present invention.

Referring to the drawings and particularly FIG. 1, an elevator system is illustrated in block diagrammatic form and includes a direct current drive motor 1 having an armature circuit 2 and a field circuit 3 connected to operate an elevator car. A static power converter 4 operates to convert a three-phase alternating current at input 5 to a direct current at output 6 and directly supplies varying controlled amounts of energizing direct current of either polarity to armature 2 for controlling the movement of the elevator car in a predetermined commanded mode of operation.

The static power converter 4 utilizes a dual bridge arrangement containing a plurality of controlled rectifying devices. Certain aspects of the invention, however, are not limited to the use of a static power converter although some aspects of the invention are particularly adaptable to regenerative dual bridge type static converters. Such static type converters are illustrated in U.S. Pat. No. 3,716,771 issued to Maynard on Feb. 13, 1973, U.S. Pat. No. 3,683,252 issued to Maynard on Aug. 8, 1972, U.S. Pat. No. 3,668,493 issued to Maynard on June 6, 1972, and U.S. Pat. No. 3,551,748 issued to Maynard et al on Dec. 29, 1970.

In operation, the controlled rectifiers within the dual bridge networks of the static power converter 4 are selectively rendered conductive to supply varying controlled amounts of direct current at output 6 according to a firing sequence established by the armature gating circuit 7. The direction of current flow at output 6 may be reversed by converter 4 to reverse the direction of travel of the elevator car or to provide regenerative braking.

The armature gating circuit 7 responds to the phase sequence of the three-phase alternating current input 5 as supplied through an input 8 by a reference transformer 9 to thereby control the sequence of conduction or firing of the controlled rectifiers within the static power converter 4. The armature gating circuit 7 further operates in response to a gating circuit signal 10 which is supplied from an amplifying, compensating and control circuit 11 and a velocity command and error signal generator 12.

Specifically, a velocity command signal is generated within the generator 12 upon initiation of a car starting sequence by a supervisory control 13 and is combined with a velocity signal at 14 designated $V_T$ which is proportional to the actual speed of the elevator car as supplied by an output 15 of a tachometer 16 for providing an error signal at 17. The error signal at 17 is a difference signal which represents a deviance in the actual speed of the elevator system represented by $V_T$ at input 14 from a desired or commanded speed to vary the energization of the armature circuit 2 and speed up or slow down the elevator motor 1 to maintain the elevator car at the commanded speed.

The error signal at 17 is supplied to the circuit 11 which, in turn, receives an armature voltage input 18 from an output 19 at the armature circuit 2 and an armature current input 20 from an output 21 at the static power converter 4. The circuit 11 thus compensates the error signal supplied from 17 in accordance with the sensed armature circuit losses and further provides a continuous armature power limit. The polarity of the error signal at 17 is also sensed by the circuit 11 to selectively actuate either the forward or reverse direction portion of the gating circuit 7 to control the respective forward or reverse bridge circuits within the static converter 4 to provide either the desired up or down direction operation of the elevator car or regenerative braking.

The field circuit 3 of the D. C. motor 1 is energized through a circuit 22 from a brake and field static power converter 23. The static converter 23 selectively provides the requisite amount of direct current power to the field circuit 3 through circuit 22 from an alternating current power source such as at 5. The amount of direct current supplied by converter 23 to the circuit 22 is sensed at output 24 is controlled by a field gating circuit 25 which is phase controlled through an input circuit 26 connected to the reference transformer 9. The field gating circuit 25 is also connected to be controlled by a field control 27 which responds to the start-up and shut-down sequences initiated by the supervisory control 13.

A brake 28 provides solenoid operated brake shoes or other friction devices which are coupled to a drive shaft output of the D.C. motor 1. The brake 28 operates when de-energized to fully engage the drive shaft to prevent the elevator car from moving and is energized to permit movement as more fully described hereinafter. The energization of brake 28 is controlled by the brake and field static power converter 23 through an input circuit 29. The direct current energizing power supplied through the circuit 29 to the brake 28 is sensed at output 30 to provide a signal indicative of the energizing power which has been converted to D.C. by converter 23 from the three-phase A.C. input 5.

The static converter 23 specifically contains controlled rectifiers at least one of which is selectively rendered conductive in response to the operation of a brake gating circuit 31. The gating circuit 31 responds to the phase sequence of the three-phase alternating current input 5 as supplied from the transformer 9 through an input circuit 32 and to a firing control signal supplied from a brake modulating control 33 through an input circuit 34. The modulating control 33 responds to the supervisory control 13 for initiating brake lifting and brake setting and further responds to the armature voltage $\pm V_A$ at an input circuit 35 which is supplied from the output circuit 19, the speed signal $V_T$ at an input circuit 36 which is supplied from the output circuit 15, and the brake lifting voltage $\pm V_{BK}$ at an input circuit 37 which is supplied from the output circuit 30.

In general, the brake gating circuit 31 effectively controls the static converter 23 for energizing the brake 28 to permit a car to leave a landing and for de-energizing the brake 28 to secure and maintain the car at a landing at which a stop is made. In an abnormal situation where a serious malfunction of the system has been sensed and the car is traveling between floors, the brake gating circuit 31 and the brake modulating control 33 respond to an emergency mode of operation to stop the elevator car as soon as possible anywhere in the elevator shaft by de-energizing the brake 28. In an abnormal situation where a less serious malfunction of the system has been sensed and the car is traveling between floors, the brake gating circuit 31 and the brake modulating control 33 respond to an emergency landing mode of operation in which the brake 28 is selectively energized and de-energized to slow or possibly momentarily stop the movement of the elevator car and thereafter permit the car to travel to an adjacent landing where the brake 28 is maintained de-energized to permit passenger transfer. Should any malfunction of the system be detected while the car is at a landing, the supervisory control 13 is effective for maintaining brake 28 in a de-energized condition to prevent car movement until the defect disappears or has been corrected.

The invention provides various modes of operation to provide a safe and yet efficient operation of the elevator system. A normal mode of operation is provided when the brake 28 remains continuously energized and lifted while the car is traveling between landings and is only de-energized and set while the car is adjacent a landing for facilitating safe passenger transfer. In such a normal mode of operation, the elevator car is permitted to travel only to a maximum safe velocity or speed as commanded by the error signal at 17 irregardless of the travel distance required of the elevator car before stopping at another landing.

A reduced speed mode of operation is diagrammatically depicted at 38 and is effective whenever the system senses a voltage drop or reduction of a first pre-established magnitude in the incoming power supply 5 to reduce the maximum attainable speed of the elevator car until full voltage power is again available. The reduced speed mode of operation is effective whenever the brown-out condition, namely, a reduction in voltage of the incoming power supply, drops to or below the first pre-established magnitude but does not drop to a second pre-established magnitude indicating a serious condition necessitating the stopping of the entire system. In elevator systems which provide both a two or more floor running speed and a one floor running speed, the reduced speed mode 38 is preferably connected to transfer the operating control from the two or more floor speed to the one floor speed for safe operation of the system until the incoming power can be restored.

An emergency landing mode of operation is depicted at 39 and responds to a number of inputs which are operative to indicate a malfunction of the elevator system. Specifically, an over-current detector 40 senses the armature current $-I_A$ at an input circuit 41 which is electrically coupled to the output circuit 21 at the static converter 4 and responds to an excess of armature current to transfer the operation of the system into an emergency landing mode of operation. A field loss detector 42 is connected to sense the field current $-I_F$ at an input circuit 43 which is electrically coupled to the output circuit 24 at the static converter 23 and responds to the lack of sufficient field current for transferring the system into an emergency landing mode of operation. An over-regulation detector 44 is connected to sense the error signal at 17 through an input circuit 45 and responds to an excessive regulated condition for transferring the system into an emergency landing mode of operation. The over-regulation detector 44 also responds to the supply of biasing power to pre-condition various system operations and responds to the lack of such biasing power or other malfunctions in the detector in a testing sequence depicted at 46 to transfer the system operation into the emergency landing mode 39. Such testing sequence is also effective each time the elevator car initiates a trip from a landing to prevent the vehicle from leaving a landing in response to a sensed malfunction.

The emergency landing mode 39 is effective for disabling the armature gating circuit 7 through the output 47 thereby operatively preventing the static power converter 4 from supplying power to the motor 1. The emergency landing mode 39 further operates within the supervisory control 13 to modify the operation of the brake modulating control 33 and disconnect or open the circuit 6 between the static converter 4 and the D.C. motor 1 thus providing a highly safe operation to render the motor 1 incapable for supplying a driving force to the vehicle. The brake modulating control 33 under an emergency landing mode responds to the armature voltage, the tachometer speed voltage and the brake voltage to selectively supply energizing power to the brake 28 through the converter 23 and gating circuit 31 for permitting the car to travel to an adjacent landing to permit passenger transfer.

An emergency mode of operation is depicted at 48 and responds to a number of inputs indicative of serious malfunctions within the elevator system for stopping the car anywhere in the elevator shaft possibly between landings. An over-temperature detector 49 is coupled to a temperature sensor illustrated at 49a and senses the operating temperature at or near the static power converter 4 to operate in response to an over heated condition to transfer the system operation into the emergency mode. An over-speed detector 50 is connected to receive the speed signal $V_T$ from the tachometer 16 and responds to an over-speed condition to transfer the system into the emergency mode of operation. The over-speed detector 50 continually responds to the selectively supplied biasing power and responds to the loss of biasing power or to a malfunction within the detector 50 to transfer the system operation into the emergency mode. The monitoring of the over-speed detector 50 is diagrammatically illustrated at 51 and is also effective to prevent the vehicle from leaving a landing should the monitor 50 fail to properly test at the initiation of a command for vehicle movement.

A line voltage drop detector 52 responds to a decrease in the voltage of the incoming power supply 5 to a second pre-established magnitude or level for transferring the system operation into the emergency mode. The detector 52 senses a greater or second level drop of incoming powr than required for the reduced speed mode of operation 38. An improper phase sequence detector 53 also responds to the incoming power from source 5 and is responsive to the improper connection or sequence of the phase signals for transferring the system into the emergency mode of operation. The phase detector 53 also senses a malfunction within itself to transfer the system into the emergency mode of operation. A single phase or open circuit detector 54 also responds to the incoming power from source 5 and is responsive to the loss of any phase such as through an open circuit condition to transfer the system into the emergency mode of operation. A circuit connector detector 55 is coupled to sense the proper electrical connection between the gating circuit 7 and the static converter 4 by a sensor 55a and responds to an improper connection to transfer the system into the emergency mode of operation. An improper vehicle movement while leveling detector 56 responds to an abnormal movement of the vehicle while approaching a landing at which a stop is being made to transfer the system into the emergency mode of operation.

A number of malfunction conditions sensed by detectors 49 through 56 are thus each effective for transferring the system into the emergency mode of operation 38. When actuated, the emergency mode 48 disables the armature gating circuit 7 and the brake gating circuit 31 such as symbolically illustrated by disable output **56*a* to thereby render the static power converter 4 inoperative to prevent the supply of energizing power to the D.C. motor 1 and further to render the brake static converter 23 inoperative to prevent the supply of energizing power to the brake 28 thereby setting the brake and stopping the car as soon as possible. The emergency mode 48 further operates through the supervisory control 13 to disconnect the circuit 6 between the static converter 4 and the D.C. motor ] and further disconnect the circuit 29 between the static converter 23 and the brake 28** for the safe control of the elevator system.

It is therefore evident that the elevator system of the present invention can automatically transfer from the normal mode of operation into any one of three modes of operation including a reduced speed mode depicted at 38, an emergency landing mode depicted at 39, or an emergency mode depicted at 48. The elevator system when operating in the reduced speed mode depicted at 38 can automatically transfer into any one of three modes of operation including the normal mode of operation, the emergency landing mode of operation depicted at 39, or the emergency mode of operation depicted at 48. In addition, the elevator system when operating in an emergency landing mode of operation depicted at 39 can automatically transfer into the emergency mode of operation depicted at 48. Such mode transfers automatically occur in response to malfunctions sensed in the elevator operation and are effective for providing an extremely safe elevator system with redundant safely control.

Figure 2:
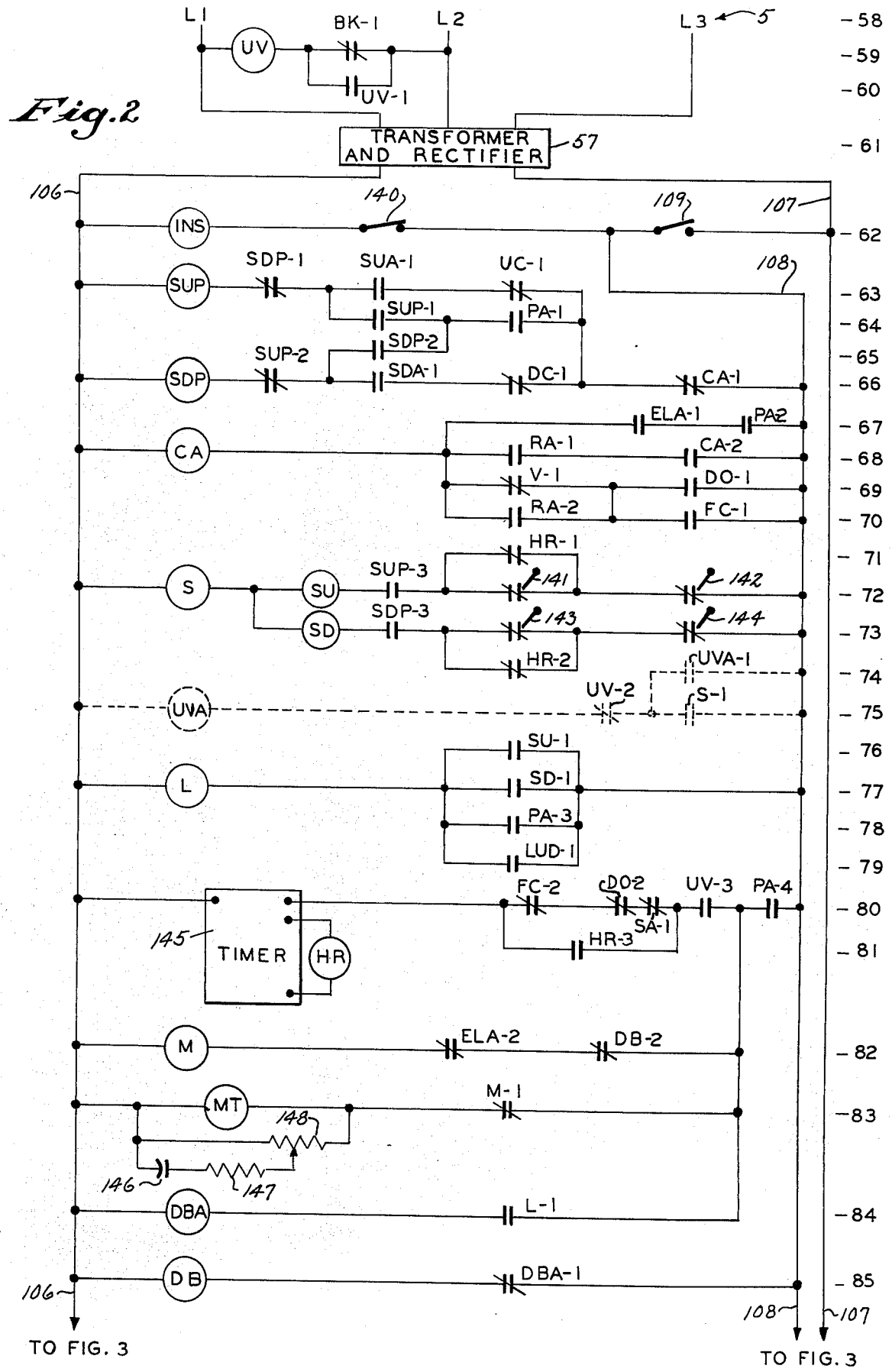
FIG. 2 is a circuit schematic showing across the line circuits forming a portion of the electrical circuits within the supervisory control in FIG. 1.
Figure 3:
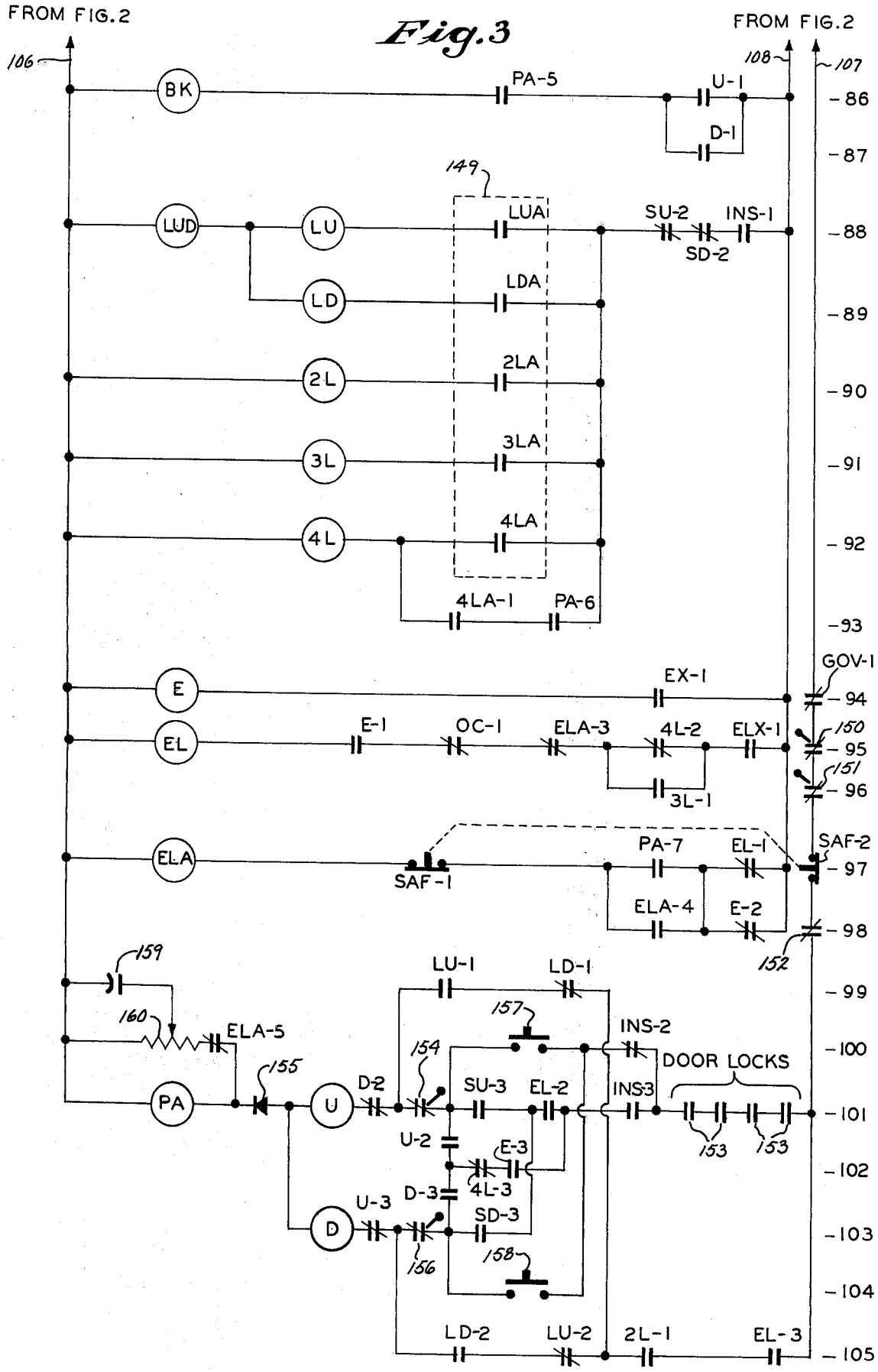
FIG. 3 is a circuit schematic showing across the line circuits forming a portion of the electrical circuits within the supervisory control in FIG. 1.
Figure 4:
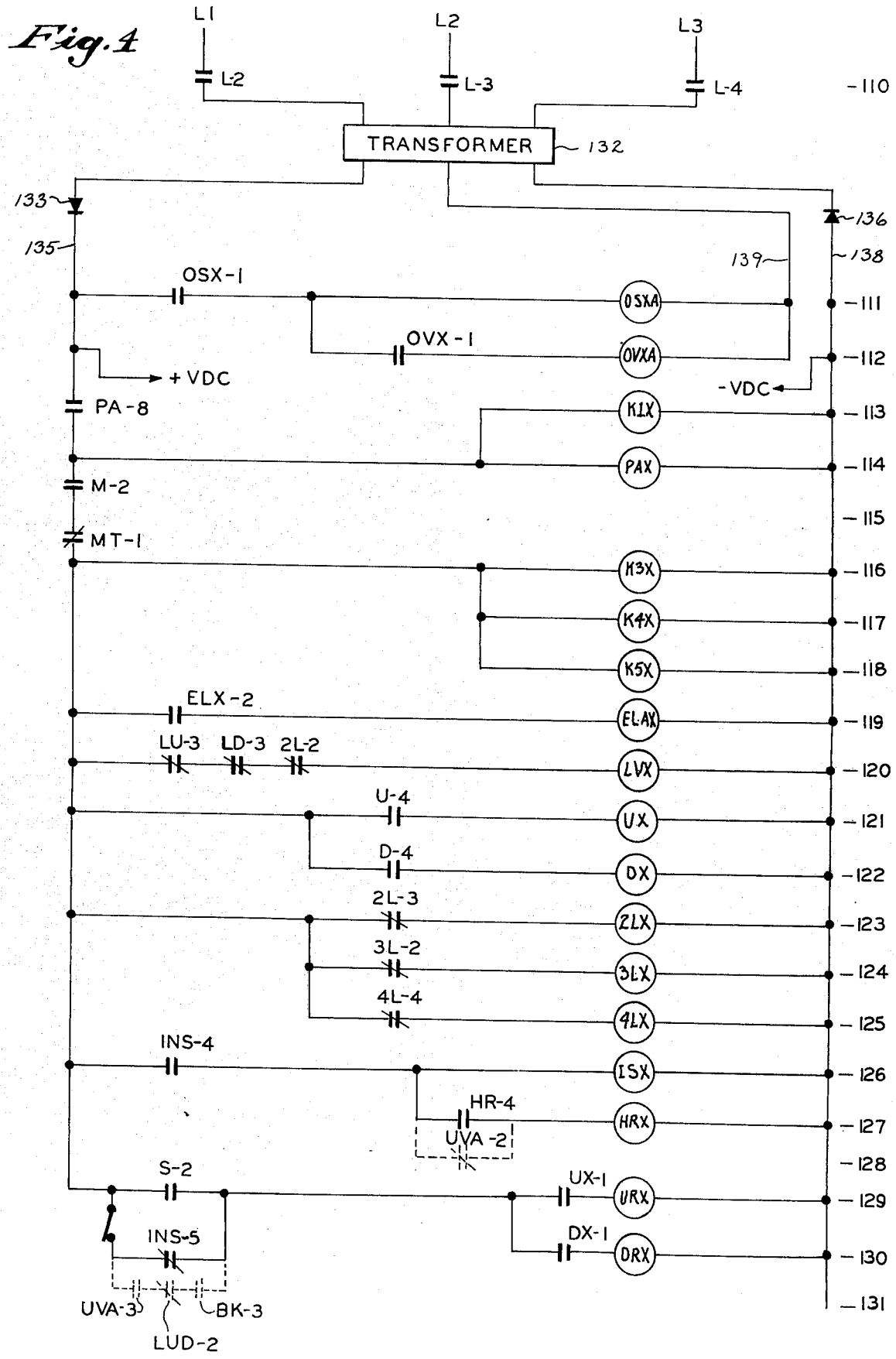
FIG. 4 is a circuit schematic showing across the line circuits forming a portion of the electrical circuit within the supervisory control in FIG. 1.

FIGS. 2, 3 and 4 show a portion of the supervisory control 13 which includes a number of relays, associated contacts and other circuit elements displayed in straight line form. While the supervisory control 13 is illustrated as using relays, it is understood that applicant's invention can be utilized with static, solidstate circuits frequently embodied within integrated circuits. The supervisory control 13 is illustrated herein to substantially control the operation of a single car or vehicle although the invention is also contemplated for use with a supervisory control which functions with a plurality of vehicles. The various relays and switches have been represented by letter designations while the various contacts are designated by their associated relay letter designation followed by a hyphenated number which identifies the contacts of the associated relay. The relay contacts are depicted in a normal position when the associated relay is de-energized. For instance, the made contacts UV-1 at line 60 are open when the relay UV at line 59 is de-energized and are closed when relay UV is energized. On the other hand, the break contacts UV-2 at line 75 are closed when relay UV is de-energized and open when relay UV is energized.

The supervisory control 13 is connected to the three-phase alternating current (A.C.) power source 5 for receiving operating power as illustrated by the three-phase lines L1, L2 and L3 which are coupled to a transformer and rectifier 57 to supply a direct current (D.C.) output. The plurality of across the line horizontal circuit connections illustrated in FIGS. 2 and 3 have been assigned the line designations 58 through 105 with the lines 62 through 105 connected to the transformer 57 by outlet leads 106 and 107 which carry a direct current output such as, for example, −110 V.D.C. and +110 V.D.C. respectively. The D.C. power lead 107, in turn, is coupled to supply power to circuits at lines 62 through 98 by a lead 108 which is coupled in circuit by a manually operated controller inspection switch 109. The D.C. power leads 106, 107 and 108 are interconnected to provide continuity between the circuit of FIG. 2 and the circuit of FIG. 3.

The straight line form circuit representation shown in FIG. 4 is also connected to the three-phase lines L1, L2 and L3 of the three-phase A.C. power source 5 which is rectified to supply direct current operating power to the control circuits. The plurality of across the line circuits containing relays and other elements have been assigned the line designations 110 through 131 for convenience of reference. The three line phases L1, L2 and L3 are selectively connected to a transformer 132 through the normally open contacts L-2, L-3 and L-4 at line 110. The transformer 132 supplies one output circuit to an anode of a diode 133 for supplying a D.C. operating potential such as +34 V.D.C. at lead 135 while a second output circuit is connected to a cathode of a diode 136 for supplying a D.C. operating potential such as −34 V.D.C. at lead 138. The D.C. output at leads 135 and 138 thus supply operating power to the circuit elements located at lines 111 through 131 and are also connected to other circuits within the system to supply positive and negative biasing voltages for operating power. The transformer 132 provides a third output lead 139 which is maintained at a neutral or reference potential for providing a circuit return path for the elements located at lines 111 and 112.

Figure 5:
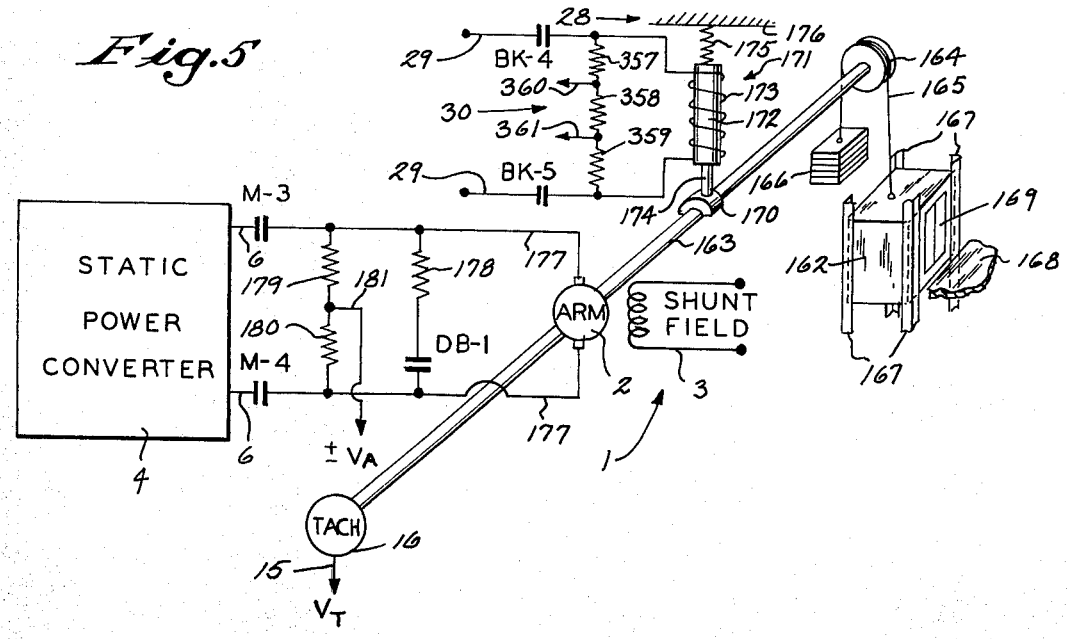
FIG. 5 is a diagrammatical illustration showing the connection of the D.C. motor and the electromechanical brake in FIG. 1 to control an elevator car.
Figure 5:
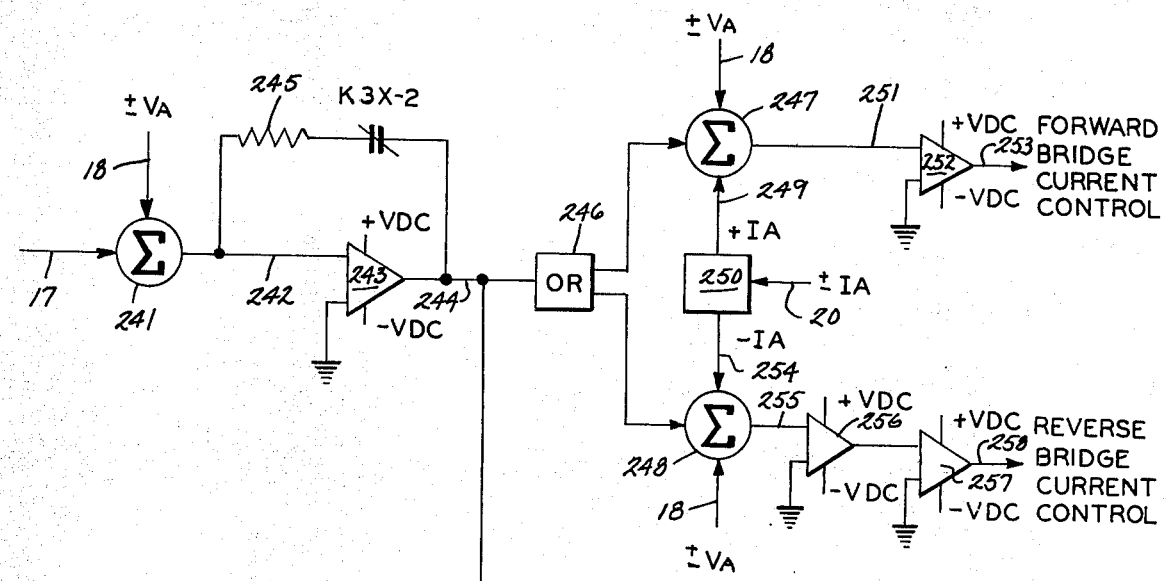
Figure 7:
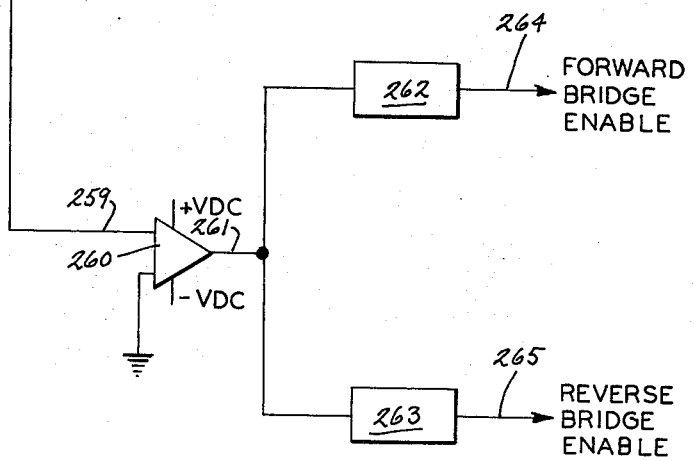
FIG. 7 is a circuit schematic showing the amplifying, compensating and gating control circuits in FIG. 1.
Figure 6:
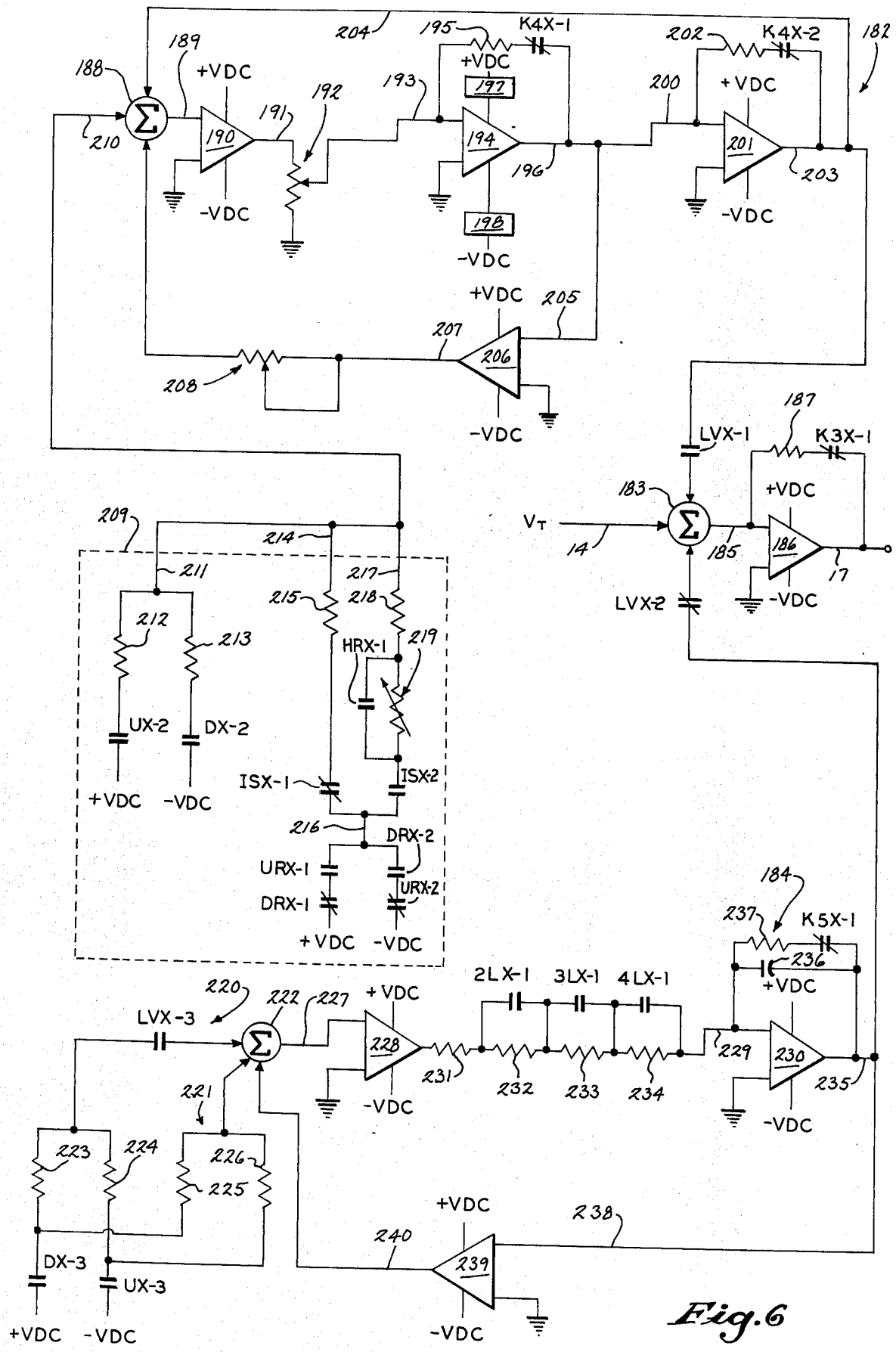
FIG. 6 is a circuit schematic showing the velocity command and error signal generator in FIG. 1.
Figure 9:
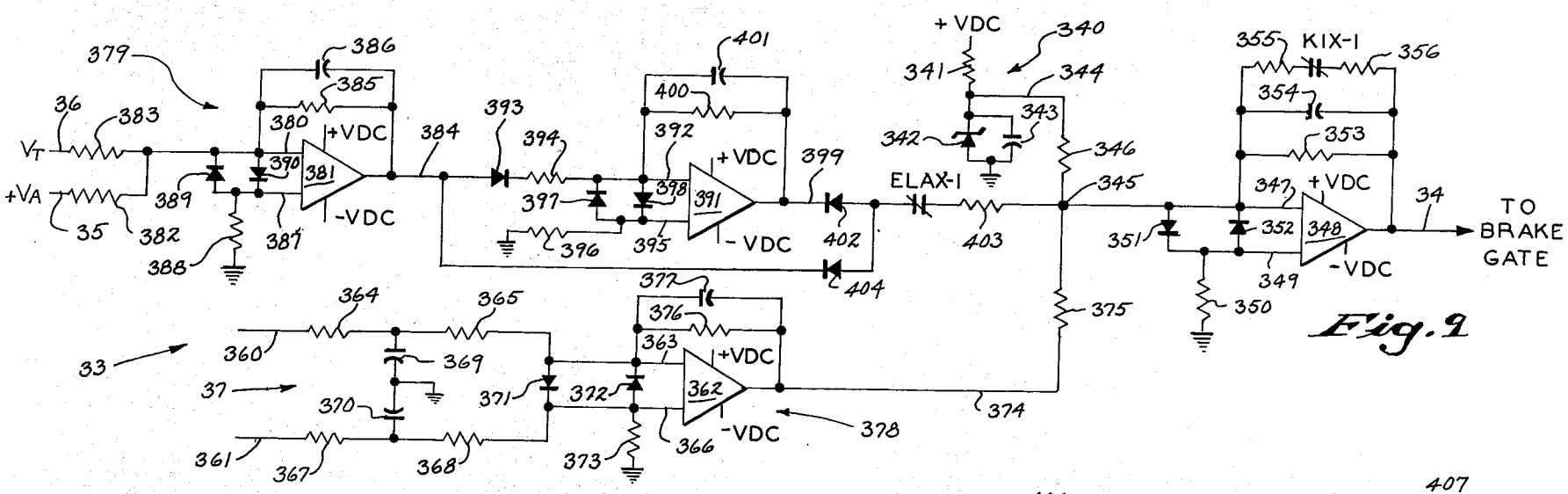
FIG. 9 is a circuit schematic showing the brake modulating control in FIG. 1.
Figures 11, 12, 13:
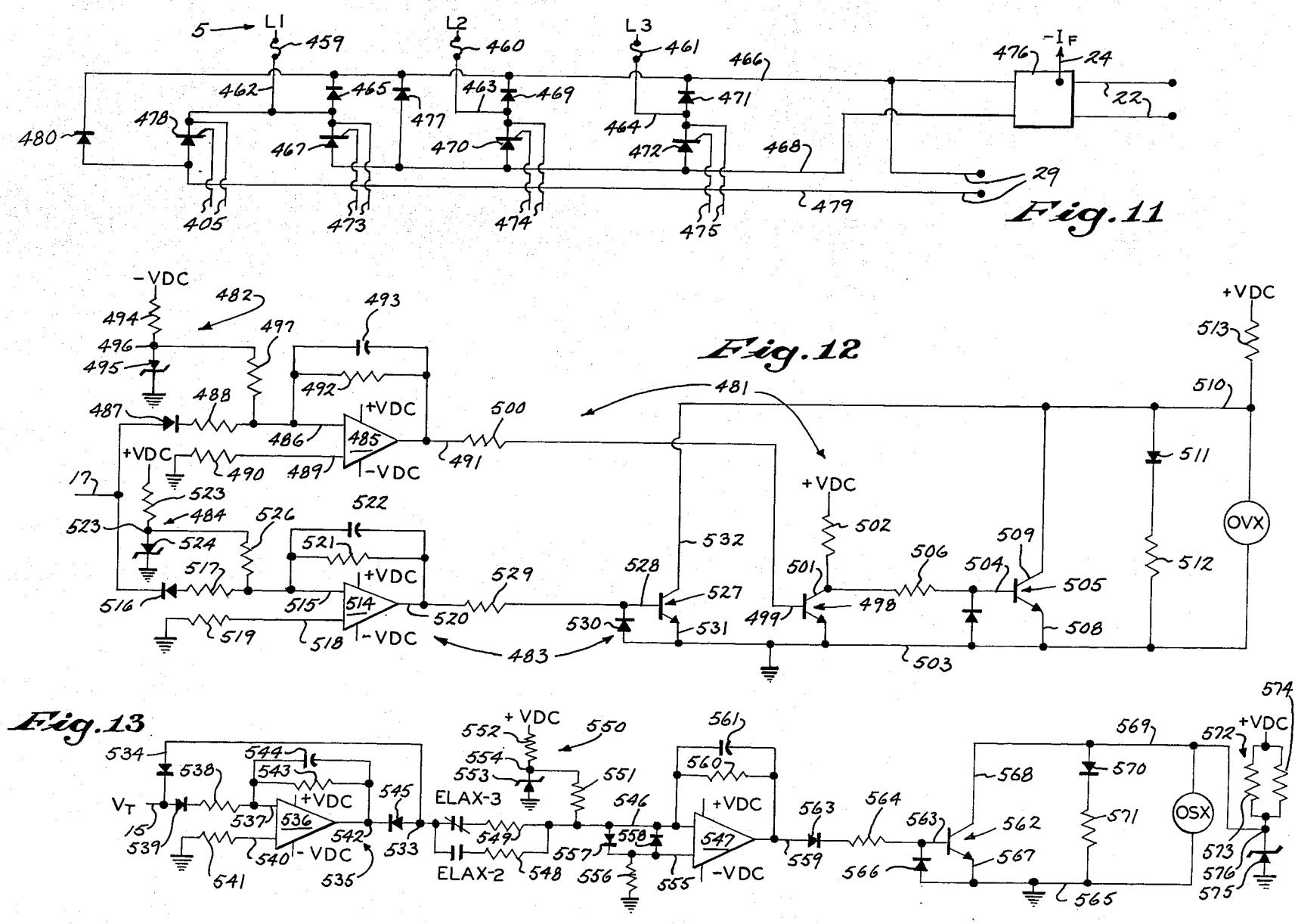
FIG. 11 is a circuit schematic showing the brake and field static power converter in FIG. 1.
FIG. 12 is a circuit showing the over-regulation detector in FIG. 1.
FIG. 13 is a circuit schematic showing the over-speed detector in FIG. 1.
Figure 14:
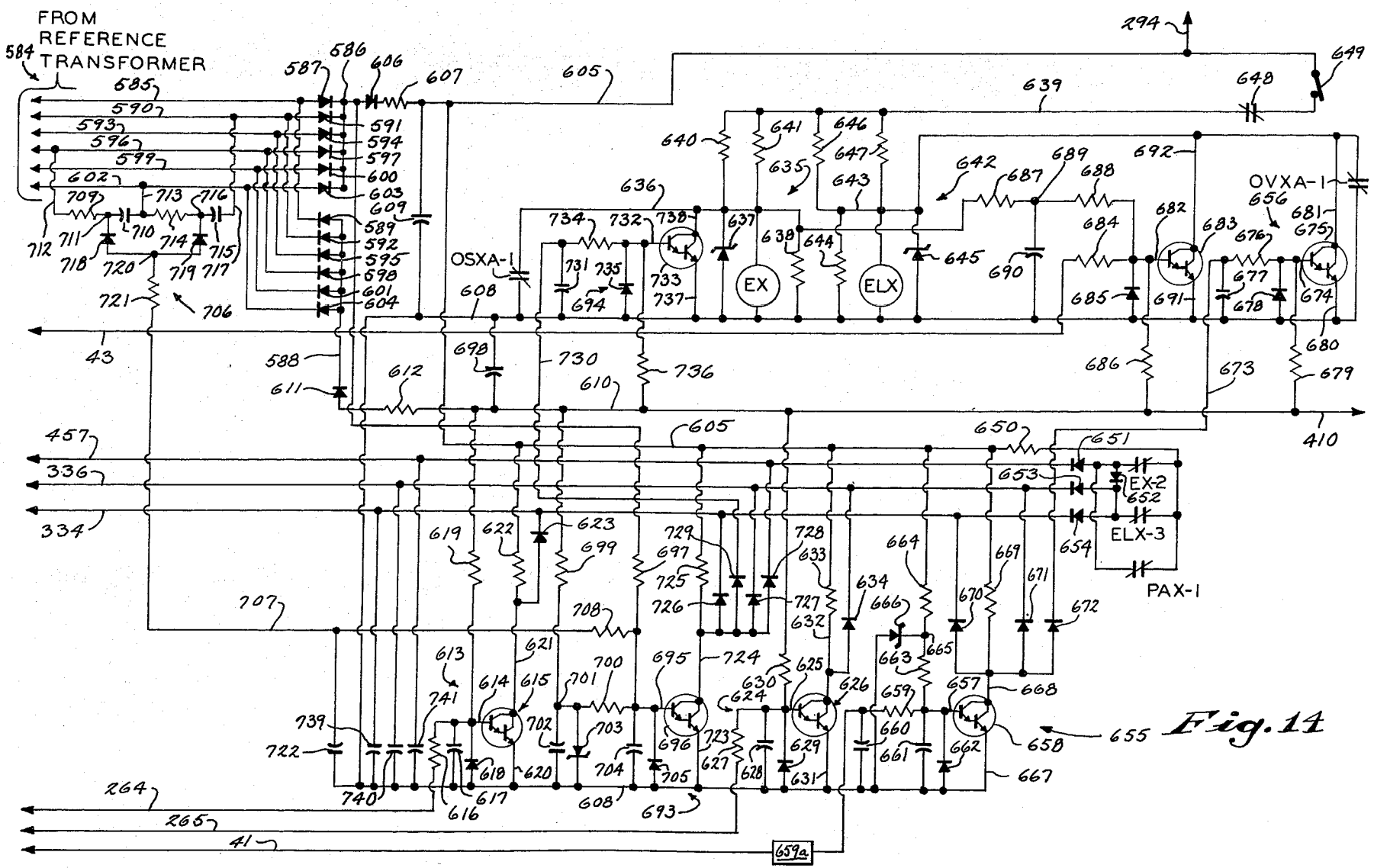
FIG. 14 is a circuit schematic showing various other elevator protection and control circuits.

As an aid to understanding the drawings, the relays and switches in the following list are identified by name, location, and the location of the associated contacts as follows:

| Symbol | Relay Designation | Relay Location | Associated Contact Location |
|---|---|---|---|
| BK | Brake | 86: | 60, 131, FIG. 5 |
| CA | Call Recognition Auxiliary | 68: | 66, 68 |
| D | Down Direction | 103: | 87, 101, 102 |
| DB | Dynamic Braking | 85: | 82, FIG. 5 |
| DBA | Dynamic Braking Auxiliary | 84: | 85 |
| DC | Down Hall Call Pick-up | Not shown: | 66 |
| DO | Call Recognition | Not shown: | 69, 80 |
| DRX | Down Direction Starting | 130: | FIG. 6 |
| DX | Down Direction Auxiliary | 122: | 130, FIG. 6 |
| E | Emergency Auxiliary | 94: | 95, 98, 102 |
| EL | Emergency Landing First Auxiliary | 96: | 97, 101, 105 |
| ELA | Emergency Interlock | 97: | 67, 82, 95, 98, 100 |
| ELAX | Emergency Landing Second Auxiliary | 119: | FIG. 9, FIG. 13 |
| ELX | Emergency Landing | FIG. 14: | 95, 119, FIG. 14 |
| EX | Emergency | FIG. 14: | 94, FIG. 14 |
| FC | Final Call | Not shown: | 70, 80 |
| HR | High Speed | 81: | 71, 74, 81, 127 |
| HRX | High Speed Auxiliary | 127: | FIG. 6 |
| INS | Inspection | 62: | 88, 100, 101, 126, 130 |
| ISX | Inspection Auxiliary | 126: | FIG. 6 |
| K1X | First Kill | 113: | FIG. 9 |
| K3X | Third Kill | 116: | FIG. 6, FIG. 7 |
| K4X | Fourth Kill | 117: | FIG. 6 |
| K5X | Fifth Kill | 118: | FIG. 6 |
| L | Line Contactor | 77: | 84, 110 |
| LD | Down Leveling Zone | 89: | 99, 105, 120 |
| LU | Up Leveling Zone | 88: | 99, 105, 120 |
| LUD | Leveling | 88: | 79, 131 |
| LVX | High Speed Leveling | 120: | FIG. 6 |
| M | Motor Armature Contactor | 82: | 83, 115, FIG. 5 |
| MT | Motor Armature Timer | 83: | 115 |
| OC | Over Current | Not shown: | 95 |
| OSX | Over Speed Fault | FIG. 13: | 111 |
| OSXA | Over Speed Fault Auxiliary | 111: | FIG. 14 |
| OVX | Over Regulation Fault | FIG. 12: | 112 |
| OVXA | Over Regulation Fault Auxiliary | 112: | FIG. 14 |

-continued

| Symbol | Relay Designation | Relay Location | Associated Contact Location |
|---|---|---|---|
| PA | Potential | 101: | 64, 67, 78, 80, 86, 93, 97 |
| PAX | Potential Auxiliary | 114: | FIG. 14 |
| RA | Releveling Auxiliary | Not shown: | 68, 70 |
| S | Start | 72: | 75, 129 |
| SA | Late Call Refusal | Not shown: | 80 |
| SD | Start Down | 73: | 77, 88, 103 |
| SDA | Down Direction Signal | Not shown: | 66 |
| SDP | Start Down Pilot | 66: | 63, 65, 73 |
| SU | Start Up | 72: | 76, 88, 101 |
| SUA | Up Direction Signal | Not shown: | 63 |
| SUP | Start Up Pilot | 63: | 64, 66, 72 |
| U | Up Direction | 101: | 86, 102, 103, 121 |
| UC | Up Hall Call Pick-up | Not shown: | 63 |
| URX | Up Direction Starting | 129: | FIG. 6 |
| UV | Under Voltage | 60: | 61, 75, 80 |
| UVA | Under Voltage Auxiliary | 75: | 74, 127, 131 |
| UX | Up Direction Auxiliary | 121: | 129, FIG. 6 |
| V | Slow Down | Not shown: | 69 |
| 2L | Second Zone Leveling | 90: | 105, 120, 123 |
| 3L | Third Zone Leveling | 91: | 96, 124 |
| 4L | Fourth Zone Leveling | 92: | 93, 95, 102, 124 |
| 2LX | Second Leveling Auxiliary | 123: | FIG. 6 |
| 3LX | Third Leveling Auxiliary | 124: | FIG. 6 |
| 4LX | Fourth Leveling Auxiliary | 125: | FIG. 6 |

Only a portion of the supervisory control 13 is shown which relates to or functions with the invention and the remaining portion of the supervisory control 13 could utilize various electrical control circuits commonly known in the art, such as the circuits shown within the elevator dispatching and control system of the U.S. Pat. No. 2,854,096 issued to K. M. White et al on Sept. 30, 1958.

FIG. 2

With specific reference to FIG. 2, the under voltage relay UV at line 59 is interconnected between the two incoming phase lines L1 and L2 through a parallel connected normally closed contacs BK-1 and the normally open seal contacts UV-1. The relay UV is normally energized when stopped at a landing through the closed contacts BK-1 and seals through its contacts UV-1 to remain continually energized. The contacts BK-1 of the brake relay are generally open under a normal operation while the car is traveling between landings so that relay UV remains energized solely through the seal circuit of contacts uV-1 until the incoming line voltage as sensed across phase lines L1 and L2 drops or decreases to a predetermined first peak magnitude or level, such as at 15% below the normal desired level, at which time relay UV drops or de-energizes. When once dropped, the relay UV generally remains de-energized until he car reaches a landing at which time the contacts BK-1 close permitting the circuit to reset and energize the relay UV provided the incoming power has been restored to a normal and safe level.

The inspection relay INS at line 62 is energized for initiating automatic elevator operation by the closing of a manually operated switch 140 and the manual switch 109. Switches 109 and 140 are generally used by elevator inspectors or maintainance personnel for disconnecting the automatic control provided by the supervisory control 13 and permitting manual operation of an elevator car.

A start up pilot relay SUP and a start down pilot relay SDP are shown at lines 63 and 66, respectively, and are selectively energized by a portion of the supervisory control (not shown) which commands the operation of a car in response to sensed system conditions, such as the period of the day, traffic demand indicating the presence of riding and perspective passengers or the condition of other elevator cars in the system, etc. The relay SUP at line 63 is connected in circuit through the normally closed contacts SDP-1 of the start down pilot relay, the normally open contacts SUA-1 of the up direction signal relay (not shown), the normally closed contacts UC-1 of the up hall call pick-up relay (not shown) and the normally closed contacts CA-1 of the call recognition auxiliary relay. When energized, the relay SUP remains energized through the normally open seal contacts SUP-1 and the normally open contacts PA-1 of the potential relay. The start down pilot relay SDP at line 66 is connected in circuit through the normally closed contacts SUP-2 of the start up pilot relay, the normally open contacts SDA-1 of the down direction signal relay (not shown), the normally closed contacts DC-1 of the down hall call pick-up relay (not shown) and the normally closed contacts CA-1 of the call recognition auxiliary relay. When energized, the relay SDP remains energized through the normally open seal contacts SDP-2 and the normally open contacts PA-1 of the potential relay.

Energization of the start up pilot relay SUP opens contacts SUP-2 at line 66 to prevent energization of the start down pilot relay SDP while the contacts SDP-1 at line 63 open in response to energization of the start down pilot relay SDP to prevent energization of the start up pilot relay SUP. The start up pilot relay SUP and the start down pilot relay SDP thus selectively operate in response to the closure of the normally open contacts SUA-1 and SDA-1, respectively, to initiate elevator travel in either the up or down directions. The up or down direction command provided by the energization of the SUP or the SDP relays remains in effect through latching circuits provided by the SUP-1 and SDP-2 contacts until interrupted by either the dropping of the potential relay PA thus opening contacts PA-1 or the energization of the call recognition relay CA thus openimg contacts CA-1.

The call recognition auxiliary relay CA at line 68 is connected in circuit through the normally closed contacts V-1 of the slow down relay (not shown) or the parallel connected normally open contacts RA-2 of the releveling auxiliary relay RA (not shown) and through the normally open contacts DO-1 of the call recognition relay DO (not shown). The call recognition relay CA is also connected in circuit through the normally open contacts ELA-1 of the emergency interlock relay ELA and the normally open contacts PA-2 of the potential relay P.

When energized, the call recognition auxiliary relay CA is sealed in through the normally open contacts RA-1 of the releveling auxiliary relay RA (not shown) and the normally open seal contacts CA-2. When operating under a normal running sequence, the call recognition auxiliary relay CA remains de-energized until sensing a call registration for service requiring a stop at a landing to which the car is approaching. Specifically, the energization of the call recognition relay DO (not shown) closes contacts DO-1 at line 69 to energize relay CA through the normally closed contacts V-1. The energization of relay CA opens contacts CA-1 at line 66 to drop or de-energize either SUP or SDP thereby initiating a slow down and a stopping sequence at a landing as directed by the supervisory control 13. The initiation of a slow down sequence energizes the releveling auxiliary relay RA (not shown) which closes contacts RA-1 and RA-2 and permits the relay CA to remain energized until the car has stopped at the desired landing. The final call relay FC (not shown) is used with a system having more than one car and becomes energized in response to the transfer of the stopping assignment from one car to another for initiating a stopping sequence by closing the contacts FC-1 to energize relay CA through the closed contacts V-1.

The emergency interlock relay ELA becomes energized in response to certain malfunctions occurring within the elevator system and closes the contacts ELA-1 to complete an energizing circuit through the contacts PA-2 of the potential relay to require the car to stop at an adjacent landing, as will be more fully described hereinafter.

The start relay S is connected in circuit through the start up relay SU, the normally open contacts SUP-3 of the start up pilot relay SUP, the normally closed contacts 141 of a high speed upper terminal limit switch, and the normally closed contacts 142 of the low speed upper terminal limit switch. The start relay S is also connected in circuit through the start down relay SD, the normally open contact SDP-3 of the start down pilot relay SDP, the normally closed contacts 143 of the high speed lower terminal limit switch, and the normally closed contacts 144 of the low speed lower terminal limit switch. The high speed upper terminal limit switch 141 is parallel connected to the normally closed contacts HR-1 and the high speed lower terminal limit switch 143 is parallel connected to the normally closed contacts HR-2 of the high speed relay HR. Whenever the car is required to travel for more than one floor without stopping, the contacts HR-1 and HR-2 open to insert swiches 141 and 143 into the circuit for controlling relays S, SU and SD to provide a safety stopping sequence should the car proceed beyond a predetermined distance of the upper and lower terminal landings. The start up and start down relays SU and SD, respectively, are thus selectively energized by the start up pilot and start down pilot relays SUP and SDP along with the energization of start relay S to control the car movement.

An under voltage auxiliary relay UVA is shown in phantom and is used with single speed type motive units and is connected in circuit through the normally closed contacts UV-2 of the under voltage relay UV and the normally open contacts S-1 of the start relay S. The normally open contacts UVA-1 are connected in parallel with the contacts S-1 and provide a seal or latching circuit for the under voltage auxiliary relay UVA. The under voltage relay UV at line 59 is energized when receiving proper operating power thus opening the contacts UV-2 and preventing the energization of relay UVA. In a low voltage or brown-out condition of a first pre-established magnitude, the relay UV drops to close contacts UV-2 to permit energization of relay UVA through contacts S-1 which are closed when the car has recieved a start signal. The relay UVA remains energized in response to the brown-out type condition until being reset by the energization of the relay UV at a landing where the car has stopped provided the incoming power supply has increased to a normal operating level. The under voltage auxiliary relay UVA is generally used in a single speed elevator system which does not provide a high speed relay HR such as at line 81.

The line contactor relay L at line 77 is connected in circuit through the parallel connected normally open contacts SU-1 of the start up relay, the normally open contacts SD-1 of the start down relay, the normally open contacts PA-3 of the potential relay, and the normally open contacts LUD-1 of the leveling relay. The relay L is energized in response to a start up or a start down command by the supervisory control 13 through contacts SU-1 or SD-1 and remains energized thereafter through energization of the potential relay PA or the leveling relay LUD. The line contactor L further provides normally open contacts (not shown) which close with relay L energized to supply power to the circuits illustrated in FIGS. 4 through 14 and including the reference transformer 9 and the field circuits 25 and 27.

A high speed relay HR at line 81 is generally used for multiple speed type motive units and is connected to a timer 145 and selectively operates after a predetermined time for initiating a high speed run for two or more floors. Specifically, the high speed relay HR and timer 145 are connected in circuit through the normally closed contacts FC-2 of the final call relay (not shown), the normally closed contacts DO-2 of the call recognition relay (not shown), the normally closed contacts SA-1 of the late call refusal relay (not shown), the normally open contacts UV-3 of the under voltage relay, and the normally opened contacts PA-4 of the potential relay. The contacts HR-3 of the high speed relay HR provide a seal circuit which is parallel connected to the contacts FC-2, DO-2 and SA-1.

In operation, the timer 145 generally starts timing in response to the closure of the contacts PA-4 of the potential relay and the contacts SA-1 of the late call refusal relay after the car has left a landing. The timer 145 generally continues to time and will prevent the energization of relay HR until the car has passed a slow down and stopping distance for a one floor run. When operating for a one floor run, the contacts DO-2 of the call recognition relay open in response to a slow down and stopping command for the next succeeding floor thereby preventing the energization of the relay HR and restricting the operation of the car to a slower or one floor run speed. Should a car be permitted to travel for two or more floors without stopping, the timer 145 generally operates after a predetermined time to energize the relay HR thereby permitting the car to obtain a high run speed. The contacts UV-3 open in response to a low voltage or a brown-out condition of a first pre-established magnitude to transfer the system into a reduced speed mode of operation thereby preventing the car from attaining the normal two or more floor running speed. The contacts FC-2 open whenever the car is required to travel for one floor to answer or service the last remaining call within the elevator system to prevent a high speed run. The contacts SA-1 are initially open at the beginning of each run and close after a predetermined time delay prior to approaching the one floor run slow down position while the contacts DO-2 are permitted to open in response to a call which is registered for the next succeeding floor while the car is under way for preventing the system from transferring into a high speed operation. The contacts SA-1 in essence provide timing sequence which is auxiliary to timer 145 and could be eliminated in certain systems where timer 145 provides the requisite timing sequence.

The motor armature contactor relay M at line 82 is connected in circuit through the normally closed contacts ELA-2 of the emergency interlock relay and the normally closed contacts DB-2 of the dynamic braking relay and the normally open contacts PA-4 of the potential relay. In operation, relay M becomes energized in response to the energization of the potential relay PA and can be de-energized by the opening of the contacts ELA-2 in response to certain malfunctions sensed within the system or the opening of contacts DB-2 under a dynamic braking sequence for the motor armature circuit as described more fully hereinafter.

The motor armature time relay MT at line 83 is connected in circuit through the normally closed contacts M-1 of the motor armature contactor relay and the normally open contacts PA-4 of the potential relay. A capacitor 146 is connected in parallel with the timer relay MT through a resistor 147 and a center tapped resistor 148 to provide a timed delay in de-energization of relay MT whenever contacts M-1 or PA-4 open.

The dynamic braking auxiliary relay DBA at line 84 is connected in circuit through the normally open contacts L-1 of the line contactor relay and the normally open contacts PA-4 of the potential relay. The relay DBA is normally energized when the car is traveling in a normal running sequence between landings. A dynamic braking relay DB at line 85 is connected in circuit through the normally closed contacts DBA-1 of the dynamic braking auxiliary relay and is normally de-energized whenever a car is traveling in a normal running sequence between landings.

FIG. 3

The power leads 106, 107 and 108 continue from the identical numbered leads shown in FIG. 2 and supply operating direct current potential to the circuits. A brake relay BK is connected in circuit between leads 106 and 108 through the normally open contacts PA-5 and either the normally open contacts U-1 or the normally open contacts D-1 of the up or down direction relays, respectively. The relay BK is normally energized whenever the car is traveling in either an up or down direction under a normal operation and becomes de-energized to disconnect the static power converter 23 from the brake 28 thereby setting the brake as further discussed hereinafter A number of magnetic switches illustrated within the dotted area 149 at lines 88 through 92 are connected to the elevator car for sensing the car position at or near a landing to initiate what is known in the art as a leveling and/or releveling operation in which the car is guided into a landing in response to the sensed distance from the landing. The magnetic switches shown at 149 are normally open and selectively close when sensing the position of the car at predetermined locations adjacent to each landing. Specifically, the contacts LUA close whenever the car is sensed at approximately 20 inches below a landing, the contacts LDA close whenever the car is sensed at approximately 20 inches above the landing, the contacts 2LA close whenever the car is sensed at approximately 10 inches either above or below the landing, the contacts 3LA close whenever the car is sensed at approximately 5 inches either above or below the landing, and the contacts 4LA close whenever the car is sensed at approximately 2 ½ inches either above or below the landing.

The leveling relay LUD is connected in circuit through the up leveling zone relay LU, the normally open magnetic switch contacts LUA, the normally closed contacts SU-2 of the start up relay, the normally closed contacts SD-2 of the start down relay and the normally open contacts INS-1 of the inspection relay. The leveling relay LUD may alternatively be connected in circuit through the down leveling zone relay LD, the normally open magnetic switch contacts LDA, and the contacts SU-2, SD-2 and INS-1. A second zone leveling relay 2L, a third zone leveling relay 3L, and a fourth zone leveling relay 4L are connected in circuit through the normally open magnetic switches 2LA, 3LA and 4LA, respectively, and through the contacts SU-2, SD-2 and INS-1. The fourth zone leveling relay 4L also provides a seal circuit through the normally open contacts 4L-1 and the normally open contacts PA-6 which are parallel connected to the magnetic switch 4LA.

In operation, the relay LUD is energized whenever a car is detected within 20 inches of a landing at which the car is required to be stopped as provided by the de-energization of the start up and start down relays SU and SD and the closing of either switch LUA or LUD. The relay LU is energized when the car is approximately 20 inches below the landing by the closing of contacts LUA and the relay LD is energized when the car is approximately 20 inches above the landing by the closing of contacts LDA. Likewise, the relay 2L is energized when the car is approximately 10 inches either above or below the landing, the relay 3L is energized when the car is approximately 5 inches either above or below the landing, and relay 4L is energized when the car is approximately 2 ½ inches either above or below the landing.

The emergency auxiliary relay E is connnected in circuit through the normally open contacts EX-1 of the emergency relay (FIG. 14). The relay E is energized during a normal operation and is de-energized in response to one of certain sensed malfunctions within the elevator system when the system transfers into the emergency mode of operation as more fully described hereinafter The emergency landing first auxiliary relay EL at line 95 is connected in circuit through the normally open contacts E-1 of the emergency auxiliary relay, the normally closed contacts OC-1 over the current relay (not shown), the normally closed contacts ELA-3 of the emergency interlock relay, the normally closed contacts 4L-2 of the fourth zone leveling relay, and the normally open contacts ELX-1 of the emergency landing relay. The normally open contacts 3L-1 of the third zone leveling relay are parallel connected to the normally closed contacts 4L-2.

During a normal operation without any malfunction of the elevator car, the relay EL is energized by the closure of the contacts E-1 and ELX-1 and is de-energized in response to one of certain sensed malfunctions within the elevator system. Specifically, the relay EL will be de-energized in response to one of certain sensed malfunctions within the system by the opening of contacts ELX-1 when the system transfers into a emergency landing mode of operation as more fully described hereinafter. In addition, the relay EL will drop in response to the opening of contacts E-1 whenever the system is transferring into the emergency mode of operation. The relay EL will also be de-energized when the contacts OC-1 open in response to an over current condition of a pre-established magnitude occurring for a pre-established time existing within the elevator motor 1 as sensed by a current sensing relay OC (not shown) which is generally coupled to the armature windings in a known manner. The relay OC may consist of an eutectic alloy which is rated at 250% of the full load armature current.

The relay EL will further be de-energized through a particular sequence of operation of the third and fourth zone leveling relays 3L and 4L through the contacts 3L-1 and 4L-2. Specifically, the third zone leveling relay 3L becomes energized whenever the car arrives within 5 inches of a landing to which a stop is being made thereby closing contacts 3L-1 to permit continued energization of the relay EL. As the car arrives to within 2 ½ inches of the landing, the fourth zone leveling relay 4L energizes thereby opening contacts 4L-2 so that the relay EL remains energized primarily through the 3L-1 contacts The fourth zone leveling relay 4L seals in through its normally open contacts 4L-1 and contacts PA-6 to continually hold contacts 4L-2 in a open condition. Should the car thereafter move beyond 5 inches in either direction of the landing at which a stop is being made, the third zone leveling relay 3L will be de-energized thereby opening contacts 3L-1 and correspondingly de-energize the relay EL to indicate a dangerous operation.

The emergency interlock relay ELA at line 97 is connected in circuit through a manually operated, normally closed run-stop switch designated SAF-1, the normally open contacts PA-7 of the potential relay, and the normally closed contacts EL-1 of the emergency landing first auxiliary relay or the parallel connected normally closed contacts E-2 of the emergency auxiliary relay. The relay ELA further provides the normally open seal contacts ELA-4 which are parallel connected to the contacts PA-7.

The de-energization of the emergency auxiliary relay E or the emergency landing first auxiliary relay EL is effective for energizing the emergency interlock relay ELA through the contacts E-2 or EL-1, respectively, when the car is conditioned to travel between landings as provided by the closure of contacts PA-7 of the potential relay and the normally closed switch contacts SAF-1. The energization of relay ELA closes the contacts ELA-4 to provide a seal circuit about contacts PA-7 and opens the contacts ELA-3 to maintain relay EL de-energized. The relay ELA thus seals to remain energized and the relay EL remains de-energized until the energizing circuit is broken for relay ELA by the opening of the manual switch SAF-1. The contacts E-2 at line 98 of the emergency auxiliary relay are redundant to the contacts E-1 at line 95, the later operating through the relay EL and the contacts EL-1 to energize the relay ELA under a sensed emergency mode malfunction, to ensure a safe operation. When resetting the circuit, the de-energization of relay ELA by opening the switch SAF-1 permits the contacts ELA-3 to close to energize the relay EL should the malfunction cease to exist.

The potential relay PA at line 101 is connected in circuit through a number of circuit paths, all of which include a series of switches located within the D.C. power lead 107. Specifically, a normally closed governor switch designated GOV-1 at line 94 is connected to operate in response to a known speed sensing switch mounted on the car which operates to open the contacts GOV-1 whenever the car velocity exceeds a predetermined maximum limit to thereby de-energize the potential relay PA. An up terminal over travel limit switch 150 at line 95 and a down terminal over travel limit switch 151 at line 96 are both normally closed and serially connected within line 107. The limit switches 150 and 151 operate to open whenever the car travels beyond a predetermined distance of either the upper or lower terminal landing to de-energize the potential relay PA. A normally closed manually operable switch SAF-2 at line 97 is operated by the car run-stop switch which is coupled to the switch SAF-1 and may be selectively opened to de-energize the potential relay PA. A normally closed safety clamp switch 152 at line 98 operates to open at a second predetermined maximum velocity limit should the governor switch GOV-1 fail to operate whenever the car speed exceeds the first predetermined maximum velocity limit to provide a safety back-up to de-energize the potential relay PA.

The potential relay PA is further connected in circuit through a series of normally open car and door lock contacts 153 which open when the car or hall doors are in an open position to de-energize or maintain the potential relay PA de-energized. The contacts 153 must close in order to enable the car to leave a landing through the energization of the relay PA. The relay PA is further connected in circuit through the normally open contacts INS-3 of the inspection relay, the normally open contacts EL-2 of the emergency landing first auxiliary relay, the normally open contacts SU-3 of the start up relay, the normally closed contacts 154 of the upper terminal stop limit switch, the normally closed contacts D-2 of the down direction relay, the up direction relay U, and the diode 155. An alternative circuit is provided for energizing the relay PA through the door lock contacts 153, the contacts INS-3, the contacts EL-2, the normally open contacts SD-3 of the start down relay, the normally open contacts SD-3 of the start down relay, the normally closed contacts 156 of the lower terminal stop limit switch, the normally closed contacts U-3 of the up direction relay, the down direction relay D and the diode 155.

An up direction circuit is provided for maintaining the relay PA energized which is connected from the relay U through the contacts D-2, the contacts 154, the seal contacts U-2 of the up direction relay U, the normally closed contacts 4L-3 of the fourth zone leveling relay, the normally open contacts E-3 of the emergency auxiliary relay, the contacts INS-3, and the door contacts 153. A down direction circuit is also provided for maintaining the relay PA energized which is connected from the relay D through the contacts U-3, the switch 156, the normally open contacts D-3 of the down direction relay D, the contacts 4L-3, the contacts E-3, the contacts INS-3, and the door contacts 153.

A circuit is also provided for manually energizing the relay PA by an inspector or operator within the car. Specifically, a manually connected up direction circuit is provided through the door contacts 153, the normally closed contacts INS-2 of the inspection relay, the manually operable normally open switch contacts 157, the limit switch contacts 154, the contacts D-2 and the relay U. Alternatively, a manually connected down direction circuit is provided through the door contacts 153, the contacts INS-2, the manually operable normally open switch contacts 158, the limit switch contacts 156, the contacts U-3 and the relay D. The up and down direction relays U and D may thus be selectively energized by closing the manually operable switches 157 and 158 whenever the inspection relay INS has been de-energized thereby closing contacts INS-2 and opening contacts INS-3.

A leveling control circuit is further provided for maintaining the relay PA energized. Specifically, an up direction leveling circuit is provided through the normally open contacts EL-3 of the emergency landing first auxiliary relay, the normally open contacts 2L-1 of the second zone leveling relay, the normally closed contacts LD-1 of the down leveling zone relay, the normally open contacts LU-1 of the up leveling zone relay, the contacts D-2 and the relay U. A down direction leveling circuit is provided through the contacts EL- 3, the contacts 2L-1, the normally closed contacts LU-2 of the up leveling zone relay, the normally open contacts LD-2 of the down leveling zone relay, the contacts U-3 and the relay D.

The potential relay PA is parallel connected to a timing circuit including a serially connected capacitor 159, a center tapped resistor 160, and the normally closed contacts ELA-5 of the emergency interlock relay.

During a normal running mode of operation between landings, the potential relay PA is initially energized by the closure of either the contacts SU-3 of the start up relay or the contacts SD-3 of the start down relay through a circuit including the closed contacts EL-2, INS-3 and door contacts 153, the later being closed in response to the closure of the car and hall doors. The energization of relay PA by the closure of contacts SU-3 further energizes the up direction relay U which opens contacts U-3 to prevent the energization of the down direction relay D. In like manner, the energization of relay DA by the closure of contacts SD-3 further energizes the down direction relay D which opens contacts D-2 to prevent the energization of the up direction relay U. The selective energization of the relays U or D closes the associated contacts U-2 or D-3, respectively, to provide a seal circuit around the contacts SU-3, SD-3 and EL-2 through the contacts 4L-3 and E-3.

The relays PA, U or D remain energized while the car is running between landings through the closed contacts SU-3 for the up direction or the closed contacts SD-3 for the down direction until a stop signal is received from the supervisory control 13 at a predetermined distance from a landing at which the car is to stop. Such stopping command is effective for closing the contacts DO-1 at line 69 of the call recognition relay (not shown) to energize the call recognition auxiliary relay CA at line 68, which, in turn, is effective for opening contacts CA-1 at line 66 to ensure that the start up and start down pilot relays SUP and SDP are both de-energized. The de-energization of the relays SUP and SDP opens the contacts SUP-3 at line 72 and SDP-3 at line 73 to correspondingly de-energize the start relay S and the start up and start down relays SU and SD. The contacts SU-3 at line 101 and SD-3 at line 103 are thus open so that the relays PA, U or D remain energized solely through the seal circuit including the contacts 4L-3 and E-3 at line 102 from the time the stop command is given by the opening of contacts SU-3 or SD-3 until the time the car reaches the leveling zone at 20 inches from the landing at which the car is to stop. The contacts SU-2 and SD-2 at line 88 further close to complete a circuit to the leveling and releveling magnetic switches 149.

The relays PA, U or D are maintained in an energized condition during a leveling or releveling operation through several circuits. The relays PA, U or D are energized through most of the leveling sequence by the seal circuit at line 102 through the contacts E-3 and 4L-3 until the fourth zone leveling relay 4L energizes as the car reaches to within 2½ inches of the landing thus opening the contacts 4L-3.

The relays PA, U or D remain energized during the later portion of the leveling sequence and during any releveling operation through a circuit which is completed by the closure of contacts 2L-1 at line 105 in response to the arrival of the car within 10 inches of the landing at which the car is to stop as sensed by the energization of the second zone leveling relay 2L. If the car is traveling upward, the contacts LU-1 at line 99 close when the car reaches to within 20 inches of the landing to complete a circuit for the up direction relay U and relay PA when the contacts 2L-1 close while if the car is traveling downward, the contacts LD-2 at line 105 close when the car reaches to within 20 inches of the landing to complete a circuit for the down direction relay D and relay PA when the contacts 2L-1 close.

The circuit for maintaining the relays PA, U or D energized through the contacts 2L-1 when leveling or releveling thus remains effective while the car is located within 10 inches on either side of the landing at which a stop is being made through the continued energization of the second zone leveling relay 2L. When the car arrives immediately adjacent to the landing, both the up leveling zone relay LU at line 88 and the down leveling zone relay LD become de-energized by the opening of the magnetic switches LUA and LDA, respectively, thus opening the contacts LU-1 at line 99 and the contacts LD-2 at line 105 to immediately de-energize the up and down direction relays U and D. The relay PA, however, remains energized for a predetermined time after the relays U or D have been de-energized as provided by the time constant of capacitor 159 and resistor 160. The slight delay in de-energizing the relay PA provides continued energization for certain circuits within the system as discussed more fully hereinafter while the movement of the car is halted or stopped by the de-energization of the relays U and D.

During a running sequence, the de-energization of the emergency landing first auxiliary relay EL in response to a sensed malfunction of the elevator system opens the contacts EL-2 at line 101 to prevent the energization of the relays PA, U or D in response to the closure of the contacts SU-3 and SD-3. The de-energization of relay EL further opens the contacts EL-3 at line 105 so that the relays PA, U or D can only be energized through either the seal circuit including the contacts E-3 or the manual operating circuits including the switches 157 and 158. The de-energization of the emergency auxiliary relay E in response to a sensed malfunction of the elevator system opens the contacts E-3 at line 102 to prevent the seal circuit from energizing the relays PA, U or D. It is further noted that the de-energization of the relay E further opens contacts E-1 at line 95 to correspondingly de-energize or drop relay EL which, in turn, opens contacts EL-2 and EL-3 so that only the manually operable circuit including the switches 157 and 158 may be used to energize the relays PA, U or D.

The contacts ELA-5 at line 100 open in response to the energization of the emergency interlock relay ELA at line 97. The relay ELA, in turn, is energized in response to a sensed malfunction within the system, such as provided by the closure of the contacts EL-1 of the emergency landing first auxiliary relay of the contacts E-2 of the emergency landing relay. With the contacts ELA-5 open, the relay PA will drop or de-energize at the same time that either of the relays U or D drop whenever a malfunction exists.

The relays PA, U or D thus immediately drop or de-energize whenever the emergency auxiliary relay E drops or becomes de-energized in response to certain sensed malfunctions by the opening of a number of contacts including the contacts E-1 at line 95, the contacts E-3 at line 102, the contacts EL-2 at line 101, the contacts EL-3 at line 105 and the contacts ELA-5 at line 100. The relays PA, U or D remain energized, however, for a certain length of time whenever the emergency landing first auxiliary relay EL drops or becomes de-energized in response to certain sensed malfunctions as long as the emergency auxiliary relay E remains energized and the fourth zone leveling relay 4L remains de-energized. Specifically, the contacts E-3 and 4L-3 at line 102 remain closed to maintain a seal circuit for continued energization of relays PA, U or D while the car is traveling between landings even though the relay EL is de-energized. As the car approaches to within 2 ½ inches of an adjacent landing with the relay EL de-energized, the fourth zone leveling relay 4L energizes to open contacts 4L-3 at line 102 to immediately drop relays PA, U or D.

FIG. 4

The normally open contacts L-2, L-3 and L-4 are illustrated at line 110 in FIG. 4 and are connected between the phase lines L1, L2 and L3, respectively, and further coupled to the transformer 132 for selectively supplying power thereto.

An overspeed fault auxiliary relay OSXA at line 111 is connected in circuit to the neutral or reference potential lead 139 and to the positive potential lead 135 through the normally open contacts OSX-1 of the overspeed fault relay shown in FIG. 13. An over-regulation fault auxiliary relay OVXA is also connected to lead 139 and to the positive potential lead 135 through the normally open contacts OVX-1 of the over-regulation fault relay shown in FIG. 12 and the contacts OSX-1.

A first kill relay KIX at line 113 and a potential auxiliary relay PAX at line 114 are parallel connected to each other and further connected to lead 138 and to lead 135 through the normally open contacts PA-8 of the potential relay. A third kill relay K3X at line 116, a fourth kill relay K4X at line 117 and a fifth kill relay K5X at line 118 are parallel connected to one other and further connected to lead 138 and to lead 135 through the normally closed contacts MT-1 of the motor armature timer relay, the normally open contacts M-2 of the motor armature contactor relay, and the contacts PA-8.

The remaining across-the-line circuits shown in lines 119 through 131 are connected in circuit to the lead 138 and the lead 135 through the contacts MT-1, M-2 and PA-8. An emergency landing second auxiliary relay ELAX at line 119 is connected in circuit through the normally open contacts ELX-2 of the emergency landing relay illustrated in FIG. 14. A high speed leveling relay LVX at line 120 is connected in circuit through the normally closed contacts 2L-2 of the second zone leveling relay, the normally closed contacts LD-3 of the down leveling zone relay, and the normally closed contacts LU-3 of the up leveling zone relay. The relay LVX is normally energized while the car is operating between landings and drops whenever a car is at or within 20 inches on either side of a landing at which a stop is being made.

An up direction auxiliary relay UX at line 121 is connected in circuit through the normally open contacts U-4 of the up direction relay while the down direction auxiliary relay DX at line 122 is connected in circuit through the normally open contacts D-4 of down direction relay. A second leveling auxiliary relay 2LX at line 123 is connected in circuit through the normally closed contacts 2L-3 of the second zone leveling relay. A third leveling auxiliary relay 3LX at line 124 is connected in circuit through the normally closed contacts 3L-2 of the third zone leveling relay. A fourth leveling auxiliary relay 4LX at line 125 is connected in circuit through the normally closed contacts 4L-4 of the fourth zone leveling relay.

An inspection auxiliary relay ISX at line 126 is connected in circuit through the normally open contacts INS-4 of the inspection relay.

A high speed auxiliary relay HRX at line 127 is connected in circuit through the normally open contacts HR-4 of the high speed relay preferrably used with multiple speed type motive units and the contacts INS-4. The contacts HR-4 close in response to the energization of the high speed relay HR at line 81 whenever the car is commanded to proceed for two or more floors before stopping thereby requiring the car to accelerate to a maximum permissible velocity or contact speed. The contacts HR-4, however, remain open through the continued de-energization of the relay HR should the system receive a stop command for a one floor run before the timer 145 has had a chance to time out. A drop in the voltage of the incoming power supply of a first predetermined magnitude is effective to immediately de-energize the relay HR or prevent the energization of the relay HR by the opening of contacts UV-3 at line 80 in response to the de-energization of the under voltage relay UV at line 59. The de-energization of the relay UV in response to a low voltage condition of a first magnitude is thus effective for de-energizing the relay HRX or maintaining the relay HRX in a de-energized condition through the de-energization of the relay HR with the system transferring into a reduced speed mode of operation.

The high speed auxiliary relay HRX is also used with a single speed type motive unit and is energized by the normally closed contacts UVA-2 of the under voltage auxiliary relay which replace the contacts HR-4. The contacts UVA-2 are closed during a normal running operation and open in response to a drop in the voltage of the incoming power supply of a first predetermined magnitude as provided through the de-energization of the relay UV at line 59, the closing of contacts UV-2 at line 75, and the energization of the relay UVA which operates to de-energize the relay HRX. The contacts UVA-2 are thus utilized for transferring the system into a reduced speed mode of operation in response to a low voltage condition of a first magnitude with the system using a single speed type motive unit.

An up direction starting relay URX at line 129 is connected in circuit through the normally open contacts UX-1 of the up direction auxiliary relay and the normally open contacts S-2 of the start relay while a down direction starting relay DRX at line 130 is connected in circuit through the normally open contacts DX-1 of the down direction auxiliary relay and the contacts S-2. The relays URX and DRX may also be connected in circuit through a normally closed manual operable switch 161 and the normally closed contacts INS-5 of the inspection relay through the contacts UX-1 or DX-1, respectively. The contacts INS-5 are thus parallel connected to contacts S-2 and close in response to the de-energization of the inspection relay INS to permit the car to be controlled by an inspector through the switches 157 and 158 at lines 100 and 104 in FIG. 3.

A stopping sequence circuit at line 131 is further depicted in dotted circuit connection which is connected in parallel with contacts INS-5 when the system is employed with a single speed unit. Specifically, the normally open contacts UVA-3 of the under voltage auxiliary relay, the normally closed contacts LUD-2 of the leveling relay, and the normally open contacts BK-3 of the brake relay are connected in circuit through switch 161 and the contacts UX-1 and DX-1 to selectively control the energization of relays URX and DRX. In a normal operation between landings under automatic control with the contacts INS-5 open through the energization of the relay INS, the contacts UVA-3 remain open so that the opening of the contacts S-2 of the start relay S initiates a stopping sequence for an adjacent landing by de-energizing the relay URX and DRX. The de-energization of the relay S at line 72 is provided in a normal stopping sequence by the energization of the call recognition relay DO (not shown) when a car has reached a predetermined distance from a landing at which a stop is to be made through the contacts DO-1 at line 69, contacts CA-1 at line 66, and the contacts SUP-3 at line 72 and SDP-3 at line 73. Thus, the contacts S-2 must open when the car is at a sufficient distance from the landing to enable the car to stop within the limitation of the system which is generally well beyond the 20 inch distance provided for leveling control.

When utilizing a single speed type motive unit, the energization of the relay UVA at line 75 through the de-energization of the relay UV at line 59 in response to a first level predetermined decrease or drop in the incoming power supply will open the contacts UVA-2 and close the contacts UVA-3. The high speed auxiliary relay HRX will be de-energized to command the velocity command circuit 12 to operate the system under the reduced speed mode of operation wherein the car is slowed to a lower predetermined maximum velocity.

The closure of the contacts UVA-3 under the reduced speed mode of operation completes an electrical circuit around the contacts S-2 so that the relays URX or DRX remain energized even after the contacts S-2 open indicating a normal stopping sequence for a normal mode of operation. As the car approaches to within 20 inches of a landing at which a stop is to be made, the contacts LUD-2 of the leveling relay open to de-energize both relays UX and DRX. In addition, one of the contacts LU-3 or LD-3 at line 120 open when the contacts LUD-2 open to de-energize the high speed leveling relay LVX which, in turn, opens the contacts LVX-1 and closes the contacts LVX-2 in FIG. 6 to initiate a stopping sequence command by the leveling and releveling pattern command circuit 184 within the velocity command generator 12.

The optional utilization of the circuits including the contacts UVA-2 and UVA-3 thus provides a system which not only transfers the maximum permissible speed limitation from one predetermined level to a second predetermined lower level for a reduced speed mode of operation, but also transfers the required stopping distance from one pre-established stopping distance to a shorter or lesser pre-established stopping distance.

The fact that the car is required to travel at a slower speed in a reduced speed mode of operation permits a slow down sequence for stopping at a landing when arriving at a position 20 inches from the landing as sensed through the energization of the leveling relays. The setting of the brake through the de-energization of the brake relay BK at line 86 would open the contacts BK-3 at line 131 to prevent the contacts UVA-3 from energizing the relays URX and DRX.

FIG. 5

FIG. 5 illustrates in diagrammatic form the inter-connection of the D.C. motor 1 and the brake 28 for controlling the movement of an elevator car 162. Specifically, the armature circuit 2 of the D.C. motor 1 is coupled to selectively rotate a drive shaft 163 which is further coupled either directly or through appropriate gearing (not shown) to a traction sheave 164. The car 162 is supported by a cable 165 which is reeved over the traction sheave 164 and provides an opposite end which is connected to a counter-weight 166. The selective rotation of sheave 164 enables the car 162 to travel in the up or down direction through an elevator shaft which may include one or more guide rails 167 for providing service to any one of a plurality of floors, such as landing 168. A car door 169 generally cooperates with a hoist way door (not shown) when the car 162 is adjacent to the landing 168 to permit passenger transfer to and from the car.

The brake 28 is operatively coupled to the drive shaft 163 through the brake shoes 170. Specifically, the brake shoes 170 are selectively operated to lift from the drive shaft 163 in accordance with the selective energization of a solenoid 171. A core element 172 of the solenoid 171 is coupled to an energizing coil 173 and is connected to the brake shoes 170 through an operating rod 174. The brake shoes 170 are biased into a first position for fully engaging the drive shaft 163 by a biasing element illustrated as a spring 175 which is interconnected between a fixed reference support 176 and the movable core element 172. The coil 173 is connected in circuit to the brake and field static power converter 23 through the output leads 29 and the normally open contacts BK-4 and BK-5. The energization of coil 173 permits the brake shoes 170 to lift or move to a second position for disengagement from the drive shaft 163 for permitting rotatable operation of the sheave 164. The coil 173 is supplied with electrical energy in accordance with a novel control which will be described more fully hereinafter.

The drive shaft 163 is also connected or otherwise coupled to the tachometer 16 for providing an output signal at lead 15 which is proportional to the speed of rotation of sheave 164 and thus to the speed of travel of the elevator car 162.

The armature circuit 2 includes a pair of leads 177 which are connected in circuit to the output leads 6 from the static power converter 4 through the normally open contacts M-3 and M-4 of the motor armature contactor relay. An impedance element shown as a resistor 178 is connected in circuit between the leads 177 through the normally open contacts DB-1 of the dynamic braking relay. The contacts DB-1 may thus be selectively closed to dissipate energy from the armature circuit 2 through the resistor 178 under certain conditions as described hereinafter should the static power converter 4 be disconnected from circuit by the opening of the contacts M-3 and M-4. An armature voltage sensing circuit is also connected across the leads 177 and includes the series connected resistors 179 and 180 which provide an output junction circuit 181 for supplying an armature voltage signal at output lead 19.

FIG. 6

The velocity command and error signal generator 12 is utilized in FIG. 6 and includes a velocity pattern command circuit 182 which is connected in circuit to a summing circuit 183 through the normally open contacts LVX-1 and a leveling and releveling pattern command circuit 184 which is connected in circuit to the summing circuit 183 through the normally closed contacts LVX-2. In operation, the velocity pattern command circuit 182 is connected to the summing circuit 183 by the closure of the contacts LVX-1 when the high speed leveling relay LVX at line 20 in FIG. 4 is energized. The leveling and releveling pattern command circuit 184 is selectively utilied and connected to the summing circuit 183 by the closure of the contacts LVX-2 in response to the de-energization of the relay LVX, such as when the car approaches to within 20 inches of the landing at which it is to stop. The velocity pattern command circuit 182 and the leveling and releveling pattern command circuit 184 are thus alternatively connected to the summing circuit 183 as controlled by the high speed leveling relay LVX. The summing circuit 183 is further continuously connected to the input circuit 14 which is coupled to supply the speed signal $V_T$ from the tachometer 16.

The summing circuit 183 thus receives a command velocity signal from either circuit 182 or circuit 184 which is differentially summed with an opposite polarity speed signal at input 14 to provide an error or difference signal at the output lead 185. The error or difference signal supplied by lead 185 is connected to an inverting input of a high gain amplifier 186 which provides an error signal output at lead 17 for controlling the energization and operation of the D.C. motor 1 which will be more fully described hereinafter. The amplifier 186 contains a feedback circuit which includes a resistor 187 and the normally closed contacts K3X-1 of the third kill relay which generally close at the termination of each running sequence to reset the circuit.

The velocity pattern command circuit 182 together with the summing circuit 183 and the amplifier 186 is specifically shown and described in the copending application having Ser. No. 465,270 of C. Young et al entitled "Control System for a Transportation System" filed on an even date herewith and assigned to a common assignee and reference is made thereto for a clear understanding of the construction and operation of the circuits. Briefly, the velocity pattern command circuit 182 includes a summing circuit 188 which is coupled to provide a signal to an inverting input 189 of a high gain switching amplifier 190 having a clamped feedback circuit (not shown) for providing a limitation upon the commanded maximum rate of change of acceleration or "jerk" of the car 162 and a non-inverting input connected to ground.

An output circuit 191 of the amplifier 190 is coupled through a variable voltage dividing impedance circuit 192 to an inverting input circuit 193 of an integrator 194. The integrator provides an output at lead 196 and further has a non-inverting input coupled to the system ground. A feedback circuit for integrator 194 includes a serially connected resistor 195 and the normally closed contacts K4X-1 of the fourth kill relay which selectively close to reset the integrator 194 generally at the termination of each running sequence. A positive biasing circuit 197 is coupled to a positive voltage source +VDC and a negative biasing circuit 198 is coupled to a negative voltage source −VDC and are selectively preset to provide predetermined saturation voltage levels for integrator 194 thus providing a limitation upon the commanded acceleration of the car 162.

The output circuit 196 of integrator 194 is further coupled to an inverting input 200 of an integrator 201 while a serially connected resistor 202 and the normally closed contacts K4X-2 are coupled between an output circuit 203 and the input circuit 200 of the integrator 201. A non-inverting input of integrator 201 is coupled to the circuit ground. The output circuit 203 is connected to the summing circuit 188 through a feedback circuit 204 and is also connected to the summing circuit 183 through the normally open contacts LVX-1 as previously described.

The output circuit 196 of the integrator 194 is also coupled to an inverting input 205 of an inverting amplifier 206 having an output circuit 207 connected to the summing circuit 188 through a variable impedance circuit 208.

A command input circuit 209 is connected to supply a velocity command signal through an input lead 210 to the summing circuit 188. The lead 210 is connected to various circuits to provide preselected command signals which have a positive polarity for travel in the up direction and a negative polarity for travel in the down direction. A creeping speed input circuit 211 is connected to the lead 210 and to a constant potential voltage source +VDC through a serially connected resistor 212 and the normally open contacts UX-2 and to a constant potential negative voltage source −VDC through a serially connected resistor 213 and the normally open contacts DX-2.

An inspection speed input circuit 214 is also connected to the lead 210 and is further connected in circuit through a resistor 215 and the normally closed contacts ISX-1 of the inspection auxiliary relay to the constant potential positive and negative voltage sources through a junction circuit 216. Specifically, the contacts ISX-1 in the inspection speed circuit 214 are connected through the junction circuit 216 to a positive constant voltage source +VDC through the normally open contacts URX-1 of the up direction starting relay and the normally closed contacts DRX-1 of the down direction starting relay and to a negative constant voltage source −VDC through the normally open contacts DRX-2 and the normally closed contacts URX-2.

An increased speed circuit 217 is connected to the lead 210 to selectively provide a high speed command signal and a reduced speed command signal for operating in a reduced speed mode of operation. The reduced speed command signal is also utilized for single floor runs with the system employing multiple speed type motive units. The high speed command signal is provided through a circuit including a serially connected resistor 218, the normally open contacts HRX-1 of the high speed auxiliary relay and the normally open contacts ISX-2 of the inspection auxiliary relay which, in turn, are connected to the junction circuit 216. The reduced speed command signal is provided by a variable resistor 219 which is parallel connected to the contacts HRX-1.

The maximum velocity commanded by the system for the elevator car is determined by the amount of current supplied to the summing circuit 188 through the input lead 210 as more fully described in the above mentioned copending application of C. Young filed on an even date herewith and further description thereof is deemed unnecessary. Thus, the current supplied through the lead 211 is determined by the selected value of the resistors 212 and 213 and the magnitude of the constant voltage sources +VDC and −VDC to provide an elevator creeping speed, such as eight feet per minute, whenever the up or down direction auxiliary relays UX (at line 121) or DX (at line 122) are energized. Such a creeping speed circuit is highly desirable to provide continued movement of the car in the abnormal situation where the velocity pattern command circuit 182 has decelerated the car to almost a stopped condition before reaching the leveling magnetic switches LUA or LDA.

The current supplied through the lead 214 is determined by the selected impedance value of the resistor 215 and the magnitude of the constant voltage sources +VDC and −VDC. Thus, an elevator inspection speed is provided such as, for example, eighty-five to one-hundred and fifty feet per minute whenever the inspection auxiliary relay (at line 126) is de-energized thus closing the contacts ISX-1 and opening contacts ISX-2 and either the up or down direction starting relays URX or DRX at lines 129 and 130 are energized.

The current supplied through the lead 217 is determined by the selected impedance value of the resistors 218 and 219 and the operable condition of the contacts HRX-1 along with magnitude of the constant voltage sources +VDC and −VDC. Thus, the current supplied through the lead 217 to provide a high speed command signal for operating the elevator at the contact or maximum velocity is determined by the selected impedance value of the resistor 218 and the magnitude of the constant voltage sources +VDC and −VDC because the contacts HRX-1 will be closed in response to the energization of the high speed auxiliary relay. The current supplied through the lead 217 to provide the reduced speed command signal is determined by the selected impedance values of the resistors 218 and 219 and the selected setting of the variable resistor 219 along with the magnitude of the constant voltage sources +VDC and −VDC because the contacts HRX-1 will be open.

The de-energization of the fourth kill relay K4X at line 117 at the termination of each running sequence permits the closure of the contacts K4X-1 and K4X-2 to effectively connect the resistive elements 195 and 202 in circuit to discharge the integrating capacitors associated with the integrators 194 and 201, respectively. In like manner, the de-energization of the third kill relay K3X at line 116 at the termination of each running sequence closes the contacts K3X-1 to deactivate the error signal regulator 186. The closure of contacts K4X-1, K4X-2 and K3X-1 resets the circuit for the next running sequence.

The leveling and releveling circuit 184 provides a transfer preconditioning command circuit 220 and a leveling rescue command circuit 221 which are electrically connected to a summing circuit 222 and further connected to a positive constant voltage source +VDC through the normally open contacts DX-3 of the down direction auxiliary relay and to a negative constant voltage source −VDC through the normally open contacts UX-3 of the up direction auxiliary relay.

The preconditioning circuit 220 is connected to the summing circuit 222 through the normally open contacts LVX-3 of the high speed leveling relay and includes a resistor 223 serially connected with the contacts DX-3 and voltage source +VDC for providing a down direction decelerating preconditioning signal to the summing circuit 222 while a resistor 224 is serially connected to the contacts UX-3 and the voltage source -VDC to provide an up direction decelerating preconditioning signal to the summing circuit 222.

The leveling rescue circuit 221 is directly electrically connected to the summing circuit 222 and includes a resistor 225 connected to the constant voltage source +VDC through the contacts DX-3 and a resistor 226 connected to the consant voltage source -VDC through the contacts UX-3.

An output circuit 227 from the summing circuit 222 is connected to an inverting input of a high gain amplifier 228 which operates as a comparitor having a non-inverting input connected to ground. The amplifier 228 provides an output circuit which is connected to an inverting input 229 of an integrator 230 and includes a plurality of series connected resistors numbered 231 through 234. The resistor 232 is parallel connected with the normally open contacts 2LX-1 of the second leveling auxiliary relay, the resistor 233 is parallel connected with the normally open contacts 3LX-1 of the third leveling auxiliary relay, and the resistor 234 is parallel connected with the normally open contacts 4LX-1 of the fourth leveling auxiliary relay.

The integrator 230 provides an output circuit 235 which is coupled to the input 229 through an integrating capacitor 236 which is parallel connected to a serially connected resistor 237 and the normally closed contacts K5X-1 of the fifth kill relay. The output circuit 235 is further connected to an inverting input 238 of an inverting amplifier 239 which provides an output circuit 240 coupled to the summing circuit 222. The output circuit 235 of the integrator 230 is also coupled to the summing circuit 183 through the normally closed contacts LVX-2 of the high speed leveling relay.

The leveling and releveling circuit 184 selectively operates to supply a decelerating command to the summing circuit 183 in response to the de-energization of the high speed leveling relay LVX at line 120 through the energization of either the up or down leveling zone relays LU or LD at lines 88 and 89 thus signifying that the car has approached to within 20 inches of the landing. The de-energization of the relay LVX thus closes the contacts LVX-2 to connect the leveling circuit 184 to the summing circuit 183 while further opening the contacts LVX-1 to disconnect the velocity pattern control 182.

The leveling circuit 184 is pre-conditioned to effectuate a smooth transfer between control by the velocity pattern control 182 to control by the leveling pattern control 184. At the time of transfer when the contacts LVX-2 close and the contacts LVX-1 open, a command signal is supplied at the output circuit 235 which substantially corresponds to the pattern command signal being supplied at the output circuit 203 to ensure a smooth transition. The contacts LVX-3 are closed during the time the velocity pattern command 182 is supplying a command signal to the summing circuit 183 to provide a pre-conditioning input to the summing circuit 222 thus supplying an input to the integrator 230 through comparitor 228, the resistor 231, and the closed contacts 2LX-1, 3LX-1 and 4LX-1. The integrating capacitor 236 of the integrator 230 thus becomes precharged for providing a predetermined signal at the output circuit 235 which is designed to be substantially equal to the signal at output circuit 203 when the relay LVX is de-energized.

The de-energization of the relay LVX thus opens the contacts LVX-3 to disconnect the pre-conditioning circuit 220 so that the output circuit 227 of the summing circuit 222 which had been providing a substantially zero output to comparitor 228 during the preconditioning stage will provide a stepped input to the comparitor 228. The stepped input from the summing circuit 222 is provided by the summation of the inverted feedback signal supplied through the lead 240 and a relatively small signal from the leveling rescue circuit 221 which has little effect during most of the leveling sequence. The comparitor 228 responds to the stepped input by switching and providing an opposite polarity signal to the inverting input 229 of the intergrator thus permitting the capacitor 236 to discharge in accordance with the time constant established by the effective resistance of the resistors 231 through 234 and the capacitor 236.

The input resistance to the integrator 230 is varied by the sequential opening of the contacts 2LX-1, 3LX-1 and 4LX-1 as the car approaches the landing in response to the selective energization of the second, third and fourth zone leveling relays 2L, 3L, and 4L at predetermined distances from the landing as previously described. The time constant provided by the capacitor 236 and the resistors 231 through 234 thus changes as the car approaches the landing so that the output signal at the lead 235 decays in linear steps as provided by the closed loop control through the inverter 239 and commands the car to stop at a landing for passenger transfer. The leveling rescue circuit 221 provides a continuous command signal to the summing circuit 222 which is particularly useful for releveling if the elevator car proceeds beyond the landing without stopping in an abnormal sequence. Thus should the car over-shoot the landing within a predetermined distance, the leveling circuit 184 would require the car to return to the landing.

The de-energization of the fifth kill relay K5X at line 118 permits the contacts K5X-1 to close and connect the resistor 237 with the capacitor 236 to reset the leveling circuit 184 at the termination of each running sequence.

FIG. 7

The amplifying, compensating, and control circuits 11 are illustrated in FIG. 7 and are connected to receive the regulated error signal from the lead 17. A summing circuit 241 is connected to receive the error signal from the lead 17 and further connected to receive the armature voltage $\pm V_A$ from the lead 18 as supplied from the D.C. motor 1. The summing circuit 241 provides an output signal to an inverting input 242 of a high gain amplifier 243 which has its non-inverting input connected to the circuit ground.

The amplifier 243 provides an output circuit 244 which is connected to the input circuit 242 through a serially connected resistor 245 and the normally closed contacts K3X-2 of the third kill relay which selectively close at the termination of each running sequence to reset the circuit. A logic "OR" circuit 246 is connected to the output circuit 244 and preferrably utilizes diodes to supply a negative polarity signal to a summing circuit 247 and a polarity signal to a summing circuit 248.

The summing circuit 247 also receives a positive potential signal through the lead 249 which is proportional to the armature current signal $+I_A$ as supplied through a transformer circuit 250 from the lead 20. The summing circuit 247 further receives the armature voltage signal $\pm V_A$ from the lead 18 and provides a compensated output signal at lead 251 to the inverting input of a high gain amplifier 252. The amplifier 252 has a non-inverting input connected to the system ground and provides a lead 253 which is connected to the armature gating circuit 7 for controlling the forward direction power output of the static power converter as more fully described hereinafter.

The summing curcuit 248 also receives an armature voltage signal supplied from the lead 18 and further receives a negative potential signal through the lead 254 which is proportional to the armature current signal $-I_A$ as supplied from the transformer 250. The summing circuit 248 thus provides a compensated output at a lead 255 to an inverting input of a high gain amplifier 256. The amplifier has a non-inverting input connected to the system ground and provides an output to an inverting amplifier 257 for supplying an output signal at lead 258 to the armature gating 7 for controlling the reverse direction power output of the static power converter as more fully described hereinafter.

The output circuit 244 from the amplifier 243 is further connected to an inverting input 259 of an amplifier 260 which has a non-inverting input connected to the circuit ground. An output circuit 261 of the amplifier 260 is connected to a negative voltage detector 262 and a positive voltage detector 263. A negative voltage existing at the output circuit 261 is thus sensed by the detector 262 which provides a logic output signal at lead 264 which is coupled to control the gating circuit 7 for enabling the forward bridge in the static power converter 4. In like manner, a positive voltage existing at the output circuit 261 is sensed by the detector 263 and provides a logic output signal at lead 265 which is coupled to control the gating circuit 7 for enabling the reverse bridge in the static power converter 4.

In operation, the enable outputs 264 and 265 are coupled through enabling circuitry to the gating circuit 7 to selectively permit operation of either the forward or reverse bridge circuits in the static converter 4 to operate the motor in either the forward or reverse direction and further provide regenerative operation such as, for example, when the car is decelerating in response to a command from the velocity pattern command 182 or the leveling and releveling pattern command 184. The amount of current supplied from the bridge circuits in the static converter 4 to the motor 1 is controlled by the signals appearing at leads 253 and 258 which constitute the compensated error signal. The signals appearing at leads 253 and 258 thus control the speed of the elevator and have been regulated through the summing circuits 241, 247 and 248 in accordance with the sensed counterelectromotive force and the $I^2R$ losses sensed at the motor 1.

FIG. 8

Figure 8:
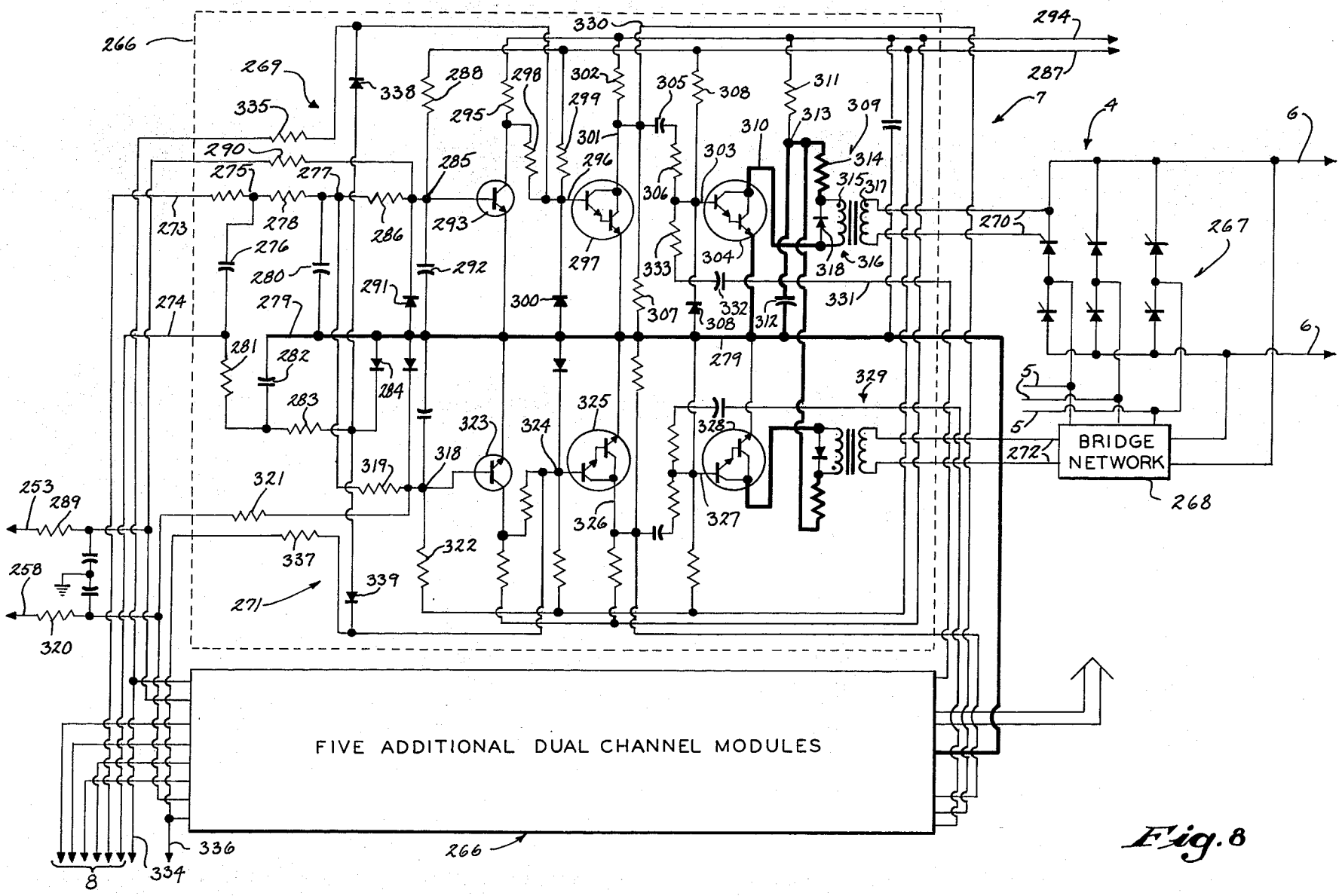
FIG. 8 is a circuit schematic showing the armature gating circuits in FIG. 1.

The armature gating control circuit 7 is illustrated in FIG. 8 and includes six dual-channel modules each designated 266 which control a plurality of controlled rectifiers within a forward or first direction bridge 267 and a reverse or second direction bridge 268 for supplying controlled amounts of current to the D.C. motor 1 through the output leads 6. Because the six modules 266 are similarly constructed, only one will be briefly described which includes a first channel 269 providing a pair of output leads 270 for controlling the firing of one controlled rectifier within the forward bridge 267 and a second channel 271 providing a pair of leads 272 for controlling the firing of one controlled rectifier within the reverse bridge 268. Each channel is further capable of firing another channel connected with the associated bridge to provide a return circuit as more fully described hereinafter.

The firing control signals supplied to the controlled rectifiers from the channels 269 and 271 are phase controlled in accordance with the phase sequence of the incoming three-phase alternating current input 5 as sensed by a referrence transformer 9 thereby providing a phase input 8 which includes the leads 273 and 274. The circuit connections of the channel 269 will be described and it is understood that the circuit connections of the channel 271 and the other channels in the remaining modules are similarly constructed and operate in a similar manner to control the bridge networks 267 and 268.

The input lead 273 contains a phase signal $V_{AN}$ which represents the alternating input voltage existing between the phase A and neutral as sensed by the transformer 9 while the lead 274 contains a signal $V_{NA}$ which represents the alternating input voltage existing between the neutral and phase A which is ninety electrical degrees out of phase from the signal $V_{AN}$. The alternating voltage occurring at a circuit connection 275 thus leads by ninety electrical degrees the alternating voltage at the lead 274 as applied across a capacitor 276. A circuit connection 277 provides a voltage signal which leads the voltage $V_{AN}$ by 60° and is connected to the lead 275 through a resistor 278 and is further connected to a system neutral or ground lead 279 through a capacitor 280. The phase input lead 274 is also coupled to the system ground lead 279 through a resistor 281 and a capacitor 282. A serially connected resistor 283 and diode 284 are parallel connected to the capacitor 282.

A summing circuit 285 is connected to receive the phase signal from the lead 277 through a resistor 286 and is further connected to receive a constant negative signal from a source lead 287 through a resistor 288. The summing point 285 is further connected to receive the control signal from the lead 253 through the resistors 289 and 290. The summing circuit 285 is coupled to the system ground 279 through a parallel connected diode 291 and capacitor 292 which provide circuit protection and is further connected to the base circuit of an NPN type transistor 293. The transistor 293 has an emitter circuit connected to the system ground lead 279 and a collector circuit connected to a constant positive voltage source lead 294 through a resistor 295 and is rendered conductive whenever the summated signals appearing at the base circuit 285 rise above a predetermined positive voltage level.

The collector circuit of the transistor 293 is further connected to a base circuit 296 of a Darlington pair transistor circuit 297 through a resistor 298. The base circuit is further connected to the consant negative voltage source lead 287 through a resistor 299 and to the system ground lead 274 through a diode 300. An emitter circuit of the transistor circuit 297 is connected to the system ground lead while a collector circuit 301 is connected to the constant positive voltage source lead 294 through a resistor 302. The Darlington pair 297 is biased to be turned off by the negative signal supplied through resistor 299 and turns on whenever a sufficiently positive predetermined voltage appears at base circuit 296, such as when the transistor 293 turns off thus operatively connecting the positive voltage source lead 294 to the base circuit 296.

The collector circuit 301 of the Darlington pair 297 is also connected to a base circuit 303 of a Darlington pair type transistor circuit 304 through a serially connected capacitor 305 and resistor 306. The collector circuit is further connected to the system ground lead 279 through a resistor 307 while the base circuit 303 is connected to the ground lead 279 through a diode 308. The base circuit 303 is also connected to the constant negative voltage source lead 287 through a resistor 308 which provides a signal tending to turn the Darlington pair 304 off.

An output circuit 309 is provided to couple a collector circuit 310 of the Darlington pair 304 to the output leads 270 for controlling the conduction of a controlled rectifier in the bridge circuit 267. Specifically, the circuit includes a resistor 311 serially connected to a capacitor 312 through a junction circuit 313 with the resistor 311 connected to the constant positive voltage lead 294 and the capacitor 312 connected to the ground lead 279. The collector 310 of the Darlington pair 304 is connected to the junction circuit 313 through a serially connected resistor 314 and a primary winding 315 of a transformer 316 which, in turn, provides a secondary winding 317 connected to the leads 270. A diode 318 is parallel connected to the primary winding 315 for protective purposes.

In operation to provide a firing pulse through the leads 270 to render a controlled rectifier within the bridge circuit 267 conductive, the signal appearing at the base summing circuit 285 must be above a predetermined positive voltage level to render the transistor 293 "on" or conductive. The period or time in a cycle that the transistor 293 is turned "on" determines the allowable conduction time of the associated controlled rectifier. The controlled conduction time of the controlled rectifiers thus controls the amount of current supplied to the motor 1 for controlling the speed thereof. The length of each firing pulse is thus dependent upon the magnitude of the compensated error signal supplied to the summing circuit 285 from the lead 253 which is differentially combined with the phase signal supplied to the summing circuit 285 from the phase circuit lead 277.

The turning "on" of transistor 293 operatively connects the resistor 295 to the ground lead 279 so that the signal at the base circuit 296 decreases to turn the Darlington pair 297 "off" thus operatively disconnecting the resistor 302 from the ground lead 279 and increasing the voltage signal at base circuit 303 to turn "on" the Darlington pair 304. An output pulse is thus provided to the leads 270 to turn the associated controlled rectifier "on" when the capacitor 312 is discharged through the resistor 314, the primary winding 315 and the Darlington pair 304 to the circuit ground lead 279. The associated controlled rectifier connected to the leads 270 is thus maintained in a conductive state for a controlled period of time as determined from the time the transistor 293 is turned "on" until the controlled rectifier is commutated "off" by the incoming power supply.

The channel 271 operates in a similar manner for controlling an associated controlled rectifier within the bridge network 268 through the leads 272. The channel 271 provides a summing circuit 318 which is connected to receive a phase signal from the lead 277 through a resistor 319 and is further coupled to receive the compensated error signal from the lead 258 through the resistors 320 and 321. The summing circuit 318 is further connected to the constant negative voltage source circuit 287 through a resistor 322.

The summing circuit 318 is thus connected to control the base circuit of an NPN type transistor 323 which, in turn, provides a collector circuit electrically coupled to control a base circuit 324 of a Darlington pair transistor circuit 325. The Darlington pair 325 provides a collector circuit 326 which is electrically coupled to control a base circuit 327 of a Darlington pair transistor circuit 328 which, in turn, provides an output circuit 329 for providing firing control pulses to an associated controlled rectifier within the bridge network 268.

The firing command provided by the channel 269 for firing an associated controlled rectifier within the bridge network 267 is also effective for rendering another controlled rectifier within the same network 267 conductive to provide a return current path for the circuit established through the output leads 6. Specifically, the turning off of the Darlington pair 297 operatively connects the consant positive voltage source lead 294 to the base circuit 303 thereby turning "on" the Darlington pair 304 and also operatively connects the source lead 294 to another Darlington pair base circuit similarly situated in another channel through the output lead 330. In a similar manner, the firing command provided by another channel associated with network 267 will connect a constant positive voltage to the base circuit 303 of the Darlington pair 304 through an input lead 331, capacitor 332, and resistor 333 to supply a firing pulse to the leads 270.

A disabling interlock circuit includes a disable line 334 which is coupled to the base circuit 296 of the Darlington pair 297 within the channel 269 through a resistor 335 and a disable line 336 which is coupled to the base circuit 324 of the Darlington pair 325 within the channel 271 through a resistor 337. A constant positive voltge signal is selectively applied to the leads 334 and 336 by control circuitry more fully described hereinafter to selectively control the conduction of the Darlington pairs 297 and 325 within all of the channel modules 266. A constant positive voltage supplied to the base circuit 296 through the lead 334 turns "on" the Darlington pair 297 and prevents the channel 269 from issuing firing pulses to the bridge network 267. In a similar manner, a constant positive voltage supplied to the base circuit 324 through the lead 336 turns "on" the Darlington pair 325 and prevents the channel 271 from issuing firing pulses to the bridge network 268.

The disable lines 334 and 336 are coupled to control the channels 269 and 271 within all the modules 266. Thus, a positive disabling signal occurring on lead 336 and the lack of such disabling signal on lead 334 disables or prevents the operation of the bridge network 268 and enables or permits the selective operation of the bridge network 267 in response to the magnitude of the compensated error signal supplied on the lead 253 and the phase signal at lead 277. It is further apparent that a positive disabling signal occurring on lead 334 and the lack of such disabling signal on lead 336 disables channel 269 and the bridge network 267 and enables the channel 271 an the bridge network 268. The occurrance of disabling signals on both disable leads 334 and 336 would, of course, disable both channels 269 ad 271 in all modules 266 to prevent the bridge networks 267 and 268 from supplying energizing power to the motor 1.

It will become apparent hereinafter that during normal elevator operation, the disable signals occurring on leads 334 and 336 are supplied from circuitry (as described hereinafter) which respond to the signals supplied from the polarity detectors 262 and 263 through the leads 264 and 265 shown in FIG. 7.

The phase detecting circuit in each module further provides circuitry for alternately disabling channels 269 and 271 in accordance with the alternating polarity of the phase reference signal. Specifically, the phase sensing resistor 283 is coupled to the base circuit 296 of the Darlington pair 297 through a diode 338 and is further coupled to the base circuit 324 of the Darlington pair 325 through a diode 339. The diodes 338 an 339 each conduct an alternate half-cycles of the sensed phase signal to alternately disable the channels 269 and 271 to thereby permit the associated controlled rectifiers to conduct when the input 5 is of the proper phase sequence.

FIG. 9

The brake modulating control 33 is shown in FIG. 9 and operates to supply a brake control signal through the output circuit 34 to the brake gating circuit 31. A command signal circuit 340 is connected to a positive source +VDC which is provided from the circuit lead 135 in FIG. 4 when the contacts L1, L2 and L3 at line 110 close and the contacts PA-8, M-2 and MT-1 close at line 113 through 115 The positive voltage source +VDC is coupled to the system ground through a resistor 341 and a Zener diode 342 to a parallel connected capacitor 343. An output circuit 344 is connected to the juncture between the resistor 341 and the Zener diode 342 to provide a pre-established constant voltage output for supplying a command signal to a summing circuit 345 through a resistor 346.

The summing circuit 345 is connected to an inverting input 347 of a high gain amplifier 348 which operates to supply an output to the lead 34. A non-inverting input 349 of the amplifier 348 is connected to the system ground through a resistor 350 while the diodes 351 and 352 are parallel connected with opposite orientation between the inputs 347 and 349 to protect the amplifier. The output circuit 34 is connected to the inverting input 347 through a gain setting resistor 353 which is parallel connected to a capacitor 354 and a circuit including a serially connected resistor 355, the normally closed contacts KIX-1 of the first kill relay, and a resistor 356.

The brake voltage applied to the brake solenoid 171 is sensed at a circuit 30 in FIG. 5 which includes three serially connected resistors 357, 358 and 359 coupled across the brake winding 173 for providing a pair of voltage signals at output leads 360 and 361 which are proportional to the brake lifting voltage when the contacts BK-4 and BK-5 are closed. The leads 360 and 361 are coupled to the input circuit 37 in FIG. 9 for supplying an input signal to a high gain amplifier 362.

The lead 360 is connected to an inverting input 363 of the amplifier 362 through the serially connected resistors 364 and 365. The lead 361 is connected to the non-inverting input 366 of the amplifier 362 through the serially connected resistor 367 and 368. The juncture between resistors 364 and 365 is connected to the system ground through a capacitor 369 while the juncture between the resistors 367 and 368 is connected to the system ground through a capacitor 370. A pair of diodes 371 and 372 are oppositely connected in parallel circuit between the inverting input 363 and the non-inverting input 366 of the amplifier 362 to provide circuit protection while the input 366 is further connected to the system ground through a resistor 373.

The amplifier 362 provides an output circuit 374 which is connected to the summing circuit 345 through a resistor 375 and is further connected to the inverting input 363 through a parallel connected resistor 376 and capacitor 377.

The amplifier 362 and associated circuitry thus constitutes a feedback circuit 378 which senses the brake lifting voltage supplied to the solenoid 171 in response to the brake lifting command provided by the circuit 340 through the amplifier 348, the gating circuit 31 and the static power converter 23 for providing a regulating signal to the summing circuit 345.

In operation, the connection of biasing power by the supervisory control 13 to the brake modulating control circuit 33 provides a predetermined command signal to the summing circuit 345 by the command circuit 340 which is effective at the start of each run to provide an output at lead 34 for applying maximum lifting potential to the brake solenoid 171. The brake lifting voltage applied to the brake 28 in response to the command signal at lead 34 at the start of each run is designed to be of such magnitude to quickly lift the brake shoes 170 but would tend to burn out the coil circuit 173 if maintained for any length of time. The voltage applied to the coil 173 is thus sensed by the circuit 30 to provide a brake voltage proportional input to the circuit 37 and thus to the feedback circuit 378. The feedback voltage supplied to the circuit 37 is inverted in polarity by the amplifier 362 to supply a current signal through the resistor 375 which opposes the command current signal supplied through the resistor 346 so that the resulting signal supplied to the amplifier 348 is of such magnitude that the brake lifting signal supplied at lead 34 maintains the brake voltage at a predetermined desired lifting magnitude. The predetermined magnitude of brake lifting voltage is thus maintained during a normal operating run between landings to maintain the brake in a fully lifted condition without burning out the brake solenoid 171.

An emergency landing mode monitoring circuit 379 is connected to receive a tachometer voltage signal $V_T$ at the input circuit 36 as supplied form the output circuit 15 of the tachometer 16 and an armature voltage signal $\pm V_A$ at the input circuit 35 as supplied from the output circuit 19 of the D.C. motor 1. The leads 35 and 36 are connected to an inverting input circuit 380 of an amplifier 381 through the resistors 382 and 383, respectively. The amplifier 381 provides an output circuit 384 which is connected to the input 380 through a gain setting resistor 385 which is parallel connected to a capacitor 386. A non-inverting input 387 is coupled to the circuit ground through a resistor 388 while a pair of parallel connected diodes 389 and 390 are connected between inputs 380 and 387 for protecting the amplifier from abnormal transient input signals.

An inverting amplifier 391 provides an inverting input 392 which is connected to the output circuit 384 through a serially connected diode 393 and resistor 394. A non-inverting input 395 is coupled to the system ground through a resistor 396 while a pair of parallel connected diodes 397 and 398 are connected between the inputs 392 and 395 for protecting the inverting amplifier 319 from abnormal transients. An output circuit 399 of amplifier 391 is connected to the input circuit 392 through a gain setting resistor 400 which is parallel connected to a capacitor 401. The output circuit 399 is further connected to the cathode circuit of a diode 402 which provides an anode circuit connected to the summing circuit 345 through the normally closed contacts ELAX-1 of the emergency landing second auxiliary relay and a resistor 403. The output circuit 384 of the amplifier 381 is thus connected to the anode circuit of the diode 393 and is further connected to a cathode circuit of of diode 404 which provides an anode circuit connected to the summing circuit 345 through the contacts ELAX-1 and the resistor 403.

Under a normal mode of operation, the contacts ELAX-1 of the emergency landing second auxiliary relay are open to electrically disconnect the emergency landing mode monitoring circuit 379 from effective operation. Whenever certain sensed malfunctions exist within the system necessitating an emergency landing mode of operation, the relay ELAX at line 119 in FIG. 4 becomes de-energized thereby closing the contacts ELAX-1 for supplying a variable emergency landing mode brake control signal to the summing circuit 345 through the resistor 403. The emergency landing mode brake control signal supplied from the circuit 379 is thus algebraically summed at the summing circuit 345 with the brake lifting command signal from the circuit 340 and the brake voltage feedback signal supplied through the circuit 378 to provide the brake command signal at the lead 34.

The tachometer velocity signal $V_T$ and the armature voltage signal $\pm V_A$ are summed at the inverting input circuit 380 of the amplifier 381 for supplying a negative signal at the summing circuit 345 when operating in an emergency landing mode through either the diode circuit 404 or the inverting circuit including the inverting amplifier 391 and the diode 402. The emergency landing mode signal supplied to the summing circuit 345 through resistor 403 is thus generally of the same polarity as the brake voltage feedback signal supplied through the resistor 375 but is of an opposite polarity of the command signal supplied through the resistor 346. The emergency landing mode brake signal supplied from cricuit 379 thus adds at the summing circuit 345 to the brake voltage feedback signal, if any, supplied through the circuit 378 and opposes the brake lifting command signal supplied from the circuit 340.

Assuming that both the velocity signal $V_T$ and the armature voltage signal $\pm V_A$ are connected to the terminals 36 and 35, respectively, when the contacts ELAX-1 close, the three signals which are supplied from the command circuit 340, the feedback circuit 378 and the emergency mode circuit 379 combine to supply a brake setting signal at output 34 when the car is traveling above a first predetermined speed, such as fifteen feet per minute, as established by the input at terminals 35 and 36, and to supply a brake lifting signal at output 34 when the car is traveling at or below the first predetermined speed.

Assuming the car is traveling above the first predetermined speed such as when operating in a normal mode of operation or in a reduced speed mode of operation, the automatic transfer of the system operation into the emergency landing mode closes the contacts ELAX-1 and the emergency landing mode signal supplied to the summing circuit 345 from the circuit 379 dominates or is greater than the command signal supplied from the circuit 340. The dominating signal supplied from the circuit 379 results in a negative signal at the inverting input 347 of the inverting amplifier 348 which thus supplies a positive output signal at lead 34 which is effective to de-energize the solenoid coil 173 to set the brake shoes 170 through the control provided by the gating circuit 31 and the static converter 23. The car 162 is thus braked or decelerated by the brake shoes 170 fully engaging the drive shaft 163 until the car speed decreases to the first predetermined speed. Because the brake is set by the de-energization of the solenoid coil 173, the feedback circuit 378 will not supply a signal to the summing circuit 345 so that only the command signal from the circuit 340 and the emergency mode signal from the circuit 379 will sum to control the brake when above the first predetermined speed.

When the car has decelerated to a speed at or below the first predetermined speed, the velocity signal $V_T$ and the armature voltage signal $\pm V_A$ combine to provide an emergency mode signal to the summing circuit 345 through the resistors 403 which is smaller than the command signal supplied from the circuit 340. As a result, the positive command signal supplied from the circuit 340 dominates to provide a positive signal to the inverting input 347 of the amplifier 348 which provides a brake lifting negative output at the lead 34. The brake thus lifts and disengages the drive shaft 163 so that the car is permitted to move in either direction according to the established car momentum and /or the gravity influences acting on the car 162 and the counterweight 166.

The car is thus permitted to move unrestrained toward an adjacent landing in an emergency landing mode as long as the car speed remains at or under the first predetermined speed. The feedback circuit 378 again becomes effective for supplying a signal to the summing circuit 345 to ensure that a proper solenoid voltage is maintained without burning out the solenoid coil 173. Should the car speed increase, the tachometer voltage $V_T$ at lead 36 and the armature voltage $\pm V_A$ at lead 35 will correspondingly increase to thereby proportionately increase the emergency landing mode signal supplied to the summing circuit 345 through the resistor 403. If the car speed increases beyond the first predetermined speed, the emergency landing mode signal supplied from the circuit 379 when combined with the brake voltage feedback signal from the circuit 378 will dominate the brake lifting command signal from the circuit 340 to provide a negative signal to the amplifier 348 and a positive signal at lead 34 to again set the brake by de-energizing the solenoid 173. The brake 28 will again fully engage the drive shaft 163 until the car decelerates to a speed at or below the first predetermined speed when it again lifts to permit continued unrestrained movement. When the car is decelerating with the brake 28 set and is traveling at a speed slightly above the predetermined speed, the varying brake setting output at lead 34 is effective for varying the frictional force of the brake shoes 170 upon the shaft 163.

The brake modulating control 33 will thus permit the car 162 to travel to an adjacent landing in an emergency landing mode under a controlled speed limitation so that the brake 28 is set when the car speed is above a first predetermined speed and lifted when the car speed is at or below the first predetermined speed. It is apparent that the brake 28 can be alternatively set and lifted should the car speed tend to increase as the car moves to an adjacent landing to maintain the speed at or near the first predetermined speed.

The brake modulating control circuit 33 further provides a very desirable safety feature by transferring the brake setting speed in the emergency landing mode from the first predetermined speed to a second predetermined speed in the event that the tachometer voltage signal $V_T$ becomes disconnected from the lead 36 or otherwise becomes inoperable. Specifically, the loss of velocity signal decreases the summated signal appearing at the inverting input 380 of amplifier 381 due to the presence of only $\pm V_A$ to correspondingly decrease the signal supplied to the summing circuit 345 through the resistor 403. The reduced emergency landing mode signal supplied to the summing circuit 345 in response to the loss of $V_T$ thus combines with the feedback signal from the cirucit 378 and the command signal from the circuit 340 to establish a second predetermined speed, such as thirty feet per minute, at which the car must travel at or under in order to maintain the brake lifted. The circuit 33 is thus effective to set and lift the brake 28 in accordance with the monitored speed varying with respect to the second predetermined speed in a manner similar to that described with respect to the first predetermined speed.

The loss of only the armature voltage input signal $\pm V_A$ at lead 35 would also modify the operation of the brake modulating control circuit 33 to be responsive to the second predetermined speed in a similar manner.

Th contacts K1X-1 of the first kill relay generally close at the termination of each run when the car has stopped to reset the circuit for another running sequence.

FIG. 10

Figure 10:
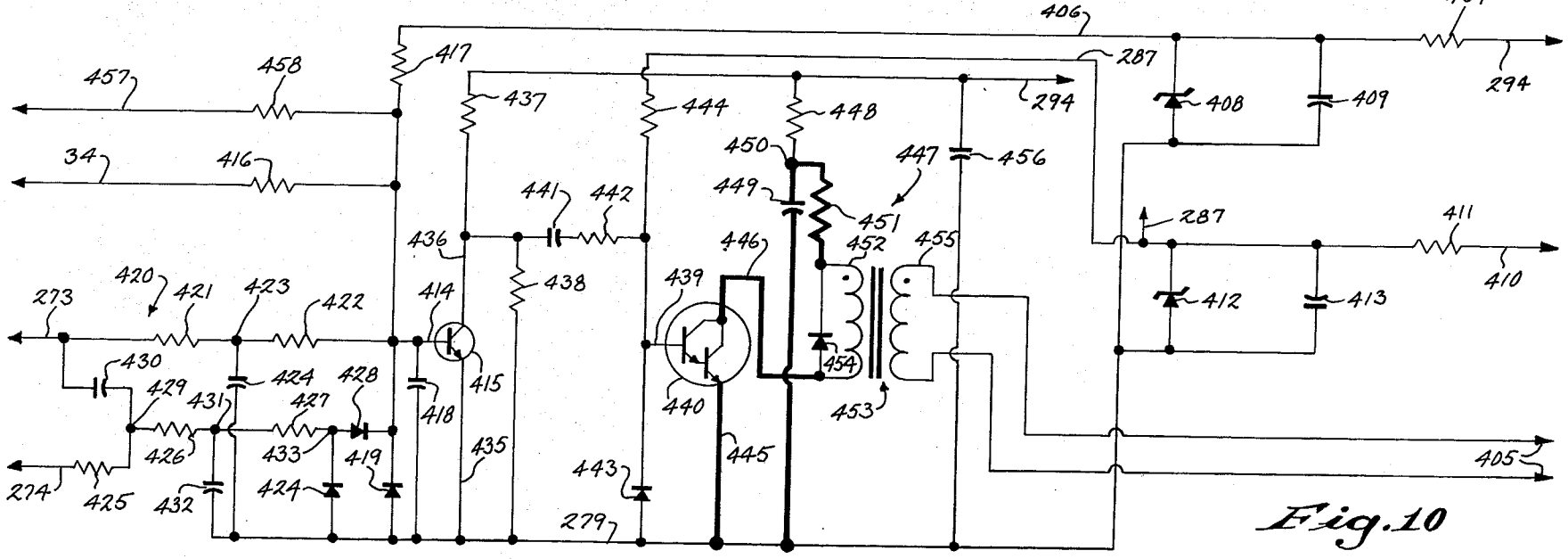
FIG. 10 is a circuit schematic showing the brake gating circuit in FIG. 1.

The brake gating circuit 31 is illustrated in FIG. 10 and receives an input from the brake modulating control 33 through the lead 34 and provides an output to the brake static power converter 23 through a pair of leads 405. The positive constant voltage lead 294 is connected to a positive regulated voltage lead 406 through a resistor 407 with the lead 406 coupled to the system neutral or ground lead 279 through a parallel connected Zener diode 408 and capacitor 409. A negative constant voltage lead 410 is connected to the negative regulated voltage lead 287 through a resistor 411 while the lead 287 is further coupled to the system ground lead 279 through a parallel connected Zener diode 412 and capacitor 413.

The brake command signal supplied from the brake modulating control 33 on the lead 34 is coupled to a base circuit 414 of an NPN type transistor 415 through a resistor 416. The base circuit 414 is also coupled to the positive voltage lead 406 through a resistor 417 and is further coupled to the system ground lead 279 through a parallel connected capacitor 418 and diode 419.

A phase sensing circuit 420 is also coupled to the base circuit 414 and includes the phase leads 273 and 274 which supply the phase signals $V_{AN}$ and $V_{NA}$, respectively. Specifically, the phase lead 273 is connected to the base circuit 414 through the serial connected resistors 421 and 422 with a juncture circuit 423 connected to the ground lead 279 through a capacitor 424. The phase lead 274 is also coupled to the base circuit 414 through a serially connected circuit including the resistors 425, 426 and 427 and a diode 428. A junction circuit 429 betweeen the resistor 425 and 426 is connected to the phase lead 273 through a capacitor 430 while a junction circuit 431 between the resistors 426 and 427 is coupled to the system ground lead 279 through a capacitor 432. A junction circuit 433 between the diode 428 and the resistor 427 is coupled to the system ground lead 279 through a diode 434.

An emitter circuit 435 of the transistor 415 is connected to the system ground lead 279 while a collector circuit 436 is connected to the constant positive voltage lead 294 through a resistor 437 and to the ground lead 279 through a resistor 438. The collector circuit 436 is also coupled to the base circuit 439 of a Darlington pair type transistor circuit 440 through a serially connected capacitor 441 and resistor 442. The base cirucit 439 is connected to the system ground lead 279 through a diode 443 and to the negative regulated voltage lead 287 through a resistor 444. An emitter circuit 445 is connected to the system ground lead 279 while a collector circuit 446 is coupled to the constant positive voltage lead 294 through an output circuit 447.

The output circuit 447 includes a resistor 448 connected to the lead 294 and coupled to the ground lead 279 through a serially connected capacitor 449. A junction circuit 450 between the resistor 448 and the capacitor 449 is coupled to the collector circuit 446 through a resistor 451 and a primary winding 452 of a transformer 453. A diode 454 is parallel connected to the primary winding 452 of the transformer 453. The transformer 453 further provides an output winding 455 which is coupled to the output leads 405 for supplying firing control pulse to the static converter 23. A capacitor 456 is coupled between the constant positive lead 294 and the system ground lead 279.

A disable lead 457 is also coupled to the base circuit 414 of the transistor 415 through a resistor 458 for supplying enabling and disabling signals to the brake gating circuit 31.

In operation, a positive signal is impressed upon the base circuit 414 through the resistor 417 which tends to render the transistor 415 continually conductive irrespective of the alternating reference phase signal supplied through the resistor 422 and the half-wave rectified 180° disable signal supplied through the diode 428, assuming that a brake lifting command signal has not been supplied at the input lead 34. The conduction or turning "on" of the transistor 415 operatively connects the resistor 437 to ground and renders the Darlington 440 non-conductive or turned "off" to open-circuit the primary winding 452 and prevent an output pulse from issuing on lead 405 which results in the brake solenoid 171 being de-energized and the brake 28 set.

A brake lifting command signal appears at the input circuit 34 when the signal supplied through the resistor 416 is sufficiently negative to render the transistor 415 non-conductive or turned "off" during a portion of each alternating power cycle. The signal supplied to the base circuit 414 through the diode 428 permits the transistor 415 to be turned "off" only during a 180° portion of each alternating cycle while the phase reference signal supplied through the resistor 422 provides an alternating signal which is summed with the signals supplied by the resistors 416 and 417 and the diode 428 to select the duration of time the transistor 415 is turned "off".

In practice, a brake lifting command signal provides a signal to the resistor 416 of a predetermined magnitude which sums with the negative excursions of the phase reference signal supplied through resistor 422 to oppose the positive signal supplied through resistor 417 and possibly any positive signals supplied through diode 428 to render the transistor 415 nonconductive or turned "off" for a predetermined period of time during each electrical cycle.

The turning "off" of the transistor 415 turns on the Darlington 440 to permit the capacitor 449 to rapidly discharge to the circuit ground through the primary winding 452. An output pulse is thus provided through the leads 405 to the static power converter 23 which operates to energize and lift the brake 28. Thus while a negative brake lifting command signal is continuously supplied to the input circuit 34, the transformer 453 provides firing pulses to the converter 23 according to the sensed phase relationship of the power source 5. The brake gating circuit is also capable of commanding small amounts of energy to partially energize the brake 28 while in a set condition to vary the frictional force applied by the brake shoes 170.

FIG. 11

The brake and field static power converter 23 is shown in FIG. 11 as receiving the three phase A.C. input 5 at the leads designated as L1, L2 and L3 for supplying controlled amounts of direct current to the motor field circuit 3 through the leads 22 and further selectively supplying direct current pulses to the brake solenoid circuit 171 through the output leads 29.

The three power leads L1, L2 and L3 are connected through the fuses 459, 460 and 461, respectively, to supply a phase A input at a lead 462, a phase B input at lead 463, and a phase C input at lead 464.

The phase A lead 462 is coupled to the anode circuit of a diode 465 which, in turn, is connected to a direct current output lead 466. The lead 462 is further connected to a cathode circuit of a controlled rectifier 467 which, in turn, is connected to a direct current output lead 468. The phase B lead 463 is similarly connected to the output lead 466 through a diode 469 and to the output lead 468 through a controlled rectifier 470 while the phase C lead 464 is connected to the output lead 466 through a diode 471 and to the lead 468 through a controlled rectifier 472.

The controlled rectifiers 467, 470 and 472 each contain a pair of gating inputs 473, 474, 475, respectively, one of which is connected to the controlled rectifier gating circuit and the other to the cathode circuit for selectively rendering the controlled rectifiers conductive in response to a command input provided by the field gating circuit 25. The output leads 466 and 468 are connected to a transformer circuit 476 which, in turn, supplies field current to the field circuit 3 through the leads 22 in response to the gating control provided by the gating circuit 25 through the leads 473, 474 and 475 and further provides an output circuit 24 which supplies a signal proportional to the field current.

A fly-back diode 477 provides a cathode circuit connected to the lead 466 and an anode circuit connected to the lead 468. The phase A lead 462 is further connected to the cathode circuit of a controlled rectifier 478 which, in turn, provides an anode circuit connected to an output lead 479. A diode 480 provides a cathode circuit connected to the lead 466 and an anode circuit connected to the lead 479.

The output leads 29 which are coupled to the brake solenoid coil 173 illustrated in FIG. 5 through the contacts BK-4 and BK-5 and further coupled to the leads 466 and 479. The pair of output leads 405 from the brake gating circuit 31 are connected to the controlled rectifier 478 as a gating control input with one lead connected to the controlled rectifier gating circuit and the other to the cathode circuit.

In a brake lifting sequence, the controlled rectifier 478 is periodically rendered conductive by the gating pulses suppled from the brake gating circuit 31 through the leads 405 to provide a pulsed direct current output at the leads 29 for energizing the solenoid coil 173 in FIG. 5 through the closed contacts BK-4 and BK-5 thus lifting the brake shoes 170 from the drive shaft 163. The D.C. current pulsations supplied to the brake 28 occur at sufficiently close intervals or at a frequency which permits the coil 173 to continually retain the solenoid core 172 in a lifted condition through the residual magnetic flux between the coil 173 and the core 172 which continues to exist between the recurring energizing pulses.

The conduction of the controlled rectifier 478 provides an energizing circuit to the brake 28 through the phase B lead 463, the diode 469, the output lead 466, the output lead 29, the contacts BK-4, the coil 173, the contacts BK-5, the lead 29, the lead 479, the controlled rectifier 478 and the phase A lead 462. It is also possible to render the controlled rectifier 478 conductive for only a short period during each electrical cycle of the incoming power for supplying energizing power to the solenoid coil 173 which is insufficient to lift the brake 28 but is effective for varying the brake pressure exerted by the brake shoe 170 when in a set condition.

A brake setting sequence wherein the brake shoes 170 are in a maximum engaging position is provided by de-energizing the solenoid coil 173 either by rendering the controlled rectifier 478 non-conductive or turned "off" or by opening the contacts BK-4 and BK-5 through the de-energization of the brake relay BK at line 86 in FIG. 3.

FIG. 12

The over-regulation detector 44 is shown in FIG. 12 and is connected to the lead 17 for receiving the amplified error signal from the velocity command and error signal generator 12 illustrated in FIG. 6 for operably controlling the selective energization of an over-regulation fault relay OVX.

A positive signal sensing channel 481 is connected to the lead 17 and to a constant negative signal source 482 while a negative signal sensing channel 483 is connected to the lead 17 and to a constant positive signal source 484. The sensing channel 481 includes a switching amplifier 485 having an inverting input circuit 486 connected to the lead 17 through a serially connected diode 487 and resistor 488. The switching amplifier 485 further has a non-inverting input circuit 489 which is coupled to the system ground through a resistor 490 and an output circuit 491 coupled to the input circuit 486 through a parallel connected resistor 492 and capacitor 493.

The negative signal source 482 includes a constant negative voltage source designated −VDC which is coupled to the system ground through a serially connected resistor 494 and Zener diode 495. A junction circuit 496 connecting the resistor 494 and the Zener diode 495 is connected to the inverting input circuit 486 through a resistor 497.

The positive sensing channel 481 further includes an NPN type transistor 498 having a base circuit 499 connected to the output lead 491 through a resistor 500. The transistor 498 provides a collector circuit 501 coupled to a positive potential D.C. biasing source +VDC through a resistor 502 and an emitter circuit connected to a system ground lead 503. The collector circuit 501 is further connected to a base circuit 504 of an NPN type transistor 505 through a resistor 506. The base circuit of the transistor 504 is further connected to the ground lead 503 through a diode 507 while an emitter circuit 508 is connected to the system ground lead 503. A collector circuit 509 of the transistor 505 is connected to a control lead 510 so that the collector-emitter circuit of the transistor is connected between the control lead 510 and the ground lead 503 and thus parallel connected to the relay OVX.

A serially connected diode 511 and resistor 512 are coupled between the leads 510 and 503 for protecting the relay OVX from abnormal circuit transients. A positive potential D.C. bias source +VDC is connected to the relay OVX and to the control lead 510 through a resistor 513.

The sensing channel 483 includes a switching amplifier 514 having an inverting input circuit 515 connected to the input lead 17 through a serially connected diode 516 and resistor 517. The amplifier 514 further provides a non-inverting input circuit 518 connected to the system through a resistor 519 and an output circuit 520 coupled to the input circuit 515 through a parallel connected resistor 521 and capacitor 522.

The positive signal source 484 includes a constant positive voltage +VDC which is coupled to the system ground through a serially connected resistor 523 and a Zener diode 524. A junction circuit 525 is connected between the resistor 523 and the Zener diode 524 and is coupled to the input circuit 515 through a resistor 526.

The sensing channel 483 further includes an NPN type transistor 527 which provides a base circuit 528 coupled to the output lead 520 through a resistor 529 and coupled to the system ground lead 503 through a diode 530. The transistor 527 provides an emitter circuit 531 connected to the ground lead 503 and a collector circuit 532 connected to the control lead 510 so that the collector-emitter circuit of the transistor 527 is parallel connected to the relay OVX.

In operation, the diodes 487 and 516 operate as a logic "or" circuit and operate to supply the amplified error signal appearing at the lead 17 to the input circuit 486 through the resistor 488 when positive and to the input circuit 515 through the resistor 517 when negative.

A negative signal having a predetermined magnitude is supplied from the source 482 to the input circuit 486 where it is summed with the positive amplified error signal supplied from the lead 17. The input 486 thus acts as a summing circuit and provides a negative input to the switching amplifier 485 which, in turn, supplies a positive output signal when the system is operating in a desirable manner. The positive output signal at the lead 491 is thus supplied to the base circuit 499 which turns transistor 498 "on" or conductive so that the base circuit 504 is operatively connected to the system ground thereby maintaining the transistor 505 "off" or non-conductive. The by-pass circuit through the transistor 505 is thus operatively open-circuited to permit continued energization of the relay OVX indicating that the amplified error signal sensed at lead 17 is within the permissible and desirable limits of regulation.

When the positive amplified error signal exceeds a predetermined value, the positive signal supplied through the resistor 488 exceeds the negative signal supplied through the resistor 497 to thereby provide a positive input signal on the lead 486 to the switching amplifier 485. The amplifier 485 thus switches to provide a negative output at the lead 491 which turns the transistor 498 "off" or non-conductive and the transistor 505 "on" or conductive. The turning "on" of the transistor 505 thus provides a short circuit for the signal supplied through the resistor 513 to the circuit ground lead 503 so that the relay OVX will drop or de-energize thus indicating that a malfunction exists by the over-regulation of the positive amplified error signal sensed at lead 17.

The negative signal sensing channel 483 operates in a similar manner as the channel 481 by summing the negative amplified error signal supplied from the lead 17 with a predetermined positive signal from the signal source 484 at the input circuit 515. During a satisfactory operation, the positive signal from the source 484 exceeds the negative amplified error signal from the lead 17 to supply a positive input to the amplifier 514. A negative signal is thus supplied to the base circuit 528 for rendering the transistor 527 "off" or non-conductive to permit the continued energization of the relay OVX indicating that proper regulation is being provided by the negative error signal.

Whenever the negative amplified error signal at the lead 17 exceeds the predetermined positive signal supplied by the source 484, the amplifier 514 switches to provide a positive signal to the base circuit 528 to turn the transistor 527 "on" or conductive. The relay OVX is thus short circuited by the transistor 527 and drops or de-energizes indicating that the negative amplified error signal has exceeded a predetermined dangerous level.

The over-regulation fault relay OVX is thus normally energized when the elevator is being safely regulated by the error signal and drops or de-energizes whenever the error signal exceeds certain predetermined positive and negative limitations indicating an unsafe condition.

The over-regulation detector 44 may also respond to the loss of the speed signal as provided at the output lead 15 of the tachometer 16 for transferring the system operation into the emergency landing mode. Specifically, the loss of the tachometer speed signal at the input lead 14 to the summing circuit 183 in FIG. 6 could result in an excessive error signal at 17 which is effective to de-energize the over-regulation fault relay OVX as previously described, particularly when the velocity command signal is at an appreciable magnitude.

The circuit connections of the over-regulation detector 44 are further tested at the beginning of each starting and running sequence as depicted at 46 in FIG. 1. The signal sources +VDC and −VDC within the detector 44 are supplied from the leads at line 131 in FIG. 4. In the event that the signal sources are not for some reason connected or the circuits in FIG. 12 become disconnected, the relay OVX will de-energize and drop indicating a malfunction within the detector circuit 44. Should the detector 44 properly function at the initiation of a start command, the relay OVX will energize to positively precondition the system for operation in certain modes.

FIG. 13

The over-speed detector 50 is illustrated in FIG. 13 which receives the car speed signal $V_T$ from the tachometer 16 on the lead 15 and operably controls an over-speed fault relay OSX. The lead 15 is connected to a negative input circuit 533 through a parallel connected diode 534 and an inverting circuit 535 including an inverting amplifier 536. An inverting input circuit 537 of the amplifier 535 is connected to the lead 15 through a serially connected resistor 538 and diode 539. The amplifier 536 further provides a non-inverting input 540 coupled to the system ground through a resistor 541 while an output lead 542 is coupled to the input lead 537 through a parallel connected resistor 543 and capacitor 544 and to the negative input circuit 533 through a diode 545. The input circuit 533 thus provides a negative signal which is proportional to the speed signal $V_T$ appearing at the lead 15 through the connection provided by either the diode 534 or the inverting circuit 535 including the diode 545, with both the diodes 534 and 545 having anode circuits connected to the input circuit 533.

An inverting input circuit 546 of a switching amplifier 547 is coupled to the negative input circuit 533 through a parallel connected circuit having one branch including the normally open contacts ELAX-2 of the emergency landing second auxiliary relay and a resistor 548 and a second branch including the normally closed contacts ELAX-3 and a resistor 549.

A reference signal source 550 is connected to the input circuit 546 through a resistor 551 and includes a positive constant voltage source +VDC coupled to the system ground through a serially connected resistor 552 and a Zener diode 553 with the junction circuit 554 connected to the resistor 551.

The switching amplifier 547 provides a non-inverting input circuit 555 connected to the system ground through a resistor 556 while a pair oppositely orientated diodes 557 and 558 are connected between the inputs 546 and 555 to protect the amplifier 547 from abnormal signal transients. The amplifier 547 provides an output circuit 559 which is coupled to the input 546 through a parallel connected resistor 560 and capacitor 561.

An NPN type transistor 562 provides a base circuit 563 which is coupled to the output circuit 559 through a serially connected diode 563 and resistor 564 and further coupled to a system ground lead 565 through a diode 556. The transistor 562 further provides an emitter circuit 567 which is connected to the ground lead 565 while a collector circuit 568 is connected to a control lead 569.

The relay OSX is connected between the control lead 569 and the ground lead 565 while a serially connected diode 570 and resistor 571 are parallel connected to the relay OSX for circuit protection from abnormal transients. A source 572 is connected to the control lead 569 and includes a positive constant voltage source +VDC which is connected to the system ground through a pair of parallel connected resistors 573 and 574 and a Zener diode 575 with a junction circuit 576 connected to the control lead 569.

In operation, the contacts ELAX-2 close and the contacts ELAX-3 open in response to the enegization of the emergency landing second auxiliary relay ELAX at line 119 in FIG. 4 when the system is operating under a normal mode of operation or under a reduced speed mode of operation. The negative signal proportional to the car speed appearing at the input circuit 533 is thus supplied to the inverting input circuit 546 of the amplifier 547 through the resistor 548.

A predetermined positive reference signal is supplied by the source 550 to the input circuit 546 through the resistor 551 and is summed with the negative, speed proportional signal supplied through the resistor 548. If the elevator car is operating within a first predetermined speed, the reference signal will be greater than the speed proportional signal at the input 546 so that the switching amplifier will provide a negative signal to turn the transistor 562 "off" or conductive. The relay OSX is thus energized by the source 572 with the transistor 562 turned "off" thereby indicating that the car is operating within the first predetermined speed or velocity.

When the speed of the elevator car 162 increases beyond the first predetermined speed, the negative speed proportional signal supplied through the resistor 548 becomes greater than the positive reference signal supplied from the source 550 to provide a negative signal to the amplifier 547 which, in turn, switches to provide a positive output at the lead 559. The transistor 562 becomes conductive or turns "on" when receiving the positive signal from the amplifier 572 through control lead 569 thereby de-energizing or dropping the relay OSX. The de-energization of the relay OSX indicates that the car has exceeded the first predetermined speed so that the associated contacts will operate to change the mode of operation as discussed more fully hereinafter.

The contacts ELAX-2 open and the contacts ELAX-3 close in response to the system transferring in to an emergency landing mode of operation so that the speed proportional signal is supplied from the input circuit 533 to the summing circuit 546 through the resistor 549. The resistive value of the resistor 549 differs from the resistor 548 so that a second predetermined speed is effective to overcome the predetermined positive reference signal supplied from the source 550 for operatively turning the transistor 362 "on" to de-energize or drop the relay OSX.

In practice, the circuit components and particularly the resistor 548 are selected to operatively de-energize the relay OSX whenever the car speed exceeds approximately 107 ½ per cent above the rated maximum velocity or speed of the system for the normal mode of operation. The resistor 549, on the other hand, is selected to operatively de-energize the relay OSX when the car speed exceeds approximately 107 ½ per cent above the second predetermined emergency landing mode speed such as 107 ½ per cent above 15 feet per minute, for example.

The over-speed detector circuit as illustrated in FIG. 13 can readily be modified to detect other predetermined speeds which might be unsafe in other operating modes or sequences by adding parallel connected circuits to the resistors 548 and 549 which are operatively and selectively connected in circuit and provide preselected impedance values.

The detector circuit 50 could also be modified in an alternative embodiment by placing the contacts ELAX-2 and ELAX-3 in parallel circuit with the resistor 551 together with appropriately selected resistors so that the predetermined positive reference signal would be modified in response to a mode change to transfer the detector operation between the first predetermined speed and the second.

An over-speed detector circuit test 51 as illustrated in FIG. 1 is provided by the circuit illustrated in FIG. 13 at the start of each starting and running sequence. Specifically, the positive constant voltage sources +VDC are provided to the detector circuit 50 from the positive output lead at line 131 in FIG. 4 at the start of each running sequence through the closed contacts L-2, L-3, L-4, PA-8, M-2 and MT-1. If for some reason the sources +VDC do not supply energizing power to the detector circuit 50, the relay OSX will remain de-energized to indicate an unsafe operating condition. Should the detector 50 properly function at the initiation of a start command, the relay OSX will energize to positively precondition the system for operation in certain modes.

FIG. 14

A plurality of input leads 584 are connected to the reference transformer 9 and supply signals proprotional to the incoming power from the three phase A.C. source 5 with each lead supplying a signal representative of one of the incoming phases with respect to neutral. The power is selectively supplied to the input leads 584 by the closure of the line contactor contacts (not shown) in response to the energization of the line contactor relay L at line 77 in FIG. 2. Specifically, a lead 585 supplies the phase signal $V_{NA}$ and is connected to a positive unfiltered D.C. voltage lead 586 through a diode 587 and to a negative unfiltered D.C. voltage lead 588 through a diode 589. A lead 590 supplies the phase signal $V_{AN}$ and is connected to the lead 586 through a diode 591 and to the lead 588 through a diode 592. A lead 593 supplies the phase signal $V_{NC}$ and is connected to the lead 586 through a diode 594 and to the lead 588 through a diode 595. A lead 596 supplies the phase signal $V_{CN}$ and is connected to the lead 586 through a diode 597 and to the lead 588 through a diode 598. A lead 599 supplies the phase signal $V_{NB}$ and is connected to the lead 586 through a diode 600 and the lead 588 through a diode 601. A lead 602 supplies the phase signal $V_{BN}$ and is connected to the lead 586 through a diode 603 and to the lead 588 through a diode 604.

The positive voltage lead 586 is further connected to a filtered positive constant voltage lead 605 through a serially connected diode 606 and resistor 607 while the lead 605 is further coupled to a neutral or system ground lead 608 through a capacitor 609. The lead 588 is further connected to a filtered negative constant voltage lead 610 through a series connected diode 611 and resistor 612.

A first or forward direction enabling circuit 613 is connected to the lead 264 supplied from FIG. 7 for operably controlling the output on the disable lead 334 for enabling and disabling the first or forward direction gating channel 269 of the armature gating circuit illustrated in FIG. 8. Specifically, the lead 264 is coupled to a base circuit 614 of a Darlington pair type transistor circuit 615 through a resistor 616. The base circuit 614 is connected to the system ground lead 608 through a parallel connected capacitor 617 and diode 618 and is further connected to the negative voltage lead 610 through a resistor 619. An emitter circuit 620 of the Darlington circuit 615 is connected to the system ground lead 608 while a collector circuit 621 is connected to the positive voltage lead 605 through a resistor 622 and is further connected to the disable lead 334 through a diode 623.

A second or reverse direction enabling circuit 624 is connected to the lead 265 supplied from FIG. 7 for operably controlling the output on the disable lead 336 for enabling and disabling the second or reverse direction gating channel 271 of the armature gating circuit illustrated in FIG. 8. Specifically, the lead 265 is connected to a base circuit 625 of a Darlington pair type transistor circuit 626 through a resistor 627. The base circuit 625 is also connected to the system ground lead 608 through a parallel connected capacitor 628 and diode 629 and further to the negative voltage lead 610 through a resistor 630. An emitter circuit 631 of the Darlington circuit 626 is coupled to the system ground lead 608 while a collector circuit 632 is connected to the positive voltage lead 605 through a resistor 633 and to the disable lead 336 through a diode 634.

The first or forward direction enabling circuit 613 and the reverse or second direction enabling circuit 624 respond to the command signals provided by the circuit illustrated in FIG. 7 for selectively enabling and disabling the first or forward direction gating channel 269 and the second or reverse direction gating channel 271 to selectively control the operation of the bridge networks 267 and 268. A positive potential or logic "1" signal is issued on the lead 264 to render the Darlington circuit 615 conductive to effectively connect the collector circuit 621 to the system ground 608 thereby removing the positive signal from the disable lead 334. The removal of the positive signal from the disable lead 334 further removes the positive signal through the resistor 335 to the base circuit 296 of the Darlington circuit 297 within the gating channel 269 in FIG. 8 for permitting the transistor circuit 297 to be rendered non-conductive in response to the input signal supplied through the lead 253 and resistor 290.

The removal of the positive signal from the disable lead 334 by the conduction of the transistor circuit 615 is effective for enabling all six of the first or forward direction gating channels 269 in FIG. 8 to be selectively operated in accordance with the command signals supplied through the lead 253 from FIG. 7 and the phase signals supplied through the input leads 8.

A logic "0" or low potential signal applied through the lead 264 renders the transistor circuit 615 non-conductive or turned "off" to effectively apply a positive disable signal to the disable lead 334 through the diode 623. The positive disable signal on the lead 334 is applied to the base circuit 296 to maintain the Darlington circuit 297 conductive or turned "on" to prevent gating signals from being supplied on the leads 270 to the bridge network 267.

The positive disable signal supplied through the lead 334 is thus effective for disablng all six forward direction gating channels 269 so that the bridge network 267 is rendered inoperative and incapable of supplying energizing power to the motor 1.

The second or reverse direction enabling circuit 624 operates in a similar manner as the first or forward direction enabling circuit 613. A positive or logic "1" signal supplied on the lead 265 renders the Darlington circuit 626 conductive thereby removing the positive signal from the disable lead 336 to permit the six gating channels 271 to selectively operate. The second or reverse direction gating channels 271 thus operate in accordance with the command signal supplied on the lead 258 and the phase signals supplied on the leads 8 to operate the bridge network 268 for energizing the motor 1.

A logic "0" or low voltage signal supplied on the lead 265 renders the Darlington circuit 626 non-conductive or turned "off" to apply a positive disabling signal to the disable lead 336 through the diode 634. The positive disable signal on the lead 336 renders the Darlington circuit 325 conductive or turned "on" in all gating channels 271 to render the bridge network 268 inoperable and incapable of supplying energizing power to the motor 1. The enabling circuits 613 and 624 may be selectively and alternatively operated to control the operation of the gating channels 269 and 271 and thus the operation of the bridge networks 267 and 268, respectively.

A circuit 635 senses various emergency mode malfunctions and includes an emergency relay EX connected between the system ground lead 608 and a control lead 636. A Zener diode 637 is parallel connected with a resistor 636 and the relay EX while the control lead 636 is further connected to a positive voltage lead 639 through the parallel connected resistors 640 and 641.

A circuit 642 senses various emergency landing mode malfunctions and includes an emergency landing relay ELX connected to the system ground lead 608 and to a control lead 643. The control lead 643 is connected to the system ground lead 608 through a parallel connected resistor 644 and Zener diode 645 and is further connected to the positive voltage lead 639 through a pair of parallel connected resistors 646 and 647.

The positive voltage lead 639 is connected to the positive constant voltage lead 605 through the normally closed contacts of a heat switch 648 and a connector switch 649. The heat switch 648 is connected to the temperature sensor 49*a* (FIG. 1) located at or near the static power converter 4 containing the bridge circuit 267 and 268. The switch 648 operates in response to a predetermined temperature sensed by the over-temperature detector 49 located at or near the power converter 4 to provide an open circuit between the lead 205 and the lead 639 to deenergize the relays EX and ELX. The connector switch 649 is connected to the circuit connector sensor 55a located at the connecting circuit between the gating control circuit 7 and the static power converter 4. The connector switch 649 operates in response to a disconnection between the gating control circuit 7 and the power converter 4 sensed by the circuit connector detector 55 to provide an open circuit between the lead 605 and the lead 639 to de-energize the relays EX and ELX.

A normally closed set of contacts EX-2 of the emergency relay are connected to the positive voltage lead 605 through a resistor 650 and to the brake disable lead 457 through a diode 651. The contacts EX-2 are further connected to the disable lead 336 through the diodes 652 and 653 and to the disable lead 334 through the diodes 652 and 654.

A normally closed set of contacts ELX-3 of the emergency landing relay are connected to the resistor 650 and to the disable lead 336 through the diode 653 and to the disable lead 334 through the diode 654. A normally closed set of contacts PAX-1 of the potential auxiliary relay are connected to the resistor 650 and to the brake disable lead 457 through the diode 651, to the disable lead 336 through the diodes 652 and 653, and to the disable lead 334 through the diodes 652 and 654.

The normally closed contacts OSXA-1 of the over-speed fault auxiliary relay OSXA are connected to the control lead 636 and to the system ground lead 608 for operably controlling the relay EX. The normally closed contacts OVXA-1 of the overregulation fault auxiliary relay are connected to the control lead 643 and to the system ground lead 608.

When the system operates normally without any malfunctions, the emergency relay EX and the emergency landing relay ELX are continuously energized through the lead 639 and 605 while the contacts OSXA-1 and OVXA-1 remain in an open condition through the energization of the relays OSXA and OVXA, respectively. With the system operating normally, the relays EX and ELX both become energized to pre-condition the system for providing certain modes of operation at the initiation of each starting sequence by the supply of energy to the input leads 584.

The de-energization of the over-regulation fault relay OVX in FIG. 12 closes the contacts OVXA-1 through the deenergization of the relay OVXA at line 112 in FIG. 4 to effectively short-circuit the control lead 643 to the system ground 608 thereby de-energizing the emergency landing relay ELX.

The closing of the contacts ELX-3 in response to the de-energizing or dropping of the relay ELX supplies a positive disable signal from the lead 605 and resistor 650 to the disable leads 336 and 334 through the diodes 653 and 654, respectively, to disable the gating channels 269 and 271 and prevent the bridge networks 267 and 268 from conducting current to the D.C. motor 1. The closing of the contacts ELX-3 does not, however, supply a disable signal to the brake disable lead 457 so that the brake gating circuit 31 may continue to function under an emergency landing mode of operation.

The de-energization of the over-speed fault relay OSX in FIG. 13 closes the contacts OSXA-1 through the de-energization of the over-speed fault auxiliary relay OSXA at line 111 in FIG. 4 to effectively short-circuit the control lead 636 to the ground 608 thereby de-energizing the emergency relay EX.

The closing of the contacts EX-2 in response to the de-energizing or dropping of the relay EX supplies a positive disable signal from the lead 605 and resistor 650 to the armature gating disable leads 336 and 334 and to the brake gating disable lead 457 through the diodes 651, 652, 653 and 654. The disable signals supplied to the disable leads 334 and 336 disable the gating channels 269 and 271 as previously described. The disable signal supplied to the disable lead 457 is connected to base circuit 414 to render the transistor circuit 415 conductive or turned "on" thereby rendering the Darlington circuit 440 non-conductive or turned "off" so that the brake static power converter 23 will no longer supply energizing pulses to the brake solenoid circuit 171 thereby setting the brake.

An over-heated condition of a predetermined temperature within the static power converter 4 is sensed by the temperature sensor 49*a* so that the contacts 648 open to disconnect the lead 639 from the lead 605 to de-energize both of the relays EX and ELX. The contacts EX-2 and ELX-3 both close and disabling signals are supplied to the armature gating disable lines 334 and 336 and to the brake gating disable lead 457.

In like manner, an improper circuit connection between the gating control circuit 7 and the power converter 4 as sensed by the connector sensor 55*a* opens the connector contacts 649 so that both of the relays EX and ELX would drop or de-energize to supply disable signals to the disable leads 334, 336 and 457.

The over-current fault detector 40 includes an armature current sensing circuit 655 and a sample and hold circuit 656. The lead 41 which is coupled to the output lead 21 of the static power converter 4 supplies a negative signal proportional to the armature current to a base circuit 657 of a Darlington pair type transistor circuit 658 through a resistor 659 and a unipolar circuit 659a. The unipolar circuit 659a may constitute a circuit such as the unipolar circuit illustrated in FIG. 9 including the diodes 393, 402 and 404 together with the connecting circuitry. It is thus apparent that the over-current detector could ideally be used to sense a current condition in either an A.C. or D.C. motor. The connection between the resistor 659 and the unipolar circuit 659a is coupled to the system ground lead 608 through a capacitor 660 while the base circuit 657 is coupled to the system ground lead 608 through a parallel connected capacitor 661 and diode 662. The base circuit 657 is further connected to the positive voltage lead 605 through the serially connected resistors 663 and 664 with the junction circuit 665 coupled to the system ground lead 608 through a Zener diode 666.

The Darlington circuit 658 provides an emitter circuit 667 coupled to the system ground lead 608 and a collector circuit 668 connected to the positive voltage lead 605 through a resistor 669. The collector circuit 668 is further connected to the disable lead 334 through a diode 670, to the disable lead 336 through a diode 671, and to the sample hold circuit 656 through a diode 672 and an output lead 673.

The output lead 673 from the armature current sensing circuit 655 is coupled to a base circuit 674 of a Darlington pair type transistor circuit 675 through a resistor 676 within the sample and hold circuit 656. The lead 673 is further coupled to the system ground lead 608 through a capacitor 677 while the base circuit 674 is coupled to the system ground lead 608 through a diode 678 and to the negative voltage lead 610 through a resistor 679. An emitter circuit 680 of the Darlington circuit 675 is coupled to the ground lead 608 while a collector circuit 681 is connected to the control lead 643 for the relay ELX.

In operation, the over-current fault detector 40 senses the negative polarity excursions of the signal which is proportional of the armature current at the base circuit 657 as supplied through the resistor 659 and the unipolar circuit 659a. The sensed negative armature current signals are summed with a positive reference signal having a predetermined polarity supplied through the resistors 663 and 664 to the base circuit 657. When operating in a satisfactory and safe manner, the peak magnitude of the armature current signal negative excursions will not exceed a predetermined magnitude with respect to the positive reference signal to maintain the Darlington circuit 658 conductive to effectively connect the resistor 669 to the ground 608 so that disable signals will not pass the diodes 670, 671 and 672.

Whenever the peak magnitude of the armature current signal negative excursions increase to a predetermined level for one electrical cycle or more, the Darlington circuit 658 will turn "off" or be rendered non-conductive so that positive disable signals will be supplied through the resistor 669 and the diodes 670 and 671 to the disable leads 334 and 336, respectively, to disable the armature gating circuits 7.

A positive disable signal will also be supplied to the lead 673 through the diode 671 whenever the Darlington circuit turns "off". The disable signal on the lead 673 is thus supplied to the sample and hold circuit 656 and rapidly charges the capacitor 677 and further renders the Darlington circuit 675 conductive to provide a short-circuit between the control lead 643 and the system ground 608 to de-energize the emergency landing relay ELX. The contacts ELX-3 thus close to redundantly supply positive disabling signals to the disable leads 334 and 336 as previously described.

The sample and hold circuit 656 provides continued disable signals to the disable leads 334 and 336 for a predetermined period of time after the peak magnitude of the armature current signal has decreased below the predetermined level to insure that the armature current has completely returned to normal levels before again enabling the armature gating circuit 7. Thus after the peak magnitude of the armature current signal has decreased to within the predetermined normal operating level, the Darlington circuit 658 will beome conductive and turn "on" to effectively connect the collector circuit 668 to the ground 608 thereby preventing disable signals from being supplied through the diodes 670 and 671 to the leads 334 and 336, respectively. The Darlington circuit 675, however, remains energized until the voltage stored in the capacitor 677 has discharged to a predetermined level through the resistor 676 and the base-emitter circuit 674 and 680 thereby turning the transistor circuit 675 "off". The de-energization of the Darlington circuit 675 permits the emergency landing relay ELX to become energized to open the contacts ELX-3 thereby removing the disable signals from the leads 334 and 336. The delay in re-enabling the gating circuits 7 provided by the sampled and hold circuit 656 is highly desirable to discourage repetitive and alternating enabling and disabling signals due to the one cycle response capability of the sensing circuit 655 which, in fact, would issue alternate and repetitive enable and disable signals through the diodes 670 and 671 in response to a series of transient armature current spikes.

The field loss detector 42 is connected through a lead 43 to the output lead 24 for receiving a negative polarity signal which is proportional to the field current as sensed at a transformer circuit 476 within the brake and field static power converter 23. It is to be understood, however, that various other devices may be used to sense the field energy rather than the transformer 476 such as using any one of a number of Halleffect devices, magneto-resistive devices or analog output devices responsive to the magnetic field provided by the field energy. Specifically, the lead 43 is connected to a base circuit 682 of a Darlington pair type transistor circuit 683 through a resistor 684. The base circuit 682 is connected to the system ground lead 608 through a diode 685 and to the negative voltage lead 610 through a resistor 686. The base circuit 682 is further connected to the control lead 636 through the serially connected resistors 687 and 688 with the junction circuit 689 coupled to the system ground lead 608 through a capacitor 690. An emitter circuit 691 of the Darlington circuit 683 is coupled to the system ground lead 608 and a collector circuit 692 is connected to the control lead 643 and thus to the emergency landing relay ELX.

In operation, the base circuit 682 of the Darlington circuit 683 sums a number of signals to determine if a proper operating field circuit exists. Specifically, a negative predetermined reference signal is supplied through the resistor 686, a positive predetermined reference signal is supplied through the resistors 640, 641, 687 and 688, and a negative field current signal is supplied through the esistor 684. Whenever the summed negative reference signal and the field current signal combine to be greater than the positive reference signal, the Darlington circuit 683 is rendered non-conductive or turned "off" to permit the emergency landing relay ELX to become energized.

Whenever the field current decreases below or fails to reach a predetermined magnitude with respect to the positive reference signal, the summated signals will turn the Darlington circuit 683 "on" to effectively connect the control lead 643 to the system ground 608 thereby de-energizing the emergency landing relay ELX. Thus, the sensing of insufficient field current is effective to de-energize the relay ELX and close the contacts ELX-3 for supplying disable signals to the leads 334 and 335 thereby transferring the system into an emergency landing mode of operation. Applicant's field loss detector 42 thus effectively determines whether the field energy such as the field current increases to the predetermined magnitude at the initiation of each starting sequence and continues to sense whether the field current remains above the same predetermined magnitude during the entire running sequence including during periods of vehicle acceleration and constant velocity.

The field loss detector 42 is further effective to monitor the build-up of the field current each time the elevator car is initiating a starting sequence. Upon receiving a command to initiate vehicle movement, the energization of the line contactor relay L at line 77 is effective to close a set of associated contacts (not shown) to initiate the supply and buildup of field energy to the field circuit which is sensed through the resistor 684. The energization of the relay L is also effective for supplying energy to the input leads 584 in response to a command to initiate vehicle movement and thus is effective for providing a positive reference signal which increases from a zero signal to a predetermined magnitude and thereafter remains at that predetermined magnitude during a running sequence as sensed by the resistor 688. The field current signal supplied through the resistor 684 must increase at a sufficient rate so that the combined field current signal and the negative reference signal must continuely sum to be greater than a predetermined relationship with respect to the positive reference signal or else the Darlington circuit 683 will turn "on" to de-energize the relay ELX to prevent the car from leaving a landing.

The line voltage drop detector 52, the improper phase sequence detector 53 and the single phase or open circuit detector 54 utilize certain common circuitry including a detector circuit 693 and a sample and hold circuit 694. The positive unfiltered D.C. voltage lead 586 is connected to a base circuit 695 of a Darlington pair type transistor circuit 696 through a resistor 697. The negative voltage lead 610 is connected to the ground lead 608 through a capacitor 698 and to the base circuit 695 through the series connected resistors 699 and 700. A juncture circuit 701 between the resistors 699 and 700 is coupled to the ground lead 608 through a parallel connected capacitor 702 and Zener diode 703. The base circuit 695 is further connected to the system ground lead 608 through a parallel connected capacitor 704 and diode 705. The base circuit 695 is connected to a phase sensing circuit 706 through a lead 707 and a resistor 708.

The phase sequence sensing circuit 706 is constructed in a manner similar to that shown and described in the U.S. Patent to Maynard et al, U.S. Pat. No. 3,551,748, issued on Dec. 29, 1970, but operates in an inverse manner to provide a positive polarity output signal to the lead 707. Specifically, a resistor 709 and a capacitor 710 are series connected through a junction circuit 711 with the resistor 709 connected to the lead 596 through a lead 712 to receive the phase signal $V_{CN}$ while the capacitor 710 is connected to the lead 602 through a lead 713 to receive the phase signal $V_{BN}$. In like manner, a resistor 714 is series connected with a capacitor 715 through a junction circuit 716 with the resistor 714 connected to the lead 713 while the capacitor is coupled to the lead 590 through a lead 717 to receive the phase signal $V_{AN}$. The junction circuit 711 is connected to the cathode circuit of a diode 718 while the junction circuit 716 is connected to the cathode circuit of a diode 719. The anode circuits of the diodes 718 and 719 are mutually connected to a junction circuit 720 which, in turn, is connected to the lead 707 through a resistor 721. The lead 707 is further coupled to the system ground lead 608 through a capacitor 722.

An emitter circuit 723 of the Darlington circuit 696 is coupled to the system ground lead 608 while a collector circuit 724 is connected to the positive voltge lead 605 through a resistor 725. The collector circuit at 724 is further connected to the disabled lead 334 through a diode 726, to the disable lead 336 through a diode 727 and to the brake disable lead 457 through a diode 728. In addition, the collector circuit 724 is connected to the sample and hold circuit 694 through a diode 729 and a lead 730.

The lead 730 coupling the detector circuit 693 with the sample and hold circuit 694 is coupled to the system ground lead 608 by a capacitor 731 and is further connected to a base circuit 732 of a Darlington pair type transistor circuit 733 through a resistor 734. The base circuit 732 is further coupled to the system ground lead 608 through a diode 735 and to the negative voltage lead 610 through a resistor 736. An emitter circuit 737 is coupled to the system ground lead 608 while a collector circuit 738 is connected to the control lead 636 and thus to the emergency relay EX.

In operation, the base circuit 695 in the detector circuit 693, constitutes a summing point for the signals supplied through the resistors 697, 700 and 708. A negative signal is supplied through the resistor 700 from the negative voltage lead 610 for providing a highly regulated and filtered signal to the base circuit 695. A positive signal is supplied through the resistor 697 from the positive unfiltered voltage lead 586 and is generally of a magnitude under desirable normal elevator operation to render the Darlington circuit 696 conductive thereby effectively connecting the collector circuit 724 to the ground lead 608 for permitting the disable leads 334, 336 and 457 to supply enable signals to the armature and brake gating circuits. A decrease in the incoming power supply to a second magnitude indicating a severe brown-out condition, such as at 20% below the normal desired level, which is a greater drop than the first level brown-out condition sensed for transferring the system operation into the reduced speed mode, will provide disable signals to both the armature and brake gating circuits and transfer the system operation into the emergency mode. The second level brown-out condition is sensed by a reduced current flow through the resistor 697 so that the negative signal supplied through the resistor 700 will decrease the potential at the base circuit 695 to render the Darlington circuit 696 non-conductive or turned "off" thereby supplying disable signals to the leads 334, 336 and 457 to disable the armature and brake gating circuits.

If one of the input diodes 587, 591, 594, 597, 600 or 693 fail or should one of the phases of the incoming power supply be lost, the corresponding rectified and unfiltered signal appearing at the lead 586 would disappear thus reducing the current supplied to the base circuit 695 through the resistor 697 to render the Darlington circuit 693 non-conductive for again transferring the system into an emergency mode of operation.

The improper phase sequence detector 706 provides a vectorial summation of the sensed phase signal at the junction circuits 711 and 716 which normally sum to a low negative polarity voltage when the phase sequence is proper thereby permitting only a small amount of current to be conducted from the base circuit 695 through the resistor 708 to allow the Darlington circuit 696 to remain conductive. When an improper phase sequence is directed, the negative voltage at the junction circuits 711 and 716 approximately triples in magnitude thus permitting a larger current to flow from the base circuit 695 through the resistor 708 thereby rendering the Darlington circuit 696 non-conductive or turned "off" to thus supply positive disable signals to the disable lines 334, 336 and 457 to transfer the system into an emergency mode of operation.

The "turning off" or non-conduction of the Darlington circuit 696 further supplies a positive signal to the base circuit 732 of the Darlington circuit 733 which, in turn, becomes conductive to short-circuit the emergency relay EX. The deenergizing or dropping of the relay EX closes the contacts EX-2 to provide redundant disable signals to the leads 334, 336 and 457 and further closes the contacts EX-1, at line 94 in FIG. 3 within the supervisory control 13 to maintain the system in the emergency mode of operation until manually reset as described above. The positive signal supplied through the diode 720 from the detector circuit 693 to the sample and hold circuit 649 quickly charges the capacitor 731 so that the Darlington circuit 733 becomes conductive immediately after the Darlington circuit 696 becomes non-conductive. Should the Darlington circuit 696 momentarily become non-conductive and immediately thereafter become conductive, the Darlington circuit 733 will respond by becoming conductive and continue to conduct for a predetermined period of time after the Darlington circuit 696 becomes conductive due to energy stored in the capacitor 731. The sample and hold circuit 694 thus responds to a sub-cycle electrical abnormal condition occurring within the incoming power supply to maintain the relay EX de-energization for a full electrical cycle to insure that the contacts EX-1 close within the supervisory control circuit 13.

The capacitors 739, 740 and 741 are connected to the disable leads 334, 336 and 457, respectively, and to the ground lead 608 for smoothing any abnormal transients occurring in the disable signals.

OPERATION

Many of the various sequences of operation for the system illustrated in FIGS. 1–14 have already been dicussed while other sequences of operation are readily apparent from the described circuit interconnection and need not be further discussed. Several sequences of the operation will be briefly discussed to help in understanding the operation.

An automatic control for the elevator system is provided by the supervisory control 13 when the manual switches 109 and 140 at line 62 are closed to energize the inspection relay INS which operates to open the contacts INS-2 at line 100 and close the contacts INS-3 at line 101 to permit automatic control of the potential relay PA. In addition, the contacts INS-1 at line 88 close to connect the magnetic leveling switches into the circuit for selective operation while the contacts INS-4 at line 126 close to connect the inspection auxiliary relay ISX and the high speed auxiliary relay HRX in circuit. Lastly, the contacts INS-5 at line 130 open to permit the automatic control of the up and down direction starting relays URX and DRX by the contacts S-2 of the start relay. The closing of switch 109 also connects the power lead 108 to the transformer 57 for supplying energizing power to the across-the-line circuits existing at lines 63 through 98.

As an illustrative example of a normal or customary mode of operation, it is assumed that the car 162 is at rest at the second landing or floor and is assigned to travel to the eighth floor to service a demand thereat as directed by the supervisory control 13. In such event, the contacts SUA-1 at line 63 of the up direction signal relay (not shown) close in response to the car assignment in the up direction thus energizing the start up pilot relay SUP through the closed contacts SDP-1, SUA-1, UC-1 and CA-1. The energizaton of relay SUP opens the contacts SUP-2 at line 66 to maintain the relay SDP de-energized and further closes the contacts SUP-3 at line 72 to energize both the start relay S and the start up relay SU through the closed limit switches 141 and 142. The contacts SU-1 at line 76 close in response to the energization of the start up relay SU to energize the line contactor relay L which operably closes the contacts L2, L3 and L4 at line 110 to connect the power source 5 to the transformer 132 and further supply operating power to other circuits such as the reference transformer 9 by the closure of additional contacts (not shown).

The closure of the contacts L-2, L-3 and L-4 operatively supplies the voltage surces +VDC and −VDC at line 112 to various circuits within the system including those within the over-regulation detector 44 and the over-speed detector 50 as specifically set forth in FIGS. 12 and 13, respectively. The initial application of the voltage sources to the over-speed detector 50 performs a circuit test illustrated at 51 which energizes the relay OSX in FIG. 13 when the circuit is in good working order under a normal mode of operation for opening the contacts OSXA-1 in FIG. 14 through the relay OSXA at line 111 in FIG. 4 to permit the energizaton of the emergency relay EX in FIG. 14. In like manner, the initial application of the voltage sources to the over-regulation detector 44 performs a circuit test illustrated at 46 and the relay OVX in FIG. 12 becomes energized with the circuit in good working order under a normal mode of operation for opening the contacts OVXA-1 in FIG. 14 through the relay OVXA at line 112 in FIG. 4 to permit the energization of the emergency landing relay ELX in FIG. 14.

With the system operating under a normal mode of operation, the field control 27 responds to a command by the supervisory control 13 to initiate the supply of field current from the power converter 23 to the field circuit 3. With the system operating properly, the field current increases at a sufficiently rapid rate as sensed at the field loss detector 42 including the Darlington circuit 683 in FIG. 14 to further permit the energization of the emergency landing relay ELX.

Thus in the absence of sensed malfunctions and with the circuit connected and operating properly, i.e. the connector contacts 649 are fully engaged to complete a circuit, the emergency relay EX and the emergency landing relay ELX become energized when the contactor relay L energizes and the contacts L-2, L-3 and L-4 in FIG. 4 close. The contacts EX-1 at line 94 and ELX-1 at line 95 thus close to energize the emergency auxiliary relay E and the emergency landing first auxiliary relay EL which operate to further de-energize the emergency interlock relay ELA as previously described to provide a normal mode of operation for the elevator system.

The energization of relay EL closes the contacts EL-2 at line 101 so that the closing of the contacts SU-3 energizes the potential relay PA and the up direction relay U as soon as the car and hall doors are closed thus closing the door lock contacts 153.

The energization of the potential relay PA closes the contacts PA-8 at line 113 to energize both the first kill relay K1X and the potential auxiliary relay PAX. The energization of the relay PAX opens the contacts PAX-1 in FIG. 14 so that the diodes 651, 653 and 654 will not supply disabling signals to the disable lines 334, 336 and 457 to thus condition the armature gating circuit 7 and the brake gating circuit 31 for selective operation. The energization of the relay K1X at line 113 opens the contacts K1X-1 in FIG. 9 to condition the regulator 348 and thus the brake modulating control circuit 33 for selective operation.

The contacts PA-4 close at line 80 when the relay PA is energized to energize the dynamic braking auxiliary relay DBA through the closed contacts L-1 which opens the contacts DBA-1 at line 85 to de-energize the dynamic braking relay DB. The contacts DB-1 in FIG. 5 thus open to disconnect the dynamic braking resistor 178 from the armature circuit while the contacts DB-2 at line 82 close to energize the motor armature contactor relay M through the closed contacts ELA-2.

The contacts M-3 and M-4 in FIG. 5 close with relay M energized to connect the static power converter 4 to the armature circuit 2. The contacts M-1 at line 83 open with relay M energized to permit the relay MT to become de-energized after a predetermined period of time when the capacitor 146 has discharged through the resistances 147 and 148. With relay M energized and relay MT de-energized after a time delay, the contacts M-2 and the contacts MT-1 at line 115 close to provide operating power to the across-the-line circuits at lines 116 through 131.

The third, fourth and fifth kill relays K3X, K4X and K5X at lines 116-118, respectively, become energized when the contacts PA-8, M-2 and MT-1 close. The contacts K3X-!, K4X-1, K4X-2 and K5X-1 in FIG. 6 open to operably condition the velocity command and error signal generator 12 for selective operation while the contacts K3X-2 in FIG. 7 open to operably condition the amplifying, compensating and control circuit 11 for selective operation.

With the contacts ELX-2 at line 119 closed along with the closure of the contacts L-2, L-3, L-4, PA-8, M-2 and MT-1 in a normal mode of operation, the emergency landing second auxiliary relay ELAX becomes energized which, in turn, opens the contacts ELAX-1 in FIG. 9 to disconnect the emergency landing mode monitoring circit 379 from effective operating control within the brake modulating control 33. The energized relay ELAX further closes the contacts ELAX-2 and opens the contacts ELAX-3 in FIG. 13 to pre-condition the over-speed detector 50 to sense a first predetermined unsafe speed for a normal mode of operation.

The inspection auxiliary relay ISX at line 126 also becomes energized along with the kill relays K3X, K4X and K5X in an automatic operation because the contacts INS-4 would be closed by the energization of the relay INS at line 62. The contacts ISX-1 open and the contacts ISX-2 close in FIG. 6 to condition the command input circuit 209 of the velocity command and error signal generator 12 to operate in either a normal or reduced speed mode of operation.

The closing of the contacts U-4 at line 121 energizes the up direction auxiliary relay UX which, in turn, closes the contacts UX-1 at line 129 to energize the up direction starting relay URX through the closed contacts S-2 of the start relay S. The contacts URX-1 close and the contacts URX-2 open in FIG. 6 to initiate a velocity command signal generating sequence by the velocity pattern command circuit 182. Specifically, an up direction command signal is supplied to the input lead 210 through the closed contacts DRX-1, URX-1, ISX-2 and the resistors 218 and 219 which provide a reduced speed maximum velocity limitation to the system. The velocity command and error signal generator 12 thus produces a velocity command signal and an error signal at 17 as more fully described in the copending application having Ser. No. 465,270 of C. Young et al entitled "Control System for a Transportaion System" filed on an even date herewith. The error signal at 17 is thus effective for supplying energizing power to the armature circuit 2 in a normal mode of operation through the amplifying, compensating and control circuit 11, the armature gating circuit 7 and the armature regenerative dual bridge static power converter 4.

The contacts PA-5 of the potential relay and the contacts U-1 of the up direction relay at line 86 close to energize the brake relay BK which, in turn, closes the contacts BK-4 and BK-5 in FIG. 5 to connect the brake lifting solenoid circuit 171 to the static power converter 23.

The command signal circuit 340 on the brake modulating control 33 in FIG. 9 is actuated when the contacts L-2, L-3 and L-4 in FIG. 4 close to supply the bias supply +VDC at line 112 to the summing circuit 345. With the contacts BK-4 and BK-5 in FIG. 5 closed, the actuation of the brake modulating control 33 is effective for providing brake lifting power to the brake 28 through the brake gating circuits 31 and the static power converter 23. The elevator system is preferrably designed so that the lifting of the brake shoe 170 occurs at or slightly after energizing power has been supplied to the armature circuit 2 from the static converter 4 to provide a smooth start from the second landing so as to proceed to the eighth landing.

The contacts PA-1 at line 64 also close to provide a seal circuit for the start up pilot relay SUP through the contacts SDP-1, SUP-1 and CA-1 while the closing of the contacts PA-3 provides an alternative energizing path for the line contactor relay L at line 77.

The high speed relay HR at line 81 used when operating with a multiple speed type prime mover is conditioned for energization by the closing of the contacts PA-4. After the car has traveled a predetermined distance from the second landing and before reaching the third landing, the contacts SA-1 close at line 80 to initiate a timing sequence for the relay HR. The relay HR becomes energized after a predetermined time following the closing of the contacts SA-1 which generally occurs at a predetermined location in the vicinity of the slow-down and stopping initiation point for the third floor.

The energization of the relay HR indicates that the car is continuing for a two or more floor run and is effective for transferring the system operation from the one floor running speed to the multiple floor or high running speed. Specifically, the contacts HR-4 at line 127 close to energize the high speed auxiliary relay HRX. The contacts HRX-1 in FIG. 6 thus close with the relay HRX energized to supply a high speed command signal to the input circuit 210 within the velocity command and error signal generator 12.

The car traveling between the second and eighth floor is commanded to initiate a stopping sequence when at a predetermined distance from the eighth floor landing which is sensed by a selector assembly or any other well known position sensor to energize the call recognition relay DO (not shown) within the supervisory control 13. The contacts DO-1 at line 69 in FIG. 2 close with relay DO energized to energize the call recognition relay CA through the closed contacts V-1 in response to the sensed registration demand. The contacts CA-1 at line 66 open with relay CA energized to de-energize the start up pilot relay SUP. The contacts SUP-3 at line 72 thus open to de-energize both the start relay S and the start up relay SU.

The contacts S-2 at line 129 open to de-energize the up direction starting relay URX which, in turn, opens the contacts URX-1 in FIG. 6 to remove the high speed command signal from the input lead 210 to permit the pattern command circuit 182 to generate a decelerating command velocity signal. The contacts SU-3 at line 101 open but the potential relay PA and the up direction relay U remain energized through the seal circuit including the contacts U-2, 4L-3 and E-3. The contacts SU-2 at line 88 close to operatively connect the leveling and releveling magnetic switches 149 into the circuit through the closed contacts SD-2 and INS-1.

The magnetic switch LUA closes when the car decelerates to a position at 20 inches from the eighth floor landing and energizes the up leveling zone relay LU and the leveling relay LUD. The contacts Lu-3 at line 120 open to de-energize the high speed leveling relay LVX which, in turn, allows the contacts LVX-2 to close and the contacts LVX-1 to open in FIG. 6 for transferring the effective control from the velocity pattern command circuit 182 to the leveling and releveling pattern command circuit 184 within the velocity command and error signal generator 12.

The velocity pattern command circuit 182 could, if desired, be permanently connected to the summing circuit 183 to operatively decelerate and stop the car 162 at a landing for safe passenger transfer thus eliminating the need for the leveling pattern command circuit 184. The preferred embodiment, however, utilizes the novel leveling pattern command circuit 184 in accordance with the requirements of some building codes to provide incremental control in bringing the elevator car to a stop adjacent to the eighth floor landing. The second, third and fourth zone leveling relays 2L, 3L and 4L, respectively, become sequentially energized as the car approaches the eighth floor to correspondingly de-energize the auxiliary relays 2LX, 3LX and 4LX, respectively, at lines 123-125. The contacts 2LX-1, 3LX-1 and 4LX in FIG. 6 thus sequentially open as the car moves to the eighth floor landing to provide the desired and novel pattern command to the summing circuit 183 to correspondingly control the energization of the armature circuit 2 by the error signal supplied on lead 17.

The energization of the second zone leveling relay 2L as the car reaches to within 10 inches of the eighth floor landing closes the contacts 2L-1 at line 105 to provide continued energization of the relays PA and U through the circuit including the closed contacts EL-3, 2L-1, LD-1, Lu-1 and D-2. The energization of the fourth zone leveling relay 4L as the car reaches to within 2½ inches of the eighth floor landing opens the contacts 4L-3 at line 102 to open the seal circuit for the relays U and PA.

As the car stops exactly adjacent to the eighth floor landing, the up and down leveling zone relays LU and LD both become de-energized while the second, third and fourth zone leveling relays 2L, 3L and 4L remain energized. The contacts Lu-1 thus open to immediately de-energize the up direction relay U while the potential relay PA remains energized for a predetermined time until the charge stored by the capacitor 159 discharges through the resistor 160, the closed contacts ELA-5 and the relay PA.

The contacts predetermined at line 86 open to de-energize the brake relay BK which, in turn, opens the contacts BK-4 and Bk-5 in FIG. 5 to immediately de-energize the brake solenoid circuit 171 to set the brake 28. The contacts U-4 at line 121 also open to de-energize the relay UX which, in turn, opens the contacts UX-1 at line 129 to reset the circuit and further opens the contacts UX-2 and UX-3 in FIG. 6 to reset the circuit and further to operatively disconnect the leveling rescue command circuit 221 from effective operation.

After a predetermined period of time after the relay U has de-energized as determined by the discharge time constant of the capacitor 159, the potential relay PA de-energizes. The contacts PA-4 at line 80 open to de-energize the motor armature contactor relay M which, in turn, opens the contacts M-3 and M-4 in FIG. 5 to disconnect the static power converter 4 from the D.C. motor 1. The contacts PA-8 at line 113 and the contacts M-2 at line 115 open to de-energize the circuits within the lines 113 through 131. The kill relays K1X, K3X, K4X and K5X become de-energized to reset certain circuits as previously described within the brake modulating control 33, the velocity command and error signal generator 12 and the amplifying compensating and control circuit 11. The de-energization of the potential auxiliary relay PAX at line 114 closes the contacts PAX-1 in FIG. 14 so that the circuit is placed in a condition for supplying disable signals to the armature disable leads 334 and 336 and to the brake disable lead 457. The contacts PA-3 also open to de-energize the line contactor relay L at line 77 which, in turn, opens its associated contacts including the contacts L-2, L-3 and L-4 at line 110 to remove all power from the circuits in FIG. 4 and further to remove all power from the circuits within FIGS. 5 through 14.

The contacts L-1 at line 84 and the contacts PA-4 at line 80 thus are both open to de-energize the relay DBA which, in turn, closes the contacts DBA-1 at line 85 to energize the dynamic braking relay DB. The contacts DB-1 in FIG. 5 thus close with the relay DB energized to parallel connect the dynamic braking resistor 178 with the armature circuit 2 for dissipating any energy stored therein.

While the circuits illustrated in FIGS. 4 through 14 are disconnected from operating power when the car 162 has stopped at a landing, a portion of the supervisory control 13 such as shown in FIGS. 2 and 3 remains operatively connected to a power source through the transformer 57 and remain in condition to again respond to any service demand to initiate a car assignment requiring travel in either direction in a manner as above described.

A car assignement for only a one floor run, such as travel from the eighth floor to the seventh floor, for example, will not permit the energization of the high speed relay HR at line 81. In such a situation, the contacts FC-2 of the final call relay open before the relay HR has an opportunity to time for energization so that the high speed auxiliary relay HRX at line 127 remains de-energized. The contacts HRX-1 in FIG. 6 thus remain open so that a reduced speed command signal is supplied to the input lead 210 through the lead 217 for imposing a reduced speed maximum velocity limitation to the velocity pattern command which controls the energization of the D.C. motor 1. The stopping sequence for a one floor run is similar to the stopping sequence for a multiple floor run.

The reduced speed mode of operation is diagrammatically depicted at 38 in FIG. 1 and operates in response to a decrease in the incoming line voltage of a first magnitude or level to automatically transfer the operation of the system to function under a reduced speed limitation to permit continued safe operation at the lower speed until stopping at a landing. The reduction in the speed requirements for the system under a first level brown-out condition thus reduces the counter-electromotive force experienced by the motor 1 to prevent the blowing of fuses, such as by a short-circuit condition within the static power converter 4 caused by the failure of thyristors to be commutated off (known as "shoot-thru"), so that the system can continue operation. Such operation is extremely desirable for providing continued operation when using a static power converter to energize a D.C. motor. As previously discussed, the under voltage relay UV at line 60 remains energized during a normal mode of operation and de-energizes or drops in response to a decrease of incoming power of a first level or magnitude. The contacts UV-3 at line 80 open with the relay UV de-energized to de-energize or prevent the energization of the high speed relay HR even though the car is proceeding on a multiple floor run. The contacts HR-4 at line 127 open or remain open to de-energize the high speed auxiliary relay HRX which, in turn, opens or maintains the contacts HRX-1 in FIG. 6 open to operate the system under a reduced speed limitation until the car 162 has stopped at a landing and the incoming power has returned to the normal and safe operating level for multiple floor high speed operation.

The system may transfer from the reduced speed mode of operation to the normal mode of operation after the power has returned to the normal operating level by stopping at a landing and resetting the under voltage relay UV by the closing of the contacts BK-1 at line 59 when setting the brake 28 to permit the energization of the relay UV. If the power continues to remain at a first level brown-out condition, the car is permitted to depart from a landing under a reduced speed mode of operation and continue service to the plurality of landings under a safe reduced speed maximum velocity limitation. Such a reduction in speed reduces the energy requirements of the static power converter 4 and permits the rectifiers therein to be commutated off even though there has been a reduction in the source energy.

The use of the under voltage auxiliary relay UVA at line 75 together with its associated contacts UVA-2 at line 128 and UVA-3 at line 131 provides a desirable reduced speed mode of operation when using a single speed type motive unit. The relay HR is thus eliminated and the contacts UVA-2 replace the contacts HR-4 and effectively control the operation of the relay HRX to selectively transfer the system operation between the normal mode of operation and the reduced speed mode of operation.

The use of the contacts UVA-3 at line 131 in circuit with the relays URX and DRX provides a highly novel operation by transferring the required elevator car stopping distance from one predetermined stopping distance to a shorter or lesser predetermined stopping distance in response to a change from the normal mode of operation to the reduced speed mode of operation. The shorter predetermined stopping distance is provided through the use of the contacts LUD-2 at line 131 to initiate a decelerating and stopping sequence at 20 inches from a landing as provided by the leveling pattern command circuit 184.

The various circuits which sense the several malfunctions for transferring the system operation to either the emergency landing mode or the emergency mode have been discussed in detail and further detailed discussion thereof is deemed unnecessary. As an example, the over-current fault detector 40 including the armature current sensing circuit 655 in FIG. 14 is effective for sensing a malfunction and directly supplying disable signals to the armature gating disable leads 334 and 336 through the diodes 670 and 671 and further operates through the sample and hold circuit 656 to de-energize the emergency landing relay ELX for operation in the emergency landing mode of operation. The contacts ELX-3 close with the relay ELX de-energized to further redundantly supply disable signals to the disable leads 334 and 336.

The field loss detector 42 including the transistor circuit 683 is effective for sensing a malfunction and de-energizing the emergency landing relay ELX which, in turn, closes the contacts ELX-3 for supplying disable signals to the disable leads 334 and 336 for operation in the emergency landing mode of operation.

The over-regulation detector 44 in FIG. 12 and the over-regulation detector circuit test 46 are effective for sensing a malfunction and de-energizing the over-regulation fault relay OVX to de-energize the over-regulation fault auxiliary relay OVXA at line 112 in FIG. 4. The contacts OVXA-1 in FIG. 14 close with the relay OVXA de-energized to de-energize the emergency landing relay ELX which closes the contacts ELX-3 for supplying disable signals to the disable leads 334 and 336 for operation in the emergency landing mode of operation. The over-regulation detector 44 remains effective to sense an excessive error signal during a normal mode of operation which includes multiple floor high speed runs, a single floor low speed run, and leveling and releveling as well as during a reduced speed mode of operation, an inspection speed operation and a creeping speed operation.

It is thus apparent that the transfer of the system, into the emergency landing mode as depicted at 39 in FIG. 1 is effective for supplying disabling signals to the armature gating circuit 7 as depicted at 47.

The de-energization of the relay ELX in FIG. 14 opens the contacts ELX-1 at line 95 in FIG. 3 to de-energize the emergency landing first auxiliary relay EL which, in turn, closes the contacts EL-1 at line 97 to energize the emergency interlock relay ELA through the closed contacts PA-7 and the closed switch SAF-1. The contacts ELA-3 at line 95 open with the relay ELA energized to maintain the relay EL de-energized while the contacts ELA-4 at line 98 close to maintain the relay ELA continuously energized.

The potential relay PA and the appropriate direction relays U or D remain energized in the emergency landing mode through the closed contacts E-3 at line 102 while the contacts El-2 at line 101 and El-3 at line 105 open. Thus the potential relay PA is energized by only one circuit including the closed door contacts 153, the closed contacts INS-3, E-3, 4L-3 and U-2 if the car had been previously traveling in the up direction, limit switch 154, contacts D-2, the relay U and the diode 155.

The contacts ELA-2 at line 82 open with the relay ELA energized to de-energize the motor armature contactor relay which, in turn, opens the contacts M-3 and M-4 in FIG. 5 to disconnect the D.C. motor 1 from the static power converter 4. The contacts M-1 at line 83 thus close to energize the relay MT through the closed contacts PA-4 which, in turn, opens the contacts MT-1 at line 115. The contacts M-2 at line 115 also open so that the circuitry within lines 116 through 131 is redundantly de-energized. The kill relays K3X, K4X and K5X are de-energized to render the velocity command and error signal generator 12 and the amplifying, compensating and control circuit 11 inoperative. The up and down direction auxiliary relays UX and DX together with the up and down direction starting relays URX and DRX are further de-energized to remove all command from the velocity command and error signal generator 12.

The contacts ELX-2 at line 119 open with the emergency landing relay de-energized to redundantly de-energize the emergency landing second auxiliary relay ELAX along with the opening of the contacts M-2 and MT-1. The contacts ELAX-1 in FIG. 9 thus close to connect the emergency landing mode monitoring circuit 379 into effective operation within the brake modulating control 33. The contacts PA-8 at line 113 remain closed with the potential relay PA being energized through the contacts E-3 at line 102 so that the first kill relay KlX and the potential auxiliary relay PAX remain energized. The contacts KlX-1 in FIG. 9 thus remain open for permitting the brake modulating control 33 to provide continued operative control over the brake 28. The contacts PAX-1 in FIG. 14 also remain open so as not to provide a disable signal to the brake gating circuits 31 through the disable lead 457. The biasing sources +VDC and −VDC at line 112 thus continue to be provided to the various circuits so that the command signal circuit 340 remains operatively connected to provide a brake lifting command signal to the summing circuit 345 within the brake modulating control 33.

With the up or down direction relays U or D and the potential relay PA at line 101 energized during the emergency landing mode of operation, the brake relay BK at line 86 remains energized to maintain the contacts BK-4 and BK-5 closed so that the brake solenoid circuit 171 remains connected to the static converter 23.

The brake modulating control 33 is thus effective through the brake gating circuits 31 and the static power converter 23 to selectively set and lift the brake 28 and to supply a variable braking force while the brake 28 is set. Under the emergency landing mode of operation, the brake 28 is set to decelerate the car 162 until the car speed decreases below a first predetermined speed at which the brake is lifted to permit the car to move in either direction according to the established car momentum or the gravity influences acting on the car 162 and the counter-weight 166.

The automatic transfer of the system into an emergency landing mode of operation in response to a sensed malfunction is effective for disconnecting the motor armature circuit 2 from the static power converter 4, disabling and rendering ineffective the armature gating circuit 7 and disabling and rendering ineffective the velocity command and error signal generator 12 and the amplifying, compensating and control circuit 11. At the same time, the brake modulating control 33, the brake gating circuits 31 and the brake and field static power converter 23 remain in effective operation while the brake solenoid circuit 171 remains connected to the static converter 23 and the emergency landing mode monitoring circuit 379 is connected into effective circuit operation within the brake modulating control 33.

When operating within the emergency landing mode, the car 162 is thus permitted to move unrestrained toward an adjacent landing as long as the car remains at or under the first predetermined speed. Should the car speed increase above the first predetermined speed, the brake 28 will set until decelerating to a speed at or below the first predetermined speed whereat the brake 28 lifts to permit continued unrestrained movement.

The brake modulating control circuit 33 further provides a very desirable safety feature by transferring the brake setting speed in the emergency landing mode from the first predetermined speed, such as fifteen feet per minute, to a second predetermined speed, such as thirty feet per minute, in the event that the tachometer signal $V_T$ becomes disconnected from effective operation or otherwise lost. The loss of the armature voltage input signal $\pm V_A$ at lead 35 in FIG. 9 during the emergency landing mode would also modify the operation of the brake modulating circuit 33 to be responsive to the second predetermined speed to selectively set and lift the brake. The continued presence of the speed signal $V_T$, however, would be effective to operate the overspeed detector 50 should the car speed exceed the emergency landing mode first predetermined speed by a predetermined amount, such as 107 ½% of 15 feet per minute, for example, to transfer the system operation into the emergency mode. In addition, the loss of the armature voltage signal $\pm V_A$ might be caused by conditions sufficient to actuate the line voltage drop detector 52, the improper phase sequence detector 53 or the single phase or open phase circuit detector 54 to likewise transfer the system operation into the emergency mode.

A car located between landings is thus permitted to travel to an adjacent landing under the emergency landing mode of operation. The contacts ELA-1 at line 67 close with the emergency interlock relay ELA energized to energize the call recognition auxiliary relay CA through the closed contacts PA-2 to simulate a demand for service. The contact CA-1 at line 66 open with the relay CA energized to de-energize both the start up and start down pilot relays SUP and SDP which, in turn, open the corresponding contacts SUP-3 and SDP-3 at lines 72 and 73 to de-energize both the start up and start down relays SU and SD. The contacts SU-2 and SD-2 thus close with the relays SU and SD de-energized to electrically connect the magnetic leveling switches 149 into effective circuit operation for sequential energization through the closed contacts INS-1. As the car approaches to within 2 ½ inches of an adjacent landing under the speed limitations imposed by the brake modulating control circuit 33, the fourth zone leveling relay 4L at line 92 will become energized. The contacts 4L-3 at line 102 will thus open to immediately de-energize both the up and down direction relays U and D. The contacts ELA-5 at line 100 open with the emergency interlock relay ELA energized to immediately de-energize the potential relay PA with the contacts 4L-3 open. An alternative or additional sequence could utilize the door contacts 153 to supplement the 4L-3 contacts in similarly de-energizing the relay PA.

The de-energization of the relays U, D and PA will thus open the contacts U-1, D-1 and PA-5 at lines 86 and 87 to de-energize the brake relay BK which, in turn, opens the contacts BK-4 and BK-5 in FIG. 5 to disconnect the brake solenoid circuit 171 from the static power converter 23 and set the brake 28.

The contacts PA-4 at line 80 open to de-energize the relay DBA which, in turn, closes the contacts DBA-1 at line 85 to energize the dynamic braking relay DB. The contacts DB-1 in FIG. 5 thus close simultaneously with the stopping of the car with the relay DB energized to dissipate any stored energy which may exist within the armature circuit 2 for added safety thereby removing the customary delay time.

The contacts PA-8 at line 113 open with the relay PA de-energized to de-energize the first kill relay KIX and the potential auxiliary relay PAX. The contacts KIX-1 in FIG. 9 thus close to render the brake modulating control circuit 33 inoperative while the contacts PAX-1 in FIG. 14 close to be in a condition to supply a disable signal to the disable lead 457 for rendering the brake gating circuits 31 inoperative.

The line contactor L at line 77 may or may not be de-energized depending upon the condition of the contacts LUD-1 of the leveling relay LUD. If the car 162 stops adjacent to a landing at the termination of the emergency landing mode, the relay LUD at line 88 is de-energized to open the contacts LUD-1 to de-energized the relay L which operates to remove all power from the circuits illustrated in FIGS. 4 through 14. If the car 162 stops at a distance up to 2 ½ inches from the landing at the termination of the emergency landing mode, the relay LUD at line 88 will remain energized to provide continued energization for the relay L at line 77 through the contacts LUD-1. With the relay L energized, the contacts L-1, L-2 and L-3 at line 110 will remain closed so that power will be supplied to the inoperative circuits such as through the bias sources +VDC and −VDC at line 112 until the car is moved to a position adjacent to a landing to thereby de-energize the relay LUD.

It further should be noted that the elevator car will be immediately stopped if the system is transferring into the emergency landing mode of operation while at or within 2 ½ inches on either side of a landing. In such a situation, the contacts EL-2 at line 101 and EL-3 at line 105 open when transferring to the emergency landing mode while the relay CA at line 68 is energized through the closed contacts ELA-1 and PA-2 as previously described. With the car at or within 2 ½ inches from a landing, the fourth zone relay 4L at line 92 is energized in response to the energization of the relay CA as previously described to thereby open the contacts 4L-3 at line 102 to immediately de-energize the relays U or D. The potential relay PA also immediately de-energizes because the contacts ELA-5 at line 100 are open to thereby set the brake by de-engizing the relay BK at line 86.

The occurrence of certain malfunctions while the car is at or near a landing is thus effective for operating the emergency landing mode circuits and also preventing further movement of the car.

The elevator car 162 remains at a landing during or following an emergency landing mode operation until the emergency interlock relay ELA is reset or de-energized by the manual opening of the switch FAS-1 which correspondingly operates switch FAS-2 at line 97 to ensure that the potential relay PA remains de-energized. The contacts ELA-3 at line 95 thus close with the relay ELA de-energized to permit the energization of the emergency landing first auxiliary relay EL provided a malfunction does not exist within the system. The subsequent energization of the relay EL along with the de-energization of the relay ELA resets the circuits for transferring the system to either a normal mode of operation or a reduced speed mode of operation to permit continued travel from the landing.

The system further operates to transfer from either the normal mode of operation, the reduced speed mode of operation, or the emergency landing mode of operation to an emergency mode of operation as depicted at 48 FIG. 1 in response to certain malfunctions sensed within the system to stop the car as soon as possible and prevent further movement thereof.

As an example, the line voltage drop detector (second level) 52, the improper phase sequence detector 53 and the single phase or open circuit detector 54 employ certain circuitry in FIG. 14 for sensing malfunctions including the detector circuit 693 for directly supplying disable signals to the armature gating disable leads 334 and 336 through the diodes 726 and 727 and to the brake gating disable lead 457 through the diode 728 and further operate through the sample and hold circuit 694 to de-energize the emergency relay EX for operation in the emergency mode of operation. The contacts EX-2 close with the relay EX de-energized to further redundantly supply disable signals to the disable leads 334, 336 and 457.

The over-temperature detector 49 controls the switch contacts 648 and the circuit connector detector 55 controls the connector contacts 649 in FIG. 14 which are effective for sensing a malfunction and de-energizing the emergency relay EX to close the contacts EX-2 for supplying disable signals to the disable leads 334, 336 and 457 for operation in the emergency mode of operation.

The over-speed detector 50 in FIG. 13 and the over-speed detector circuit test 51 are effective for sensing a malfunction and de-energizing the over-speed fault relay OSX to de-energize the over-speed fault auxiliary relay OSXA at line 111 in FIG. 4. The contacts OSXA-1 in FIG. 14 close with the relay OSXA de-energized to correspondingly de-energize the emergency relay EX which closes the contacts EX-2 to supply disable signals to the disable leads 334, 336 and 457 for operation in the emergency mode of operation.

The over-speed detector 50 in FIG. 13 operates to selectively monitor a plurality of predetermined over-speed levels according to the operating mode of the system. Specifically, the contacts ELAX-2 in FIG. 13 close to sense a first predetermined over-speed condition in a normal mode of operation while the contacts ELAX-3 close to sense a second predetermined over-speed condition in an emergency landing mode of operation.

The contacts EX-1 at line 94 open with the emergency relay EX de-energized to de-energize the emergency auxiliary relay E. The contacts E-1 at line 95 open to correspondingly de-energize the emergency landing first auxiliary relay EL while the contacts EL-1 and E-2 both close to redundantly energize the emergency interlock relay ELA at line 97 through the closed contacts PA-7 and the closed switch SAF-1. The contacts ELA-3 at line 95 thus open with the relay ELA energized to maintain the relay EL de-energized and the relay ELA energized.

The contacts EL-2 at line 101 and EL-3 at line 105 both open with the relay EL de-energized while the contacts E-3 open with the relay E de-energized to immediately de-energize the potential relay PA with the contacts ELA-5 open. The contacts PA-4 at line 80 open with the relay PA de-energized to de-energize the motor armature contactor relay M which, in turn, opens the contacts M-3 and M-4 to disconnect the D.C. motor 1 from the static power converter 4. The relay DBA at line 84 also de-energizes with the contacts PA-4 open to energize the dynamic braking relay DB at line 85 through the closed contacts DBA-1. The contacts DB-1 in FIG. 5 thus close with the relay DB energized to connect the dynamic braking resistor 178 to the armature circuit to dynamically brake the elevator car 162. It should be noted that energy is supplied to the field circuit 3 while the system operates in an emergency landing mode which does not provide a driving force to the motor 1 but is available for interaction with the dynamic braking resistor 178 when the system transfers into an emergency mode to quickly stop the car. In addition, the contacts PA-5 and the contacts U-1 and D-1 open to de-energize the brake relay BK at line 86 which, in turn, opens the contacts BK-4 and BK-5 in FIG. 5 to disconnect the brake solenoid circuit from the static power converter 23 to redundantly deenergize and thus set the brake 28. The remaining circuits are de-activated in a manner as previously described with the relays EL, U, D, and PA de-energized and the relay ELA energized.

The elevator car 162 is thus quickly and continuously decelerated by the set brake 28 and the dynamic braking circuit 178 until coming to a complete stop anywhere in the shaft after transferring into an emergency mode of operation. The car remains stopped at the stalled location within the shaft until the emergency mode malfunction has been corrected and the circuit reset by the manual opening of the switch SAF-1 at line 97 in a similar manner as previously described for the resetting of the emergency landing mode of operation.

The system further provides a desirable safety feature during a leveling or releveling sequence as the car approaches a landing at which a stop is to be made when operating in either a normal mode of operation or a reduced speed mode of operation as depicted by the improper vehicle movement while leveling detector 56 in FIG. 1. As the car 162 approaches a landing to stop, the magnetic leveling switches 149 are connected in circuit through the closed contacts SU-2, SD-2 and INS-1. The third zone leveling relay 3L at line 91 becomes energized as the car approaches to within 5 inches of the landing so that the contacts 3L-1 at line 96 close to provide an energizing path for the emergency landing first auxiliary relay EL. As the car approaches to within 2 ½ inches of the landing, the fourth zone leveling relay 4L at line 92 becomes energized to close contacts 4L-1 at line 93 to provide for the continued energization of the relay 4L through the closed contacts PA-6. The contacts 4L-2 at line 95 open and remain in an opened condition once the car has traveled to within 2 ½ inches of the landing by the continued energization of the relay 4L.

In an abnormal operation when the car travels beyond 5 inches from the landing after once being within 2 ½ inches in attempting to stop thereat, the third zone leveling relay 3L will de-energize and open the contacts 3L-1 to de-energize the emergency landing first auxiliary relay EL. The contacts EL-2 at line 101 and the contacts EL-3 at line 105 open with the relay EL de-energized while the contacts 4L-3 at line 102 were previously opened and held in an opened condition by the initial energization of the relay 4L to thereby de-energize up and down direction relays U and D. The emergency interlock relay ELA at line 97 is energized through the closed contacts PA-7 and EL-1 so that the contacts ELA-5 open at line 100 to immediately de-energize the potential relay PA.

With both of the contacts 3L-1 and 4L-2 open, the elevator car is immediately stopped and de-activated as previously described with the relays EL, U, D and PA de-energized and the relay ELA energized. Needless to say the contacts PA-4 at line 80 open to de-energize the motor armature contactor relay M to disconnect the D.C. motor 1 from the static power converter 4 while the contacts PA-5 at line 86 open to de-energize the brake relay BK to disconnect the brake solenoid circuit 171 from the static power converter 23 to set the brake 28 and stop the car from further movement.

The sequence provided by the operation of the contacts 3L-1 and 4L-2 to de-energize the relay EL in response to the car approaching to within a first predetermined distance of a landing at which a stop is to be made and thereafter proceeding to a second greater predetermined distance from the landing insures an extremely safe operation by transferring the system into an emergency mode of operation.

The over-speed governor switch GOV-1 at line 94 and the safety clamp switch 152 at line 98 have been customarily employed with elevator systems and provide highly desirable back-up safety features for use with the over-speed detector 50. In practice, applicant has selected and adjusted the circuit components so that the over-speed detector 50 including the relay OSX in FIG. 13 will operate to indicate a malfunction whenever the car speed exceeds approximately 107 ½ percent of the preferred desirable velocity or speed for the intended operation. The governor switch GOV-1, on the other hand, preferably operates to open its contacts whenever the car speed exceeds approximately 110 per cent of the rated maximum velocity or speed for the system while the safety clamp switch 152 opens its contacts whenever the car speed exceeds approximately 115% of the rated maximum velocity or speed for the system. The present system thus provides desirable multiple back-up over-speed monitoring sequences which become effective should the tachometer 16 fail to properly operate or the lead 15 ever becomes disconnected.

The opening of the governor switch contacts GOV-1 or the safety clamp switch 152 will de-energize the up or down direction relays U and D and the potential relay PA at line 101. The contacts PA-5 at line 86 open to de-energize the brake relay BK and set the brake 28 while the contacts PA-4 at line 80 open to de-energize the motor armature contactor relay M for disconnecting the armature circuit 2 from the static power converter 4. Various other circuits are de-activated as previously described with the relays U, D and PA de-energized to stop the elevator car at any location within the system.

The present invention thus provides a multiplicity of safety features and sequences of operation, many of which sense various malfunctions. Many of the safety features and sequences of operation are effective when sensing certain malfunctions to transfer the system into a desirable and safe mode of operation. A very desirable elevator system is provide with many redundant safety features and is capable of transferring passengers between a plurality of landings with a high degree of safety.

Portions of the disclosure herein are more fully described in the copending applications filed on an even date herewith of Young et al having Serial No. 465,270 entitled "CONTROL SYSTEM FOR A TRANSPORTATION SYSTEM" and Maynard et at having Ser. No. 465,270 entitled "TRANSPORTATION SYSTEM WITH DECELERATING CONTROL" and such applications are incorporated by reference herein.

Various modes of carrying out the invention are contemplated as being within the scope of the following claims particularly pointing out and distinctly claiming the subject matter which is regarded as the invention.

I claim:

1. A transportation system for a structure having a plurality of spaced landings comprising a transport vehicle, means mounting said vehicle for movement relative to said structure in a path extending adjacent each of said landings, motive means moving said vehicle relative to the structure, braking means selectively permitting vehicle movement and retarding movement and retaining said vehicle in a stopped position with respect to said structure, control means connected to a source of energy and cooperating with said motive means and said braking means and controlling movement of said vehicle relative to the structure and stopping said vehicle at a selected landing, said control means having a plurality of modes of operation controlling the movement of said vehicle, means monitoring one or more malfunctions within said transportation system, and transfer means responsive to the functioning of said monitoring means and transferring said control means from one of said modes of operation to another of said modes of operation, said plurality of modes including a first mode of operation operating said vehicle and providing normal service between a plurality of landings and a second mode of operation established in response to a malfunction sensed within said transportation system rendering said motive means essentially inoperative for supplying a driving force to said vehicle and automatically operating said braking means as essentially the sole control for guiding said transport vehicle to one of said landings.

2. The transportation system of claim 1, wherein said control means includes first sequence means operatively coupled to said braking means and permitting vehicle movement from one of said landings and second sequence means operatively coupled to said braking means and permitting vehicle movement until arriving at a first position adjacent to a landing at which a stop is to be made, said transfer means operatively removing said first sequence means from effective operation in response to said sensed malfunction.

3. The transportation system of claim 2, wherein said control means includes third sequence means operatively coupled to said braking means in response to said vehicle arriving at a second position with respect to said landing at which said stop is to be made and permitting vehicle movement, said transfer means operatively removing said third sequence means from effective operation in response to said sensed malfunction.

4. The transportation system of claim 1, wherein said control means includes first sequence means operatively coupled to said braking means and permitting vehicle movement until arriving at a first position with respect to a landing at which a stop is to be made and second sequence means operatively coupled to said braking means in response to said vehicle arriving at a second position with respect to said landing at which a stop is to be made and permitting vehicle movement, said transfer means operatively removing said second sequence means from effective operation in response to said sensed malfunction.

5. The transportation system of claim 1, wherein said control means includes sequence means operatively coupled to said braking means and permitting vehicle movement from one of said landings, said transfer means operatively removing said sequence means from effective operation in response to said sensed malfunction.

6. The transportation system of claim 1, wherein said control means includes sequence means operatively coupled to said braking means in response to said vehicle arriving at a first position with respect to said landing at which a stop is to be made and permitting vehicle movement, said transfer means operatively removing said sequence means from effective operation in response to said sensed malfunction.

7. The transportation system of claim 1, wherein said motive means includes an energy dissipating circuit selectively coupled to an armature circuit, said control means includes sequence means operatively coupled to said transfer means and to said dissipating circuit and maintaining said dissipating circuit disconnected from said armature circuit until said vehicle at least arrives at a first position adjacent to said landing at which a stop is to be made in response to said sensed malfunction.

8. The transportation system of claim 1, wherein said motive means includes an energy dissipating circuit selectively coupled to an armature circuit, said control means includes timing means operatively coupled to said dissipating circuit and selectively connecting said dissipating circuit to said armature circuit at a predetermined time after said vehicle has stopped at a landing, said transfer means operatively coupled to said timing means and conditioning said control means to connect said dissipating circuit to said armature circuit substantially at the time said vehicle is stopped at said landing in response to said sensed malfunction.

9. The transportation system of claim 1, wherein said transfer means includes first circuit means rendering said motive means inoperative for supplying a driving force to said vehicle independent of said braking means in response to said sensed malfunction.

10. The transportation system of claim 1, wherein said control means includes a gated rectifying circuit connected to said source and to a gating control circuit and selectively conducting varying amounts of electrical energy between said source and said motive means, said transfer means including a disabling circuit connected to said gating control circuit and conditioning said gated rectifying circuit to terminate the supply of energy between said source and said motive means when operating under said second mode of operation.

11. The transportation system of claim 10, wherein said gating control circuit includes a switching circuit operable between a first and a second condition and selectively supplying a control signal to said gated rectifying circuit and controlling the conduction of electrical energy between said source and said motive means, said disabling circuit supplying a disable signal and transferring said switching circuit from said first condition to said second condition in response to said sensed malfunction and terminating the condition of energy between said source and said motive means.

12. The transportation system of claim 10, wherin said control means includes a coupling circuit connected to said gated rectifying circuit and said motive means and selectively connecting said rectifying circuit to said motive means, said transfer means including a second disabling circuit operatively connected to said coupling circuit and disconnecting said gated rectifying circuit from said motive means in response to said sensed malfunction.

13. The transportation system of claim 1, wherein said control means includes a gated rectifying circuit connected to said source and selectively connected to said motive means by a coupling circuit, said transfer means including a disabling circuit connected to said coupling circuit and disconnecting said gated rectifying circuit from said motive means in response to said sensed malfunction.

14. The transportation system of claim 1, wherein said control means includes a pattern circuit generating a command signal operatively controlling the condition of energy between said source and said motive means for commanding movement of said vehicle, said transfer means operatively rendering said pattern circuit ineffective to control the conduction of energy between said source and said motive means in response to said sensed malfunction.

15. The transportation system of claim 14, wherein said pattern circuit includes a command circuit selectively supplying a run signal and a stop signal, said transfer means operatively conditioning said command circuit to provide said stop signal in response to said sensed malfunction.

16. The transportation system of claim 14, wherein said pattern circuit includes means providing a signal to establish the maximum velocity limitation for said vehicle, said transfer means operatively conditioning said circuit means to provide a zero maximum velocity limitation in response to said sensed malfunction.

17. The transportation system of claim 14, wherein said pattern circuit includes an integrating amplifier operatively generating said command signal, said transfer means operatively rendering said amplifier ineffective for generating said command signal in response to said sensed malfunction.

18. The transportation system of claim 17, wherein said integrating amplifier provides an output signal commanding a predetermined velocity by said vehicle.

19. The transportation system of claim 17, wherein said integrating amplifier provides an output signal commanding a predetermined acceleration by said vehicle.

20. The transportation system of claim 14, wherein said control means includes an error circuit connected to said pattern circuit through a connector circuit and receiving said command signal and operatively connected to vehicle responsive means and receiving a signal proportional to vehicle movement and providing an error signal operatively controlling the conduction of energy between said source and said motive means and controlling the movement of said vehicle, said transfer means operatively coupled to said connector circuit and disconnecting said pattern circuit from said error circuit in response to said sensed malfunction.

21. The transportation system of claim 14, wherein said control means includes first and second sequence means each rendering said pattern circuit ineffective.

22. The transportation system of claim 14, wherein said pattern circuit includes a leveling circuit operatively providing a leveling command signal and controlling the conduction of energy between said source and said motive means and commanding movement in response to said vehicle approaching one of said landings at which a stop is to be made, said transfer means operatively rendering said leveling circuit ineffective to control the conduction of energy between said source and said motive means in response to said sensed malfunction.

23. The transportation system of claim 22, wherein said leveling circuit includes an integrating amplifier operatively generating said leveling command signal, said transfer means operatively rendering said amplifier ineffective to generate said leveling command signal in response to said sensed malfunction.

24. The transportation system of claim 22, wherein said control circuit includes means sensing the position of said vehicle, and said leveling circuit includes a modifying circuit operatively coupled to said position sensing means and varying said leveling command signal in response to the varying sensed location of said vehicle with respect to said landing, said transfer means operatively disconnecting said position sensing means from said modifying circuit in response to said sensed malfunction.

25. The transportation system of claim 22, wherein said leveling circuit includes circuit means providing a control signal to establish a maximum velocity limitation for said vehicle, said transfer means operatively removing said control signal from effective operation in response to said sensed malfunction.

26. The transportation system of claim 22, wherein said leveling circuit includes means selectively providing a releveling control signal to guide said vehicle to said landing, said transfer means operatively removing said releveling signal from effective operation in response to said sensed malfunction.

27. The transportation system of claim 1, wherein said control means includes a command circuit generating a command signal commanding movement of said vehicle, means operatively sensing the output of said motive means and providing a signal proportional to said motive means output, an error circuit receiving said command signal and said output signal and providing an error signal, and an amplifying circuit operatively connected to said error circuit and providing an amplified error signal operatively controlling the operation of said motive means, said transfer means operatively rendering said amplifying circuit ineffective to control the conduction of energy between said source and said motive means in response to said sensed malfunction.

28. The transportation system of claim 27, wherein said amplifying circuit directly receives said error signal.

29. The transportation system of claim 27, wherein said error circuit includes a first summing circuit and said amplifying circuit is operatively connected to said error circuit through a second summing circuit.

30. The transportation system of claim 29, wherein said second summing circuit directly receives a signal indicative of the energy being conducted between said source and said motive means.

31. The transportation system of claim 27, wherein said control means includes first and second sequence means each rendering said amplifying circuit ineffective.

32. A transportation system for a structure having a plurality of spaced landings comprising a transport vehicle, means mounting said vehicle for movement relative to said structure in a path extending adjacent each of said landings, motive means providing an output and moving said vehicle relative to the structure, braking means including a friction braking element selectively coupled to said output and permitting vehicle movement and retarding movement and retaining said vehicle in a stopped position with respect to said structure, control means connected to a source of energy and cooperating with said motive means and said braking means and controlling movement of said vehicle relative to the structure and stopping said vehicle at a selected landing, said control means including a brake control circuit connected to said source and selectively supplying energizing power and lifting and setting said friction braking element, means monitoring one or more malfunctions within said transportation system, and transfer means responsive to the functioning of said monitoring means and modifying the operation of said brake control circuit in response to a sensed malfunction to selectively lift and set said braking element and operate said vehicle within a predetermined velocity.

33. The transportation system of claim 32, wherein said braking element selectively operates in response to said sensed malfunction and guides said vehicle to one of said landings within said predetermined velocity.

34. The transportation system of claim 33, wherein said motive means is rendered inoperative to supply a driving force to said vehicle in response to said sensed malfunction.

35. The transportation system of claim 32, wherein said brake control circuit includes means selectively varying the braking force exerted by said friction element upon said motive output when in said set condition.

36. The transportation system of claim 32, wherein said brake control circuit includes a gated rectifying circuit connected to said braking element and to said source and selectively supplying energy to said braking element.

37. The transportation system of claim 32, wherein said brake control circuit includes means monitoring the operation of said transportation system, said transfer means operatively connecting said monitoring means to control the operation of said braking element in response to said sensed malfunction.

38. The transportation system of claim 37, wherein said control means includes first and second sequence means operatively coupled to said transfer means ane each operatively and independently connecting said monitoring means to control the operation of said braking element in response to said sensed malfunction.

39. The transportation system of claim 38, wherein said control means includes a third sequence means operatively coupled to said transfer means and operatively coupled to independently connect said monitoring means to control the operation of said braking element in response to said sensed malfunction.

40. The transportation system of claim 32, wherein said transportation means includes speed sensing means providing a signal proportional to the velocity of said vehicle operatively connected to said brake control circuit and maintaining said vehicle speed below said predetermined velocity in response to said sensed malfunction.

41. The transportation system of claim 40, wherein said brake control circuit includes a summing circuit receiving a command signal from a command circuit and said velocity signal and providing a brake control signal selectively setting and lifting said braking element to maintain said vehicle below said predetermined velocity in response to said sensed malfunction.

42. The transportation system of claim 41, wherein said transfer means selectively connects said velocity signal to said summing circuit in response to said sensed malfunction.

43. The transportation system of claim 40, wherein said motive means includes an armature circuit selectively connected to said source and to an energy sensing circuit providing a signal proportional to the energy flowing between said source and said armature circuit, said brake control circuit operatively connected to said energy sensing circuit and to said speed sensing means in response to said sensed malfunction and maintains said vehicle below said predetermined velocity in response to said energy signal and said velocity signal.

44. The transportation system of claim 43, wherein said brake control circuit maintains said vehicle below a second predetermined velocity in response to said velocity signal and the loss of said energy signal.

45. The transportation system of claim 43, wherein said brake control circuit maintains said vehicle below a second predetermined velocity in response to said energy signal and the loss of said velocity signal.

46. The transportation system of claim 43, wherein said brake control circuit includes a first summing circuit selectively receiving said energy signal and said velocity signal and providing a modulating control signal to a second summing circuit, said second summing circuit receiving a command signal from a command circuit and providing a brake control signal to selectively set and lift said braking element and maintain said vehicle below said predetermined velocity in response to said sensed malfunction.

47. The transportation system of claim 46, wherein said transfer means selectively connects said modulating control signal to said second summing circuit in response to said sensed malfunction.

48. The transportation system of claim 46, wherein said brake control circuit includes a unipolar circuit operatively connected between said first and second summing circuits and maintains said modulating control signal at a first electrical polarity.

49. The transportation system of claim 46, wherein said control means includes a brake sensing circuit monitoring the energy supplied to operate said braking element and supplying a signal proportional to the monitored brake energy to said second summing circuit.

50. The transportation system of claim 49, wherein said brake control circuit includes a gated rectifying circuit operatively connected to said second summing circuit and to said source and selectively supplying controlled amounts of electrical energy to said braking element in response to the magnitude of said brake control signal.

51. The transportation system of claim 50, wherein said control means includes a phase sensing circuit connected to said source and providing a phase signal indicative of the electrical phase sequence of said source, and said brake control circuit including a gating control circuit receiving said brake control signal and said phase signal and providing a gating signal to said gated rectifying means to selectively supply controlled amounts of energy to said braking element in response to the magnitude of said brake control signal and the phase sequence of said source.

52. The transportation system of claim 32, wherein said motive means includes an armature circuit selectively connected to said source and an energy sensing circuit providing a signal proportional to the energy conducted between said source and said armature circuit, said brake control circuit operatively receiving said energy signal and maintaining said vehicle below said predetermined speed in response to said sensed malfunction.

53. The transportation system of claim 52, wherein said energy signal is directly proportional to the armature voltage.

54. The transportation system of claim 52, wherein said brake control circuit includes a summing circuit receiving a command signal from a command circuit and operatively receiving said energy signal and providing a brake control signal selectively setting and lifting said braking element and maintaining said vehicle below said predetermined speed in response to said sensed malfunction.

55. The transportation system of claim 54, wherein said transfer means selectively connects said energy signal to said summing circuit in response to said sensed malfunction.

56. The transportation system of claim 32, wherein said control means includes a brake sensing circuit providing a signal proportional to the energy supplied to said braking element, and said brake control circuit includes a summing circuit receiving said brake energy signal and a command signal from a command circuit and providing a brake command signal controlling the amount of energy supplied to said braking element.

57. A transportation system for a structure having a plurality of spaced landings comprising a transport vehicle, means mounting said vehicle for movement relative to said structure in a path extending adjacent each of said landings, motive means moving said vehicle relative to the structure, control means connected to a source of energy and cooperating with said motive means and controlling movement of said vehicle relative to the structure and stopping said vehicle at a selected landing, and means monitoring one or more malfunctions within said transportation system., said control means incuding means providing first and second outputs in response to sensed first and second functions of said transportaton system, respectively, and operating said vehicle in response to a sensed malfunction below a first predetermined velocity in response to said first and second outputs and below a second predetermined velocity in response to said first output and the loss of said second output.

58. A transportation system for a structure having a plurality of spaced landings comprising a transport vehicle, means mounting said vehicle for movement relative to said structure in a path extending adjacent each of said landings, motive means incuding an armature circuit selectively connected to a source of energy and moving said vehicle relative to the structure, means monitoring the energy flowing between said source and said armature circuit and providing an armature energy indicative signal, control means connected to said source and cooperating with said motive means and controlling the movement of said vehicle relative to the structure and stopping said vehicle at a selected landing, said control means having a plurality of modes of operation controlling the movement of said vehicle, and transfer means responsive to the functioning of said monitoring means and transferring said control means from one of said modes of operation to another of said modes of operation, said plurality of modes including a first mode operating said vehicle and providing normal service between a plurality of landings and a second mode of operation established in response to said armature energy signal exceeding a predetermined magnitude and guiding said vehicle to one of said landings.

59. The transportation system of claim 58, wherein said energy signal is directly proportional to armature current.

60. The transportation system of claim 58, wherein said monitoring means includes a summing circuit receiving said energy signal and a reference signal from a reference circuit and initiating the transfer from said first mode to said second mode in response to said energy signal increasing to a magnitude having a predetermined relationship to said reference signal.

61. The transportation system of claim 60, wherein said control means includes a gated rectifying circuit connected to said source and to a gating control circuit and selectively conducting energy between said source and said armature circuit, said transfer means including a switching transistor connected to said summing circuit and having a first output circuit supplying a first disable signal to said gating control circuit through a connector circuit and a second output circuit including a sample and hold circuit supplying a second disable signal to said gating control circuit through said connector circuit in response to said energy signal increasing to said predetermined magnitude for disabling said rectifying circuit.

62. The transportation system of claim 60, wherein said monitoring means includes a unipolar circuit receiving said energy signal and providing a varying signal having a plurality of repetitive negative polarity portions proportional to armature current and one negative polarity portion increasing to said predetermined magnitude effectively transferring said system operation from said first mode to said second mode.

63. The transportation system of claim 62, wherein said reference circuit provides a constant magnitude positive polarity reference signal.

64. The transportation system of claim 62, wherein said one negative polarity portion occurs within a single electrical cycle of said source frequency.

65. A transportation system for a structure having a plurality of spaced landings comprising a transport vehicle, means mounting said vehicle for movement relative to said structure in a path extending adjacent each of said landings, motive means including an armature circuit selectively connected to a source of energy and moving said vehicle relative to the structure, means monitoring the energy flowing between said source and said armature circuit and providing an armature energy indicative signal, control means connected to said source and cooperating with said motive means and controlling the movement of said vehicle relative to the structure and stopping said vehicle at a selected landing, said control means including a gated rectifying circuit connected to said source and to a gating control circuit and selectively conducting varying amounts of energy between said source and said armature circuit, and transfer means responsive to the functioning of said monitoring means and disabling said gating control circuit rendering said gated rectifying circuit incapable of conducting energy between said source and said armature circuit in response to said armature energy signal exceeding a predetermined magnitude.

66. The transportation system of claim 65, wherein said transfer means includes a switching circuit connected to said monitoring means and transferring from a first output to a second output in response to said armature energy signal exceeding said predetermined magnitude.

67. The transportation system of claim 66, wherein said transfer means includes a disable circuit operatively receiving said second output and providing a disable signal to said gating control circuit and terminating the conduction of energy between said source and said armature circuit.

68. The transportation system of claim 67, wherein said control means includes a coupling circuit selectively connecting said gated rectifying circuit to said armature circuit, said transfer means including a second disable circuit operatively connected to said coupling circuit and disconnecting said gated rectifying circuit from said armature circuit in response to said second output.

69. The transportation system of claim 67, wherein said transfer means includes a connecting circuit conducting said disable signal to said gating control circuit.

70. The transportation system of claim 65, wherein said transfer means includes a memory means operable from a first condition to a second condition in response to said energy signal exceeding said predetermined mangitude and maintaining said second condition for a predetermined time after said energy signal decreases below said predetermined magnitude.

71. The transportation system of claim 70, wherein said transfer means includes a disable circuit connected to said memory means and to said gating control circuit and disabling said gated rectifying circuit in response to said second condition.

72. A transportation system for a structure having a plurality of spaced landings comprising a transport vehicle, means mounting said vehicle for movement relative to said structure in a path extending adjacent each of said landings, motive means selectively connected to a source of energy and moving said vehicle relative to the structure, braking means including a selectively operable friction braking element and permitting vehicle movement and retarding movement and retaining said vehicle in a stopped position with respect to said structure, means monitoring the energy flowing between said source and said motive means, control means connected to said source and cooperating with said motive means and said braking means and controlling the movement of said vehicle relative to the structure and stopping said vehicle at a selected landing, said control means including a brake control circuit controlling the operation of said braking means, and transfer means responsive to the functioning of said monitoring means and modifying the operation of said brake control circuit and selectively operating said braking element to maintain said vehicle below a predetermined velocity in response to said monitored energy exceeding a predetermined magnitude.

73. A transportation system for a structure having a plurality of spaced landings comprising a transport vehicle, means mounting said vehicle for movement relative to said structure in a path extending adjacent each of said landings, motive means including an armature circuit selectively connected to a source of energy and moving said vehicle relative to the structure, means monitoring the energy flowing between said source and said armature circuit, control means connected to said source and cooperating with said motive means and controlling the movement of said vehicle relative to the structure and stopping said vehicle at a selected landing, said control means having a plurality of modes of operation controlling the movement of said vehicle including a first mode of operation operating said vehicle and providing normal service between a plurality of landings and a second mode of operation established in response to the operation of said monitoring means and guiding said vehicle to one of said landings, and transfer means including first sequence means operatively conditioning said control means to provide said second mode in response to said energy exceeding a first predetermined magnitude and second sequence means operatively conditioning said control means to provide said second mode in response to said energy exceeding a second predetermined magnitude.

74. A transportation system for a structure having a plurality of spaced landings comprising a transport vehicle, means mounting said vehicle for movement relative to said structure in a path extending adjacent each of said landings, motive means including an armature circuit and a field circuit separately coupled to a source of energy and moving said vehicle relative to the structure, means monitoring the energy flowing between said source and said field circuit and providing a field energy indicative signal, control means connected to said source and cooperating with said motive means and controlling the movement of said vehicle relative to the structure and stopping said vehicle at a selected landing, said control means having a plurality of modes of operation controlling the operation of said vehicle, and transfer means responsive to the functioning of said monitoring means and transferring the control means from one of said modes of operation to another of said modes of operation, said plurality of modes including a first mode operating said vehicle and providing normal service between a plurality of landings and a second mode of operation established in response to said field signal decreasing below a predetermined magnitude and guiding said vehicle to one of said landings.

75. The transportation system of claim 74, wherein said predetermined magnitude of said field signal required for mode transfer remains constant during an acceleration sequence and a maximum velocity sequence of said transportation system.

76. The transportation system of claim 74, wherein said control means includes a brake control circuit connected to said source and selectively supplying energy operating a friction braking element, said brake control circuit operatively connected to said transfer means and selectively operating said braking element and maintaining said vehicle below a predetermined speed when operating within said second mode in guiding said vehicle to one of said landings.

77. The transportation system of claim 74, wherein said energy signal is directly proportional to the field current.

78. The transportation system of claim 74, wherein said monitoring means includes a summing circuit receiving said field energy signal and a reference signal from a reference circuit and initiating the transfer from said first mode to said second mode in response to said field energy signal decreasing in magnitude to a predetermined level with respect to said reference signal.

79. The transportation system of claim 74, wherein said transfer means includes a switching circuit connected to said monitoring means and selectively providing a first output conditioning said control means to provide said first mode and a second output in response to said field energy decreasing below said predetermined magnitude conditioning said control means to provide said second mode.

80. The transportation system of claim 79, wherein said control means includes a gated rectifying circuit connected to said source and to a gating control circuit and selectively conducting energy between said source and said armature circuit, said gating control circuit operatively coupled to said transfer means and terminating the conduction of energy between said source and said armature circuit in response to said second output.

81. The transportation system of claim 80, wherein said transfer means includes a disable circuit receiving said first and second outputs and supplying a disable signal to said gating control circuit in response to said second output.

82. The transportation system of claim 81, wherein said control means includes a coupling circuit selectively connecting said gated rectifying circuit to said armature circuit, said transfer means including a second disable circuit connected to said coupling circuit and disconnecting said gated rectifying circuit from said armature circuit in response to said second output.

83. A transportation system for a structure having a plurality of spaced landings comprising a transport vehicle, means mounting said vehicle for movement relative to said structure in a path extending adjacent each of said landings, motive means including an armature circuit and a field circuit separately coupled to a source of energy and moving said vehicle relative to the structure, braking means including a braking element selectively operable between a set condition and a lifted condition and permitting vehicle movement and retaining said vehicle in a stopped position with respect to said structure, means monitoring the energy flowing between said source and said field circuit and providing a field energy indicative signal, control means connected to said source and cooperating with said motive means and said braking means and controlling the movement of said vehicle relative to the structure and stopping said vehicle at a selected landing, said control means including first sequence means connecting energy from source to said field circuit and a second sequence means supplying a reference signal to said monitoring means in response to a command for vehicle movement, and transfer means responsive to the functioning of said monitoring means and conditioning said braking means to maintain said braking element in a set condition in response to said field energy signal varying to a magnitude having a predetermined relationship with respect to said reference signal and preventing vehicle movement.

84. The transportation system of claim 83, wherein said reference signal includes a first signal portion varying from a zero magnitude to a second predetermined magnitude within a predetermined time and a second signal portion maintaining said second predetermined magnitude.

85. The transportation system of claim 83, wherein said energy signal is directly proportional to the field current.

86. The transportation system of claim 83, wherein said monitoring means includes a summing circuit receiving said field energy signal and said reference signal from a reference circuit in response to the conditioning of said control means to initiate vehicle movement.

87. The transportation system of claim 83, wherein said control means includes a gated rectifying circuit connected to said source and to a gating control circuit and selectively conducting energy between said source and said armature circuit, said transfer means operatively coupled to said gating control circuit and rendering said rectifying circuit inoperative for supplying energy to said armature circuit in response to said field energy signal varying to a magnitude having a predetermined relationship with respect to said reference signal and preventing vehicle movement.

88. The transportation system of claim 87, wherein said transfer means includes a disable circuit operatively supplying a disable signal to said gating control circuit and rendering said rectifying circuit inoperative.

89. A transportation system for a structure having a plurality of spaced landings comprising a transport vehicle, means mounting said vehicle for movement relative to said structure in a path extending adjacent each of said landings, motive means including an armature circuit and a field circuit separately coupled to a source of energy and moving said vehicle relative to the structure, means monitoring the energy flowing between said source and said field circuit and providing a field energy indicative signal compared with a reference signal, control means connected to said source and cooperating with said motive means and controlling the movement of said vehicle relative to the structure and stopping said vehicle at a selected landing and providing normal service between a plurality of landings, and transfer means modifying the operation of said control means in response to the difference between said field signal and said reference signal exceeding a predetermined value.

90. A transportation system for a structure having a plurality of spaced landings comprising a transport vehicle, means mounting said vehicle for movement relative to said structure in a path extending adjacent each of said landings, motive means moving said vehicle relative to the structure, selectively operable braking means permitting vehicle movement and retaining said vehicle in a stopped position with respect to said structure, control means connected to a source of energy and cooperating with said braking means and including an error circuit operatively receiving a command signal from a pattern circuit and operatively receiving an output proportional signal from means responsive to an output of said motive means and providing an error signal operatively controlling the operation of said motive means and moving said vehicle relative to the structure and stopping said vehicle at a selected landing, said control means having a plurality of modes of operation controlling the movement of said transport vehicle, means monitoring said error signal, and transfer means responsive to the functioning of said monitoring means and transferring said control means from one of said modes of operation to another of said modes of operation, said plurality of modes including a first mode of operation operating said vehicle and providing normal service between a plurality of landings and a second mode of operation established in response to said error signal increasing to a predetermined magnitude rendering said motive means inoperative for supplying a driving force to said vehicle and operating said braking means and guiding said transport vehicle to one of said landings.

91. The transportation system of claim 90, wherein said output responsive means includes a tachometer operatively coupled to said motive means and providing a signal directly proportional to said vehicle velocity.

92. The transportation system of claim 90, wherein said monitoring means includes summing means receiving said error signal and a reference signal from a reference circuit and providing an output signal operatively conditioning said control means to transfer from said first mode to said second mode in response to said error signal increasing to said predetermined magnitude with respect to said reference signal.

93. The transportation system of claim 90, wherein said error circuit provides a positive polarity error signal commanding a first output by said motive means and a negative polarity error signal commanding a second output by said motive means, said monitoring means including a first circuit operatively receiving said positive polarity error signal and providing a first output in response to said positive polarity error signal reaching a first predetermined magnitude conditioning said control means to transfer from said first mode to said second mode and a second circuit operatively receiving said negative polarity error signal and providing a second output in response to said negative polarity error signal reaching a second predetermined magnitude conditioning said control means to transfer from said first mode to said second mode.

94. The transportation system of claim 93, wherein said error circuit includes a logic OR circuit connecting said first and second circuits to said error circuit.

95. The transportation system of claim 93, wherein said first circuit includes a first summing circuit receiving said positive error signal and a negative polarity reference signal from a first reference circuit and providing said first output in response to said positive error signal increasing to a predetermined magnitude with respect to said negative reference signal and said second circuit includes a second summing circuit receiving said negative error signal and a positive polarity reference signal from a second reference circuit and providing said second output in response to said negative error signal increasing to a predetermined magnitude with respect to said positive reference signal.

96. The transportation system of claim 90, wherein said transfer means includes a switching circuit connected to said monitoring means and selectively providing a first output conditioning said control means to provide said first mode and a second output conditioning said control means to provide said second mode in response to said error signal increasing to a predetermined magnitude.

97. The transportation system of claim 96, wherein said control means includes a gated rectifying circuit connected to said source and to a gating control circuit and selectively conducting energy between said source and said motive means, said gating control circuit operatively responding to said second output and rendering said rectifying circuit inoperative for supplying energy between said source and said motive means.

98. The transportation system of claim 97, wherein said transfer means includes a disable circuit operatively responding to said second output and supplying a disable signal to said gating control circuit.

99. The transportation system of claim 98, wherein said transfer means includes a coupling circuit connected to said gated rectifying circuit and to said motive means and permitting energy to flow between said rectifying circuit and said motive means, said transfer means including a second disable circuit connected to said coupling circuit and disconnecting said gated rectifying circuit from said motive means in response to said second output.

100. The transportation system of claim 90, wherein said braking means includes a friction braking element and said control means includes a brake control circuit connected to said source and selectively supplying energy to said braking means to lift and set said braking element, said brake control circuit operatively connected to said transfer means and selectively operating said braking element and maintaining said vehicle below a predetermined speed when operating within said second mode in response to said error signal increasing to said predetermined magnitude.

101. The transportation system of claim 90, wherein said error signal increases to said predetermined magnitude in response to the loss of said output proportional signal and conditions said control means to provide said second mode.

102. The transportation system of claim 90, wherein said transfer means is coupled to said monitoring means and selectively transfers from a first output to a second output in response to said error signal increasing to a predetermined magnitude and initiating a transfer from said first mode to said second mode, said transfer means providing said second output in response to a malfunction sensed within said monitoring means and conditioning said control means to provide said second mode of operation.

103. The transportation system of claim 102, wherein said transfer means provides said second output in response to the loss of operating power supplied from said source to said monitoring means.

104. A transportation system for a structure having a plurality of spaced landings comprising a transport vehicle, means mounting said vehicle for movement relative to said structure in a path extending adjacent each of said landings, motive means moving said vehicle relative to the structure, braking means including a selectively operable braking element and permitting vehicle movement and retaining said vehicle in a stopped position with respect to said structure, control means connected to a source of energy and including a sequence means coupled to said braking means and selectively operating said braking element between a set condition and a lifted condition and permitting vehicle movement from one of said landings and an error circuit operatively receiving a command signal from a pattern circuit and an output proportional signal from means responsive to an output of said motive means and providing an error signal operatively controlling the operation of said motive means and controlling the movement of said vehicle relative to the structure and stopping said vehicle at a selected landing, means monitoring said error signal, and transfer means responsive to the functioning of said monitoring means and transferring from a first output to a second output rendering said motive means essentially inoperative for supplying a driving force to said vehicle and guiding said vehicle to one of said landings in response to said error signal exceeding a predetermined magnitude, said transfer means responsive to a malfunction sensed within said monitoring means and providing said second output modifying the operation of said sequence means and maintaining said braking means in said set condition and preventing movement of said vehicle from one of said landings.

105. The transportation system of claim 104, wherein said transfer means provides said second output in response to the loss of operating power supplied from said source to said monitoring means.

106. The transportation system of claim 104, wherein said first output is operatively coupled to said sequence means and conditions said braking means to lift said braking element and permits vehicle movement from one of said landings.

107. A transportation system for a structure having a plurality of spaced landings comprising a transport vehicle, means mounting said vehicle for movement relative to said structure in a path extending adjacent each of said landings, motive means moving said vehicle relative to the structure, braking means including a braking element selectively operable between a set condition and a lifted condition and permitting vehicle movement and retaining said vehicle in a stopped position with respect to said structure, control means connected to a source of energy and cooperating with said motive means and said braking means and moving said vehicle relative to the structure and stopping said vehicle at a selected landing, said control means having a plurality of modes of operation controlling the movement of said transport vehicle, means monitoring the position of said vehicle when approaching a landing at which a stop is to be made, and transfer means responsive to the functioning of said monitoring means and transferring said control means from one of said modes of operation to another of said modes of operation, said plurality of modes including a first mode operating said transport vehicle and providing normal service between a plurality of landings and a second mode of operation established in response to said vehicle arriving at a first position adjacent to a landing at which a stop is to be made and the subsequent movement of said vehicle to a second position spaced from said first position and having a greater distance from said landing than said first position and operatively transferring said braking element to said set condition and preventing further movement of said vehicle.

108. The transportation system of claim 107, wherein said control means includes first sequence means operatively coupled to said braking means and permitting vehicle movement until arriving at said first position adjacent to a landing at which a stop is to be made and second sequence means operatively coupled to said braking means in response to said vehicle arriving at a third position with respect to said landing at which said stop is to be made and permitting vehicle movement, said transfer means operatively rendering said second sequence means inoperative for permitting vehicle movement in said second mode.

109. The transportation system of claim 108, wherein said third position is spaced from said landing by a greater distance than said first and second positions.

110. The transportation system of claim 109, wherein said transfer means operatively renders said first sequence inoperative for permitting vehicle movement in said second mode.

111. A transportation system for a structure having a plurality of spaced landings comprising a transport vehicle, means mounting said vehicle for movement relative to said structure in a path extending adjacent each of said landings, motive means moving said vehicle relative to the structure, braking means including a braking element selectively operable between a set condition and a lifted condition and permitting vehicle movement and retaining said vehicle in a stopped position with respect to said structure, means monitoring the velocity of said vehicle, and control means connected to a source of energy and cooperating with said motive means and said braking means and controlling the movement of said vehicle relative to the structure and stopping said vehicle at a selected landing and including first sequence means operatively coupled to said monitoring means and transferring said braking element from said lifted condition to said set condition in response to a first predetermined velocity and second sequence means operatively coupled to said monitoring means and transferring said braking element from said lifted condition to said set condition in response to a second predetermined velocity and third sequence means operatively coupled to said monitoring means and transferring said braking element from said lifted condition to said set condition in response to a third predetermined velocity.

112. The transportation system of claim 111, wherein said monitoring means includes a tachometer operatively coupled to an output of said motive means and supplying a velocity signal operatively controlling said first sequence means, a governor operatively coupled to said vehicle and providing a selectively operable first switch controlling said second sequence means, and a safety clamp coupled to said vehicle and providing a selectively operable second switch controlling said third sequence means.

113. A transportation system for a structure having a plurality of spaced landings comprising a transport vehicle, means mounting said vehicle for movement relative to said structure in a path extending adjacent each of said landings, motive means moving said vehicle relative to the structure, control means connected to a source of energy and cooperating with said motive means and controlling the movement of said vehicle relative to the structure and stopping said vehicle at a selected landing, said control means providing a first mode of operation operating said vehicle and providing normal service between a plurality of landings and a second mode of operation rendering said motive means essentially inoperative for supplying a driving force to said vehicle and guiding said vehicle to one of said landings, means monitoring malfunctions within said transportation system, and transfer means responsive to the functioning of said monitoring means and providing a first response corresponding to a sensed first malfunction and a second response corresponding to a sensed second malfunction to initiate a transfer from said first mode to said second mode.

114. The transportation system of claim 113, wherein said first response provides a first sequence pattern and said second response provides a second sequence pattern.

115. A transportation system for a structure having a plurality of spaced landings comprising a transport vehicle, means mounting said vehicle for movement relative to said structure in a path extending adjacent each of said landings, motive means moving said vehicle relative to the structure, control means connected to a source of energy and cooperating with said motive means and providing a plurality of modes of operation and controlling the movement of said vehicle relative to the structure and stopping said vehicle at a selected landing, means monitoring malfunctions within said transportation system, and transfer means responsive to the functioning of said monitoring means and transferring said control means from a first mode of operation to a second mode of operation in response to a sensed first malfunction, said control means including coupling means selectively supplying energy to said monitoring means and sequence means responsive to the operation of said transfer means and coupled to said coupling means maintaining the supply of energy to said monitoring means to continually sense a second malfunction when operating within said second mode until said vehicle arrives with a first position adjacent to a landing at which a stop is to be made.

116. The transportation system of claim 115, wherein said control means includes timing means operatively connected to said coupling means and maintains the supply of operating energy to said monitoring means for a predetermined time after said vehicle has stopped at said landing when operating within said first mode, said transfer means operatively rendering said timing means ineffective for maintaining the supply of energy to said monitoring means for said predetermined time when operating within said second mode.

117. A transportation system for a structure having a plurality of spaced landings comprising a transport vehicle, means mounting said vehicle for movement relative to said structure in a path extending adjacent each of said landings, motive means moving said vehicle relative to the structure, control means connected to a source of energy and cooperating with said motive means and controlling the movement of said vehicle relative to the structure and stopping said vehicle at a selected landing, said control means having a plurality of modes of operation controlling the movement of said vehicle including a first mode of operation operating said transport vehicle and providing normal service between a plurality of landings and a second mode of operation rendering said motive means inoperative for supplying a driving force to said vehicle and guiding said transport vehicle to one of said landings, means monitoring one or more malfunctions within said transportation system, and transfer means coupled to said monitoring means and to said control means and providing a first output conditioning said control means to provide said first mode and a second output in response to a sensed malfunction conditioning said control means to provide said second mode, said control means including an interlock circuit operating in response to said second output and connected to maintain said second output to continually provide said second mode.

118. The transportation system of claim 117, wherein said transfer means automatically switches from said first output to said second output in response to said sensed malfunction.

119. The transportation system of claim 118, wherein said interlock circuit includes means selectively manually operable and permits said transfer means to switch from said second output to said first output in response to the lack of said malfunction.

120. A transportation system for a structure having a plurality of spaced landings comprising a transport vehicle, means mounting said vehicle for movement relative to said structure in a path extending adjacent each of said landings, motive means moving said vehicle relative to the structure, control means connected to a source of energy and cooperating with said motive means and controlling the movement of said vehicle relative to the structure and stopping said vehicle at a selected landing, and means monitoring one or more malfunctions within said transportation system, said control means including means sensing the registration of demands for service at said landings and stopping said vehicle at a selected landing and means operatively coupled to said demand sensing means and to said monitoring means and simulating a demand for service at a pair of adjacent landings in response to said sensed malfunction.

121. The transportation system of claim 120, wherein said simulating means operates in response to said sensed malfunction and conditions said control means to stop said vehicle at said adjacent landing.

122. The transportation system of claim 120, wherein said control means includes means sensing the position of said vehicle at a predetermined distance from said adjacent landing, said position sensing means operatively initiating a stop of said vehicle when arriving at said predetermined distance in response to said simulated demand.

123. The transportation system of claim 122, wherein said position sensing means includes a leveling sensor.

124. The transportation system of claim 120, wherein said control means includes sequence means operatively coupled to said demand simulating means and maintaining said demand simulation for vehicle service at an adjacent landing in response to said sensed malfunction until arriving at a first position adjacent to said landing at which a stop is to be made.

125. A transportation system for a structure having a plurality of spaced landings comprising a transport vehicle, means mounting said vehicle for movement relative to said structure in a path extending adjacent each of said landings, motive means moving said vehicle relative to the structure, braking means including a selectively operable braking element and permitting vehicle movement and retarding movement and retaining said vehicle in a stopped position with respect to said structure, control means connected to a source of energy and cooperating with said motive means and said braking means and controlling the movement of said vehicle relative to the structure and stopping said vehicle at a selected landing, said control means including a gated rectifying circuit connected to said source and to a gating control circuit and selectively supplying energy to said braking means and permitting vehicle movement, means monitoring one or more malfunctions within said transportation system, and transfer means responsive to the functioning of said monitoring means and coupled to said gating control circuit and operatively terminating the supply of energy to said braking means and stopping said vehicle in response to a sensed malfunction.

126. The transportation system of claim 125, wherein said gating control circuit includes a switching circuit operable between a first and a second condition and selectively supplying a gating control signal to said gated rectifying circuit and controlling the supply of energy to said braking means, said transfer means including disable means connected to said monitoring means and supplying a disable signal to said gating control circuit and transferring said switching circuit from said first condition to said second condition in response to said sensed malfunction and terminating the supply of energy to said braking means to stop said vehicle.

127. The transportation system of claim 126, wherein said control means includes a coupling circuit connected to said gated rectifying circuit and to said braking means and selectively conducting energy to said braking means, said transfer means including a second disable means operatively connected to said monitoring means and to said coupling circuit and disconnecting said gated rectifying circuit from said braking means in response to said sensed malfunction.

128. The transportation system of claim 125, wherein said gated rectifying circuit is connected to said braking means by a coupling circuit, said transfer means including a disable means operatively connected to said monitoring means and to said coupling circuit and disconnecting gated rectifying circuit from said braking means in response to said sensed malfunction.

129. The transportation system of claim 125, wherein said transfer means operatively modifies said gating control circuit to selectively supply energy to said braking means and permit continued controlled vehicle movement in response to a sensed second malfunction.

130. The transportation system of claim 129, wherein said gating control circuit operates in response to said sensed second malfunction and supplies varied controlled amounts of energy to said braking means.

131. A transportation system for a structure having a plurality of spaced landings comprising a transport vehicle, means mounting said vehicle for movement relative to said structure in a path extending adjacent each of said landings, motive means including an energy dissipating circuit selectively connected to an armature circuit and moving said vehicle relative to the structure, control means connected to a source of energy and including gated rectifying means directly supplying energy to said armature circuit and controlling the movement of said vehicle relative to the structure and stopping said vehicle at a selected landing, and means monitoring malfunctions within said transportation system, said control means operatively connected to said monitoring means and selectively connecting said energy dissipating circuit to said armature circuit in response to a selected sensed malfunction.

132. The transportation system of claim 131, wherein said selective connection of said energy dissipating circuit to said armature circuit is effective for providing a dynamic braking of said vehicle.

133. A transportation system for a structure having a plurality of spaced landings comprising a transport vehicle, means mounting said vehicle for movement relative to said structure in a path extending adjacent each of said landings, motive means moving said vehicle relative to the structure, braking means permitting vehicle movement and retarding movement and retaining said vehicle in a stopped position with respect to said structure, means monitoring the velocity of said vehicle, control means connected to a source of energy and cooperating with said motive means and said braking means and controlling the movement of said vehicle relative to the structure and stopping said vehicle at a selected landing, said control means including a gated rectifying circuit connected to said source and to a gating control circuit and selectively supplying energy to said braking means and permitting vehicle movement, and transfer means responsive to the functioning of said monitoring means and coupled to said gating control circuit and operatively terminating the supply of energy to said braking means to stop said vehicle in response to said vehicle exceeding a predetermined velocity.

134. The transportation system of claim 133, wherein said control means includes a second gated rectifying circuit connected to said source and to a second gating control circuit and selectively conducting energy between said source and said motive means, said transfer means coupled to said second gating control circuit and operatively terminating the flow of energy between said source and said motive means in response to said vehicle exceeding said predetermined velocity.

135. The transportation system of claim 134, wherein said control means includes a first coupling circuit connecting said first gated rectifying circuit to said braking means and a second coupling circuit connecting said second gated rectifying circuit to said motive means, said transfer means operatively coupled to said first and second coupling circuits and disconnecting said first gated rectifying circuit from said braking means and said second gated rectifying circuit from said motive means in response to said vehicle exceeding said predetermined velocity.

136. The transportation system of claim 133, wherein said monitoring means includes a tachometer operatively coupled to an output of said motive means.

137. The transportation system of claim 133, wherein said monitoring means includes a summing circuit operatively receiving a velocity signal from means connected to sense an output of said motive means and a reference signal from a reference circuit and providing an output operatively connected to said transfer means and terminating the supply of energy to said braking means in response to said velocity increasing to a predetermined magnitude with respect to said reference signal.

138. The transportation system of claim 137, wherein said monitoring means includes a unipolar circuit receiving said velocity signal and providing a first polarity velocity proportional signal to said summing circuit, said reference signal including a second polarity signal.

139. The transportation system of claim 137, wherein said transfer means includes a switching circuit selectively transferring from a first output to a second output in response to said velocity signal increasing to a predetermined magnitude with respect to said reference signal.

140. The transportation system of claim 133, wherein said control means provides a plurality of modes of operation controlling the operation of said transport vehicle including a first mode providing normal service between a plurality of landings and a second mode established in response to a first malfunction sensed by said monitoring means guiding said vehicle to one of said landings and a third mode established in response to said vehicle exceeding a predetermined velocity constituting a second malfunction modifying the operation of said gating control circuit and operatively terminating the supply of energy to said braking means and stopping said vehicle, said transfer means including a switching circuit operatively coupled to said monitoring means and selectively providing a first output conditioning said control means to provide said first and second modes and a second output in response to said vehicle exceeding said predetermined velocity conditioning said control means to provide said third mode.

141. A transportation system for a structure having a plurality of spaced landings comprising a transport vehicle, means mounting said vehicle for movement relative to said structure in a path extending adjacent each of said landings, motive means moving said vehicle relative to the structure, control means connected to a source of energy and cooperating with said motive means and controlling the movement of said vehicle from a first landing and stopping said vehicle at a selected landing, said control means having a plurality of modes of operation controlling the operation of said vehicle, means monitoring malfunctions including the velocity of said vehicle within said transportation system, and transfer means responsive to the functioning of said monitoring means and transferring said control means from one of said modes of operation to another of said modes of operation, said plurality of modes including a first mode providing normal service between a plurality of landings and a second mode established in response to a sensed first malfunction guiding said transport vehicle to one of said landings and a third mode stopping said vehicle, said transfer means substantially operative during said vehicle travel from said first landing to said selected landing and transferring said system from said first mode to said third mode in response to a sensed first predetermined velocity of said vehicle and from said second mode to said third mode in response to a sensed second predetermined velocity of said vehicle.

142. The transportation system of claim 141, wherein said monitoring means includes means coupled to an output of said motive means and sensing the velocity of said vehicle and a first coupling circuit operatively connected to said velocity sensing means and sensing said first predetermined velocity and a second coupling circuit operatively connected to said velocity sensing means and sensing said second predetermined velocity.

143. The transportation system of claim 142, wherein said first coupling circuit selectively senses said motive means output in response to said system operating in said first mode and said second coupling circuit selectively senses said motive means output in response to said system operating in said second mode.

144. The transportation system of claim 143, wherein said monitoring means includes a summing circuit receiving a reference signal from a reference circuit and operatively receiving said motive means output through said first and second coupling circuits.

145. A transportation system for a structure having a plurality of spaced landings comprising a transport vehicle, means mounting said vehicle for movement relative to said structure in a path extending adjacent each of said landings, motive means moving said vehicle relative to the structure, control means connected to a source of energy and cooperating with said motive means and controlling the movement of said vehicle relative to the structure and stopping said vehicle at a selected landing, said control means having a plurality of modes of operation controlling the operation of said vehicle, means monitoring malfunctions within said transportation system, and transfer means responsive to the functioning of said monitoring means and transferring said control means from one of said modes of operation to another of said modes of operation, said plurality of modes including a first mode operating said vehicle and providing normal service between a plurality of landings and a second mode established in response to a sensed first malfunction and guiding said vehicle to one of said landings and a third mode established in response to a sensed second malfunction of said energy source and stopping said vehicle.

146. The transportation system of claim 145, and including braking means having a friction braking element selectively operable between a set condition and a lifted condition and permitting vehicle movement and retarding movement and retaining said vehicle in a stopped position with respect to said structure, said control means operating in response to said transfer means and selectively operating said braking element between said set condition and said lifted condition and guiding said vehicle to one of said landing in said second mode and transferring said braking element to said set condition and stopping said vehicle in said third mode.

147. The transportation system of claim 145, and including braking means permitting vehicle movement and retarding movement and retaining said vehicle in a stopped position with respect to said structure, said control means includes a first gated rectifying circuit connected to said source and to a first gating control circuit and selectively supplying energy to said braking means and a second gated rectifying circuit connected to said source and to a second gating control circuit and selectively conducting energy between said source and said motive means, said transfer means including disable means operatively coupled to said monitoring means and to said first and second gating control circuits and operatively terminating the supply of energy from said source to said braking means and between said source and said motive means and stopping said vehicle in response to said malfunction of said energy source.

148. The transportation system of claim 147, wherein said control means includes a first coupling circuit connecting said first gated rectifying circuit to said braking means and a second coupling circuit connecting said second gated rectifying circuit to said motive means, said transfer means including second disable means operatively disconnecting said first gated rectifying circuit from said braking means and said second gated rectifying circuit from said motive means in response to said sensed malfunction of said energy source.

149. The transportation system of claim 147, wherein said disable means includes a first circuit means supplying a first disable signal and a second circuit means supplying a second disable signal and disabling said first and second gating control circuits in response to said sensed malfunction of said energy source.

150. The transportation system of claim 145, wherein said transfer means includes a switching circuit connected to said monitoring means and selectively providing a first output conditioning said control means to provide said first and second modes and a second output conditioning said control means to provide said third mode in response to said sensed malfunction of said energy source.

151. The transportation system of claim 150, wherein said transfer means includes memory means operable from a first condition to a second condition in response to said second output and maintaining said second output for a predetermined time after said energy source has returned to normal operation.

152. The transportation system of claim 45, wherein said second malfunction includes said sensed energy decreasing to a predetermined magnitude.

153. The transportation system of claim 152, wherein said monitoring means includes a summing circuit connected to receive a first polarity reference signal and a second polarity signal proportional to said sensed energy and providing an output signal operatively coupled to said transfer means and providing said third mode in response to said second signal decreasing to a magnitude having a predetermined relationship with respect to said first signal in response to said energy decreasing to said predetermined magnitude.

154. The transportation system of claim 53, wherein said monitoring means includes a reference circuit supplying a substantially constant magnitude first signal.

155. The transportation system of claim 145, wherein said monitoring means includes means operatively coupled to said source and sensing a plurality of alternating phases of said energy, said transfer means operating in response to said monitoring means and conditioning said control means to provide said third mode in response to a sensed loss of one of said phases of energy.

156. The transportation system of claim 155, wherein said monitoring means includes a summing circuit receiving a first polarity reference signal and a second polarity signal responsive to said plurality of alternating phases of energy and providing an output signal operatively coupled to said transfer means to provide said third mode in response to said second signal decreasing to a magnitude having a predetermined relationship with respect to said first signal in response to said loss of one of said phases.

157. The transportation system of claim 156, wherein said monitoring means includes a reference circuit supplying a substantially constant magnitude first signal.

158. The trannsportation system of claim 145, wherein said monitoring means includes means operatively coupled to said source and including a plurality of rectifying elements sensing a plurality of alternating phases of energy, said transfer means operating in response to said monitoring means and conditioning said control means to provide said third mode of operation in response to a sensed failure of one of said rectifying elements.

159. The transportation system of claim 145, wherein said monitoring means includes means operatively coupled to said source sensing the sequential order of a plurality of alternating phases of energy, said transfer means operating in response to said monitoring means and conditioning said control means to provide said third mode of operation in response to a sensed improper phase sequence.

160. The transportation system of claim 159, wherein said monitoring means includes a summing circuit receiving a first reference signal and a second signal responsive to said sequential order of said plurality of alternating phases of energy and providing an output signal operatively coupled to said transfer means to provide said third mode in response to said second signal changing according to said sensed improper phase sequence to a magnitude having a predetermined relationship with respect to said first signal.

161. The transportation system of claim 160, wherein said monitoring means includes a reference circuit supplying a substantially constant magnitude first signal.

162. The transportation system of claim 145, wherein said monitoring means includes a summing circuit receiving a first signal from a reference circuit and a second signal continually responsive to the number of a plurality of alternating phases of energy supplied from said source and a third signal continually responsive to the sequential order to said plurality of alternating phases of energy, said first, second and third signals combining and providing a first output conditioning said control means to operate within said first and second modes and a second output conditioning said control means to operate within said third mode in response to a sensed abnormal condition existing within said alternating phases.

163. The transportation system of claim 162, wherein said summing circuit operatively senses the magnitude of said energy from said source by sensing said second signal.

164. A transportation system for a structure having a plurality of spaced landings comprising a transport vehicle, means mounting said vehicle for movement relative to said structure in a path extending adjacent each of said landings motive means moving said vehicle relative to the structure, control means connected to a source of energy and cooperating with said motive means and controlling the movement of said vehicle relative to the structure and stopping the vehicle at a selected landing, said control means having a plurality of modes of operation controlling the operation of said vehicle, means monitoring malfunctions with said transportation system, and transfer means responsive to the functioning of said monitoring means and transferring said control means from one of said modes of operation to another of said modes of operation, said plurality of modes including a first mode operating said vehicle and providing normal service between a plurality of landings and a second mode established in response to a sensed first malfunction and guiding said vehicle to one of said landings and a third mode established in response to a second malfunction of a predetermined temperature sensed within said control means and stopping said vehicle.

165. The tranportation system of claim 164, wherein said control means includes a gated rectifying circuit operatively connected to said source and to said motive means and selectively conducting energy between said source and said motive means, said monitoring means operatively sensing said predetermined temperature of said gated rectifying circuit.

166. The transportation system of claim 164, wherein said transfer means includes a switching circuit connected to said monitoring means and selectively providing a first output conditioning said control means to provide said first and second modes and a second output conditioning said control means to provide said third mode in response to the sensed temperature increasing to said predetermined magnitude.

167. The transportation system of claim 166, wherein said control means includes a first gated rectifying circuit connected to said source and to a first gating control circuit and selectively supplying energy to a braking circuit and a second gated rectifying circuit connected to said source and to a second gating control circuit and selectively conducting energy between said source and said motive means, said transfer means including a disable means operatively coupled to said first and second gating control circuits and to said second output and terminating the supply of energy from said source to said braking means and between said source and said motive means in response to the sensed temperature increasing to said predetermined magnitude.

168. The transportation system of claim 167, wherein said control means includes a first coupling circuit connecting said first gated rectifying circuit to said braking means and a second coupling circuit connecting said second gated rectifying circuit to said motive means, said transfer means including second disable means operatively coupled to said second output and disconnecting said first gated rectifying circuit from said braking means and said gated rectifying circuit from said motive means in response to the sensed temperature increasing to said predetermined magnitude.

169. A transportation system for a structure having a plurality of spaced landings comprising a transport vehicle, means mounting said vehicle for movement relative to said structure in a path extending adjacent each of said landings, motive means moving said vehicle relative to the structure, control means connected to a source of energy and cooperating with said motive means and controlling the movement of said vehicle relative to the structure and stopping said vehicle at a selected landing, means monitoring malfunctions within said transportation system, said control means having a plurality of modes of operation controlling the operation of said transport vehicle including a first mode operating said vehicle and providing normal service between a plurality of landings and a second mode established in response to a sensed first malfunction and guiding said vehicle to one of said landings and a third mode established in response to a sensed second malfunction and stopping said vehicle, and transfer means responsive to the functioning of said monitoring means and transferring said control means from one of said modes of operation to another of said modes of operation, said transfer means provides a first output in response to a sensed proper electrical connection of a circuit connector within said control means conditioning said control means to provide said first and second modes and a second output in response to a sensed improper electrical connection of said circuit connector conditioning said control means to provide said third mode.

170. The transportation system of claim 169, wherein said circuit connector connects a gated rectifying circuit to a gating control circuit.

171. The transportation system of claim 170, wherein said gated rectifying circuit is selectively connected to an armature circuit within said motive means.

172. The transportation system of claim 169, wherein said transfer means includes a switching circuit connected to said monitoring means and selectively providing said first and second outputs.

173. The transportation system of claim 172, wherein said control means includes a first gated rectifying circuit connected to said source and to a first gating control circuit and selectively supplying energy to a braking means permitting vehicle movement and retarding movement and retaining said vehicle in a stopped position with respect to said structure and a second gated rectifying circuit connected to said source and to a second gating control circuit and selectively conducting energy between said source and said motive means, said transfer means including disable means operatively coupled to said first and second gating control circuits and operatively terminating the supply of energy from said source to said braking means and between said source and said motive means in response to said sensed second output.

174. The transportation system of claim 173, wherein said control means includes a first coupling circuit connecting said first gated rectifying circuit to said braking means and a second coupling circuit connecting said second gated rectifying circuit to said motive means, said transfer means including second disable means operatively disconnecting said first gated rectifying circuit from said braking means and said second gated rectifying circuit from said motive means in response to said second output.

175. A transportation system for a structure having a plurality of spaced landings comprising a transport vehicle, means mounting said vehicle for movement relative to said structure in a path extending adjacent each of said landings, motive means moving said vehicle relative to the structure, means monitoring malfunctions within said transportation system including a detector monitoring the velocity of said vehicle, control means connected to a source of energy and cooperating with said motive means and controlling the movement of said vehicle relative to the structure and stopping said vehicle at a selected landing, said control means having a plurality of modes of operation controlling the operation of said vehicle including a first mode operating said vehicle and providing normal service between a plurality of landings and a second mode established in response to a sensed first malfunction and guiding said vehicle to one of said landings and a third mode established in response to a sensed second malfunction and preventing movement of said vehicle, and transfer means responsive to the functioning of said monitoring means and transferring said control means from one of said modes of operation to another of said modes of operation, said transfer means providing a first output in response to a proper operating velocity sensed by said detector conditioning said control means to provide said first and second modes and a second output in response to a improper predetermined velocity sensed by said detector conditioning said control means to provide said third mode, said transfer means responsive to a malfunction within said detector and providing said second output conditioning said control means to provide said third mode.

176. The transportation system of claim 175, wherein said transfer means provides said second output in response to the loss of operating power supplied from said source to said detector.

177. The transportation system of claim 175, wherein said control means includes sequence means coupled to said transfer means, and braking means including a braking element selectively operable between a set condition and a lifted condition and permitting vehicle movement from one of said landings, said sequence means operating in response to said second output and maintaining said braking element in said set condition preventing movement of said vehicle from one of said landings in response to said sensed malfunction within said velocity detector.

178. The transportation system of claim 177, wherein said malfunction within said detector includes a loss of operating power supplied from said source to said velocity detector.

179. The transportation system of claim 177, wherein said sequence means operates in response to said first output and operatively lifts said braking element and permits vehicle movement from one of said landings.

180. A transportation system for a structure having a plurality of spaced landings comprising a transport vehicle, means mounting said vehicle for movement relative to said structure in a path extending adjacent each of said landings, motive means moving said vehicle relative to the structure, braking means permitting vehicle movement and retaining said vehicle in a stopped position with respect to said structure, control means connected to a source of energy and cooperating with said motive means and said braking means and controlling the movement of said vehicle relative to the structure and stopping said vehicle at a selected landing, said control means including sequence means operatively coupled to said braking means and permitting vehicle movement until arriving at a first position adjacent to a landing at which a stop is to be made, means monitoring malfunctions within said transportation system, and transfer means responsive to the functioning of said monitoring means and conditioning said sequence means to provide continued operative control in response to a first sensed malfunction and rendering said sequence means inoperative for controlling said braking means in response to a second sensed malfunction.

181. The transportation system of claim 180, wherein said control means includes second sequence means operatively coupled to said braking means and permitting vehicle movement from one of said landings, said transfer means operatively rendering said second sequence means inoperative for controlling said braking means in response to said first malfunction and in response to said second malfunction.

182. The transportation system of claim 181, wherein said control means includes third sequence means operatively coupled to said braking means in response to said vehicle arriving at a second position with respect to said landing at which said stop is to be made and permitting vehicle movement, said transfer means operatively rendering said third sequence means inoperative for controlling said braking means in response to said first malfunction and in response to said second malfunction.

183. The transportation system of claim 180, wherein said control means includes second sequence means operatively coupled to said braking means in response to said vehicle arriving at a second position with respect to said landing at which said stop is to be made and permitting vehicle movement, said transfer means operatively rendering said second sequence means inoperative for controlling said braking means in response to said first malfunction and in response to said second malfunction.

184. A transportation system for a structure having a plurality of spaced landings comprising a transport vehicle, means mounting said vehicle for movement relative to said structure in a path extending adjacent each of said landings, motive means moving said vehicle relative to the structure, means monitoring malfunctions within said transportation system, control means connected to a source of energy and cooperating with said motive means and controlling the movement of said vehicle relative to the structure and stopping said vehicle at a selected landing, said control means having a plurality of modes of operation controlling the movement of said transport vehicle including a first mode operating said transport vehicle and providing normal service between a plurality of landings and a second mode rendering said motive means inoperative for supplying a drivng force to said vehicle and guiding said vehicle to one of said landings and a third mode stopping said vehicle, and transfer means coupled to said monitoring means and to said control means and providing a first output conditioning said control means to provide said first mode and a second output in response to a sensed first malfunction conditioning said control means to provide said second mode and a third output in response to a sensed second malfunction conditioning said control means to provide said third mode, said control means including an interlock circuit operating in response to said third output and establishing said second output.

185. The transportation system of claim 184, wherein said interlock circuit operatively transfers from a first condition to a second condition in response to said second output, said second condition coupled to maintain said second output.

186. The transportation system of claim 185, wherein said interlock circuit automatically transfers from said first condition to said second condition in response to said second output.

187. The transportation system of claim 185, wherein said interlock circuit includes means selectively manually operable and transferring said interlock circuit from said second condition to said first condition in response to the lack of said first and second malfunctions.

188. The transportation system of claim 185, wherein said interlock circuit includes first and second sequence means each operatively responding to said second output and providing said second condition.

189. A transportation system for a structure having a plurality of spaced landings comprising a transport vehicle, means mounting said vehicle for movement relative to said structure in a path extending adjacent each of said landings, motive means moving said vehicle relative to the structure, control means including a gated rectifying circuit selectively conducting energy between a source of energy and said motive means and controlling the movement of said vehicle relative to the structure and stopping said vehicle at a selected landing, said control means having a plurality of modes of operation controlling the operation of said transport vehicle including a first mode operating said vehicle under a first predetermined maximum velocity limitation and providng normal service between a plurality of landings and a second mode operating said vehicle under a second predetermined maximum velocity limitation, means monitoring the energy supplied by said source, and transfer means responsive to the functioning of said monitoring means and transferring said control means from said first mode to said second mode in response to said energy decreasing to a predetermined magnitude.

190. The transportation system of claim 189, wherein said gated rectifying circuit directly supplies energy to an armature circuit of said motive means.

191. The transportation system of claim 189, wherein said monitoring means includes means sensing the supply of energy from said source and providing a first output in response to said energy existing above a predetermined magnitude conditioning said control means to provide said first mode and a second output in response to said energy decreasing to said predetermined magnitude conditioning said control means to provide said second mode.

192. The transportation system of claim 191, wherein said sensing means senses the electrical voltage of said energy.

193. The transportation system of claim 189, wherein said transportation system includes a terminal landing, said braking means including a braking element selectively operable between a lifted condition permitting vehicle movement and a set condition restraining vehicle movement, said control means operatively sensing the movement of said vehicle and including first sequence means operatively coupled to said braking means and setting said braking element in response to said vehicle traveling beyond said terminal landing by a first predetermined distance while operating in said first mode and second sequence means operatively coupled to said braking means in response to said source energy decreasing to said predetermined magnitude and setting said braking element in response to said vehicle traveling beyond said terminal landing by a second predetermined distance while operating in said second mode.

194. The transportation system of claim 193, wherein said first sequence means includes a high speed limit switch and said second sequence means includes a reduced speed limit switch.

195. The transportation system of claim 189, wherein said transfer means providing a first output conditioning said control means to provide said first mode and a second output conditioning said control means to provide said second mode in response to said source energy decreasing to said predetermined magnitude, and coupling means operating in response to the operation of said braking means and transferring said transfer means from said second output to said first output in response to said source energy increasing above said predetermined magnitude.

196. The transportation system of claim 195, wherein said coupling means transfers said transfer means from said second mode to said first mode in response to said braking means transferring to a set condition when said vehicle stops at a landing.

197. The transportation system of claim 189, wherein said control means includes a pattern circuit generating a first pattern command signal having said first predetermined maximum velocity limitation for operation in said first mode and a second pattern command signal having said second predetermined maximum velocity limitation for operation in said second mode.

198. The transportation system of claim 189, wherein said control means includes a command circuit operatively coupled to said motive means and providing a signal to command movement of said vehicle from one of said landings to another, said transfer means selectively operable between a first output conditioning said control means to provide said first mode and a second output in response to said source energy decreasing to said predetermined magnitude conditioning said control means to provide said second mode, and coupling means conditioning said transfer means for transfer from said first output to said second output in response to said movement command signal.

199. The transportation system of claim 198, wherein said transfer means includes a latching circuit operable in response to said second output and maintaining said second output after the removal of said movement command signal.

200. A transportation system for a structure having a plurality of spaced landings comprising a transport vehicle, means mounting said vehicle for movement relative to said structure in a path extending adjacent each of said landings, motive means moving said vehicle relative to the structure, control means connected to a source of energy and cooperating with said motive means and providing a first maximum speed when moving said vehicle from one landing to an immediately adjacent landing and a second maximum speed when moving said vehicle from one landing to a landing spaced from said immediately adjacent landing, means moitoring a malfunction within said transportation system, and transfer means responsive to the functioning of said monitoring means and conditioning said control means to operate said vehicle at said first maximum speed in response to said sensed malfunction when moving from one landing to a landing spaced from said immediately adjacent landing.

201. The transportation system of claim 200, wherein said sensed malfunction includes a decrease of said source energy to a predetermined magnitude.

202. The transportation system of claim 200, wherein said motive means includes a two-speed D.C. motor.

203. A transportation system for a structure having a plurality of spaced landings comprising a transport vehicle, means mounting said vehicle for movement relative to said structure in a path extending adjacent each of said landings, motive means moving said vehicle relative to the structure, control means connected to a source of energy and cooperating with said motive means and controlling movement of said vehicle relative to the structure and including first sequence means initiating a stop of said vehicle in response to said vehicle arriving at a first predetermined distance from said landing at which a stop is to be made and second sequence means including a leveling position monitor stopping said vehicle in response to said vehicle arriving at a second predetermined distance from said landing at which a stop is to be made, means monitoring one or more malfunctions within said transportation system, and transfer means responsive to the functioning of said monitoring means and transferring the operation of said control means from said first sequence means to said second sequence means to initiate a stop in response to a sensed malfunction.

204. The transportation system of claim 203, wherein said sensed malfunction includes a decrease of the energy supplied by said source to a predetermined magnitude.

205. The transportation system of claim 203, wherein said first predetermined distance is greater than said second predetermined distance.

206. The transportation system of claim 203, wherein said second sequence means operates in response to a leveling position sensor sensing the arrival of said vehicle at a position adjacent to said landing at which a stop is to be made.

207. The transportation system of claim 203, wherein said first sequence means includes a speed pattern circuit initiating a stopping sequence and generating a deceleration pattern signal controlling the conduction of energy between said source and said motive means and said second sequence means includes a leveling pattern circuit initiating a stopping sequence and generating a decelerating pattern signal controlling the conduction of energy between said source and said motive means.

208. A transportation system for a structure having a plurality of spaced landings comprising a transport vehicle, means mounting said vehicle for movement relative to said structure in a path extending adjacent each of said landings, motive means moving said vehicle relative to the structure, control means connected to a source of energy and cooperating with said motive means and controlling movement of said vehicle relative to the structure and stopping said vehicle at a selected landing, said control means having a plurality of modes of operation controlling the operation of said transport vehicle, means monitoring malfunctions within said transportation system, and transfer means responsive to the functioning of said monitoring means and transferring said control means from one of said modes of operation to another of said modes of operation, said plurality of modes including a first mode operating said vehicle under a first predetermined maximum velocity limitation and providing normal service between a plurality of landings and a second mode operating said transport vehicle under a second predetermined maximum velocity limitation in response to a sensed first malfunction and a third mode rendering said motive means essentially inoperative for supplying a driving force to said vehicle and guiding said vehicle to one of said landings in response to a sensed second malfunction.

209. The transportation system of claim 208, wherein said first malfunction includes a decrease in the energy supplied by said source to a predetermined magnitude.

210. The transportation system of claim 208, wherein said transfer means selectively operates and conditions said control means to provide said third mode in response to said monitoring means sensing one of a plurality of malfunctions including the energy supplied to an armature circuit of said motive means increasing to a predetermined magnitude, the energy supplied to a field circuit of said motive means decreasing below a predetermined magnitude, the error signal derived as a difference between an output proportional signal of said motive means and a command signal as sensed by an error detector exceeding a predetermined magnitude, and the malfunctioning of said error detector.

211. The transportation system of claim 208, wherein said control means provides a fourth mode of operation and renders said motive means inoperative for supplying a driving force to said vehicle and stopping said vehicle in response to a sensed third malfunction.

212. The transportation system of claim 211, wherein said transfer means selectively operates and conditions said control means to provide said fourth mode in response to said monitoring means sensing one of a plurality of malfunctions including the velocity of said vehicle as sensed by a velocity detector exceeding a predetermined magnitude, the malfunctioning of said velocity detector, the energy supplied form said source decreasing to a predetermined magnitude, the loss of a phase of energy supplied from said source as sensed by a phase detector, the failure of a rectifying element within said phase detector, the improper sequential order of a plurality of alternating phases of energy supplied from said source, a predetermined temperature within a gated rectifying circuit, an improper electrical connection by a circuit connector, and the movement of said vehicle to a first position adjacent to a landing at which a stop is being made and the subsequent movement to a second position.

213. A transportation system for a structure having a plurality of spaced landings comprising a transport vehicle, means mounting said vehicle for movement relative to said structure in a path extending adjacent each of said landings, motive means moving said vehicle relative to the structure, control means connected to a source of energy and cooperating with said motive means and controlling the movement of said vehicle relative to the structure and stopping said vehicle at a selected landing, said control means having a plurality of modes of operation controlling the operation of said transport vehicle, means monitoring malfunctions within said transportation system, and transfer means responsive to the functioning of said monitoring means and transferring said control means from one of said modes of operation to another of said modes of operation, said plurality of modes including a first mode operating said vehicle under a first predetermined maximum velocity limitation and providing normal service between a plurality of landings and a second mode operating said vehicle under a second predetermined maximum velocity limitation in response to a sensed first malfunction of a decrease in the energy supplied by said source to a predetermined magnitude and a third mode rendering said motive means inoperative for supplying a driving force to said vehicle and stopping said vehicle in response to a sensed second malfunction.

214. The transportation system of claim 213, wherein said transfer means selectively operates and conditions said control means to provide said third mode in response to said monitoring means sensing one of a plurality of malfunctions including the velocity of said vehicle as sensed by a velocity detector exceeding a predetermined magnitude, the malfunctioning of said velocity detector, the energy supplied from said source decreasing to a second predetermined magnitude, the loss of a phase of energy supplied from said source as sensed by a phase detector, the failure of a rectifying element within said phase detector, the improper sequential order of a plurality of alternating phases of energy supplied from said source, a predetermined temperature within a gated rectifying circuit, an improper electrical connection by a circuit connector, and the movement of said vehicle to a first position adjacent to a landing at which a stop is being made and the subsequent movement to a second position.

215. A transportation system for a structure having a plurality of spaced landings comprising a transport vehicle, means mounting said vehicle for movement relative to said structure in a path extending adjacent each of said landings, motive means moving said vehicle relative to the structure, control means connected to a source of energy and cooperating with said motive means and controlling the movement of said vehicle relative to the structure and stopping said vehicle at a selected landing, said control means having a plurality of modes of operation controlling the operation of said transport vehicle, means monitoring malfunctions within said transportation system, and transfer means responsive to the functioning of said monitoring means and transferring said control means from one of said modes of operation to another of said modes of operation, said plurality of modes including a first mode operating said vehicle and providing normal service between a plurality of landings and a second mode rendering said motive means inoperative for supplying a driving force to said vehicle and guiding said vehicle to one of said landings in response to sensed first malfunction and a third mode rendering said motive means inoperative for supplying a driving force to said vehicle and stopping said vehicle in response to a sensed second malfunction.

216. The transportation system of claim 215, wherein said transfer means selectively operates and conditions said control means to provide said second mode in response to said monitoring means sensing one of a plurality of malfunctionings including the energy supplied to an armature circuit of said motive means increasing to a predetermined magnitude, the energy supplied to a field circuit of said motive means decreasing below a predetermined magnitude, the error signal derived as a difference between an output proportional signal of said motive means and a command signal as sensed by an error detector exceeding a predetermined magnitude, and the malfunctioning of said error detector.

217. The transportation system of claim 215, wherein said transfer means selectively operates and conditions said control means to provide said third mode in response to said monitoring means sensing one of a plurality of malfunctions including the velocity of said vehicle as sensed by a velocity detector exceeding a predetermined magnitude, the malfunctioning of said velocity detector, the energy supplied from said source decreasing to a predetermined magnitude, the loss of a phase of energy supplied from said source as sensed by a phase detector, the failure of a rectifying element within said phase detector, the improper sequential order of a plurality of alternating phases of energy supplied from said source, a predetermined temperature within a gated rectifying circuit, an improper electrical connection by a circuit connector, and the movement of said vehicle to a first position adjacent to a landing at which a stop is being made and the subsequent movement to a second position.

218. A transportation system for a structure having a plurality of spaced landings comprising a transport vehicle, means mounting said vehicle for movement relative to said structure in a path extending adjacent each of said landings, motive means moving said vehicle relative to the structure, control means cooperating with said motive means and controlling the movement of said vehicle relative to the structure and stopping said vehicle at a selected landing, said control means selectively providing a plurality of modes of operation controlling the operation of said vehicle selected from modes providing a normal operation, a reduced speed operation, an emergency landing operation and an emergency operation, means monitoring one or more malfunctions within said transportation system, and transfer means responsive to the functioning of said monitoring means and transferring said control means from one of said modes of operation to another of said modes of operation in response to a sensed malfunction and selecting the mode best suited for safe operation.

* * * * *

UNITED STATES PATENT AND TRADEMARK OFFICE

CERTIFICATE OF CORRECTION

PATENT NO. : 3,961,688

DATED : June 8, 1976

INVENTOR(S) : John T. Maynard

It is certified that error appears in the above-identified patent and that said Letters Patent are hereby corrected as shown below:

| | |
|---|---|
| Column 4, Lines 56-57, | Cancel "pedetermined" and substitute therefor ---predetermined---; |
| Column 7, Line 10, | Cancel "generaly" and substitute therefor ---generally---; |
| Column 23, Line 34, substitute | Cancel "is" first occurrence and ---as---; |
| Column 25, Line 66, | Cancel "powr" and substitute therefor ---power---; |
| Column 26, Line 34, | Cancel "]" and substitute therefor ---1---; |
| Column 26, Line 56, | Cancel "safely" and substitute therefor ---safety---; |
| Column 29, Line 46, | Cancel "contacs" and substitute therefor ---contacts---; |
| Column 29, Line 54, | Cancel "uV-1" and substitute therefor ---UV-1---; |
| Column 29, Line 60, | Cancel "he" and substitute therefor ---the---; |
| Column 31, Line 13, | Cancel "openimg" and substitute therefor ---opening---; |
| Column 34, Line 17, | After "hereinafter" insert ---. (a period)---; |

UNITED STATES PATENT AND TRADEMARK OFFICE

CERTIFICATE OF CORRECTION

PATENT NO. : 3,961,688

DATED : June 8, 1976

INVENTOR(S) : John T. Maynard

It is certified that error appears in the above-identified patent and that said Letters Patent are hereby corrected as shown below:

| | |
|---|---|
| Column 35, Line 12, | After "hereinafter" insert ---. (a period)---; |
| Column 35, Line 16, | Cancel "over the" and substitute therefor ---of the over---; |
| Column 35, Line 31, | Cancel "a" and substitute therefor ---an---; |
| Column 35, Line 56, | After "contacts" insert ---. (a period)---; |
| Column 36, Line 22, | Cancel "later" and substitute therefor ---latter---; |
| Column 37, Lines 6-7, | Cancel "the normally open contacts SD-3 of the start down relay," |
| Column 37, Line 65, | Cancel "later" and substitute therefor ---latter---; |
| Column 42, Line 30, | Cancel "UX" and substitute therefor ---URX---; |
| Column 43, Line 54, | Cancel "utilized" and substitute therefor ---shown---; |
| Column 43, Line 63, | Cancel "20" and substitute therefor ---120---; |
| Column 43, Line 65, | Cancel "utilied" and substitute therefor ---utilized---; |

UNITED STATES PATENT AND TRADEMARK OFFICE

CERTIFICATE OF CORRECTION

PATENT NO. : 3,961,688

DATED : June 8, 1976

INVENTOR(S) : John T. Maynard

It is certified that error appears in the above-identified patent and that said Letters Patent are hereby corrected as shown below:

| | |
|---|---|
| Column 46, Line 11, | After "with" insert ---the---; |
| Column 49, Line 64, | Cancel "referrence" and substitute therefor ---reference---; |
| Column 52, Line 25, | Cancel "voltge" and substitute therefor ---voltage---; |
| Column 52, Line 49, | Cancel "an" and substitute therefor ---and---; |
| Column 52, Line 52, | Cancel "ad" and substitute therefor ---and--- |
| Column 52, Line 68, | Cancel "an" and substitute therefor ---and--- |
| Column 53, Line 15, | After "115" insert ---. (a period)---; |
| Column 53, Line 34, | Cancel "KIX-1" and substitute therefor ---K1X-1---; |
| Column 54, Line 32, | Cancel "form" and substitute therefor ---from---; |
| Column 54, Line 64, | After "circuit" cancel "of", second occurrence; |
| Column 55, Line 29, | Cancel "cricuit" and substitute therefor ---circuit---; |
| Column 56, Line 64, | After "of" insert ---the---; |

UNITED STATES PATENT AND TRADEMARK OFFICE

CERTIFICATE OF CORRECTION

PATENT NO. : 3,961,688

DATED : June 8, 1976

INVENTOR(S) : John T. Maynard

It is certified that error appears in the above-identified patent and that said Letters Patent are hereby corrected as shown below:

| | |
|---|---|
| Column 57, Line 3, | Cancel "cirucit" and substitute therefor ---circuit---; |
| Column 57, Line 16, | Cancel "Th" and substitute therefor ---The---; |
| Column 57, Line 54, | Cancel "betweeen" and substitute therefor ---between---; |
| Column 57, Line 54, | Cancel "resistor" and substitute therefor ---resistors---; |
| Column 58, Line 1, | Cancel "cirucit" and substitute therefor ---circuit---; |
| Column 61, Line 12, | After "system" insert ---ground---; |
| Column 63, Line 24, | After "pair" insert ---of---; |
| Column 63, Line 35, | Cancel "556" and substitute therefor ---566---; |
| Column 63, Line 50, | Cancel "enegization" and substitute therefor ---energization---; |
| Column 63, Line 66, | Cancel "conductive" and substitute therefor ---non-conductive---; |
| Column 65, Lines 6-7, | Cancel "proprotional" and substitute therefor ---proportional---; |
| Column 65, Line 27, | After "and" insert ---to---; |

UNITED STATES PATENT AND TRADEMARK OFFICE

CERTIFICATE OF CORRECTION

PATENT NO. : 3,961,688

DATED : June 8, 1976

INVENTOR(S) : John T. Maynard

It is certified that error appears in the above-identified patent and that said Letters Patent are hereby corrected as shown below:

| | |
|---|---|
| Column 66, Line 40, | Cancel "disablng" and substitute therefor ---disabling---; |
| Column 67, Line 28, | Cancel "205" and substitute therefor ---605---; |
| Column 70, Line 8, | Cancel "beome" and substitute therefor ---become---; |
| Column 70, Line 56, | Cancel "circuit" and substitute therefor ---current---; |
| Column 70, Line 61, | Cancel "esistor" and substitute therefor ---resistor---; |
| Column 72, Line 17, | Cancel "voltge" and substitute therefor ---voltage---; |
| Column 72, Line 19, | Cancel "disabled" and substitute therefor ---disable---; |
| Column 73, Line 47, | Cancel "de-energization" and substitute therefor ---de-energized---; |
| Column 73, Line 58, | Cancel "dicussed" and substitute therefor ---discussed---; |
| Column 74, Line 22, | Cancel "energizaton" and substitute therefor ---energization---; |
| Column 74, Line 36, | Cancel "surces" and substitute therefor ---sources---; |

UNITED STATES PATENT AND TRADEMARK OFFICE

CERTIFICATE OF CORRECTION

PATENT NO. : 3,961,688

DATED : June 8, 1976

INVENTOR(S) : John T. Maynard

It is certified that error appears in the above-identified patent and that said Letters Patent are hereby corrected as shown below:

| | |
|---|---|
| Column 75, Line 50, | Cancel "K3X-!" and substitute therefor ---K3X-1---; |
| Column 75, Line 62, | Cancel "circit" and substitute therefor ---circuit---; |
| Column 76, Line 26, | Cancel "Transportaion" and substitute therefor ---Transportation---; |
| Column 76, Line 39, | Cancel "on" and substitute therefor ---in---; |
| Column 77, Line 42, | Cancel "Lu-3" and substitute therefor ---LU-3---; |
| Column 77, Line 65, | Cancel "4LX" and substitute therefor ---4LX-1---; |
| Column 78, Line 8, | Cancel "Lu-1" and substitute therefor ---LU-1---; |
| Column 78, Line 17, | Cancel "Lu-1" and substitute therefor ---LU-1---; |
| Column 78, Line 23, | Cancel "predetermined" and substitute therefor ---U-1---; |
| Column 78, Line 25, | Cancel "Bk-5" and substitute therefor ---BK-5---; |
| Column 79, Line 8, | Cancel "assignement" and substitute therefor ---assignment---; |

UNITED STATES PATENT AND TRADEMARK OFFICE

CERTIFICATE OF CORRECTION

PATENT NO. : 3,961,688

DATED : June 8, 1976

INVENTOR(S) : John T. Maynard

It is certified that error appears in the above-identified patent and that said Letters Patent are hereby corrected as shown below:

| | |
|---|---|
| Column 81, Line 14, | Cancel "El-2" and substitute therefor ---EL-2---; |
| Column 81, Line 14, | Cancel "El-3" and substitute therefor ---EL-3---; |
| Column 83, Lines 48-49, | Cancel "de-energized" and substitute therefor ---de-energize---; |
| Column 84, Line 9, | Cancel "de-engizing" and substitute therefor ---de-energizing---; |
| Column 85, Line 47, | Cancel "deenergize" and substitute therefor ---de-energize---; |
| Column 87, Line 21, | Cancel "provide" and substitute therefor ---provided---; |
| Column 87, Line 30, | Cancel "465,270" and substitute therefor ---465,272---; |
| Column 89, Line 24, CLAIM 12 | Cancel "wherin" and substitute therefor ---wherein---; |
| Column 89, Line 57, CLAIM 16 | After "includes" insert ---circuit---; |
| Column 90, Line 57, CLAIM 26 | After "includes" insert ---circuit---; |
| Column 92, Line 7, CLAIM 38 | Cancel "ane" and substitute therefor ---and---; |

UNITED STATES PATENT AND TRADEMARK OFFICE

CERTIFICATE OF CORRECTION

PATENT NO. : 3,961,688

DATED : June 8, 1976

INVENTOR(S) : John T. Maynard

It is certified that error appears in the above-identified patent and that said Letters Patent are hereby corrected as shown below:

| | |
|---|---|
| Column 94, Line 2, CLAIM 57 | Cancel ". (a period)" after "system"; |
| Column 94, Line 3, CLAIM 57 | Cancel "incuding" and substitute therefor ---including---; |
| Column 98, Line 8, CLAIM 83 | After "from" insert ---said---; |
| Column 109, Line 23, CLAIM 152 | Cancel "45" and substitute therefor ---145---; |
| Column 109, Line 36, CLAIM 154 | Cancel "53" and substitute therefor ---153---; |
| Column 109, Line 61, CLAIM 158 | Cancel "trannsportation" and substitute therefor ---transportation--- |
| Column 110, Line 31, CLAIM 162 | Cancel "to" and substitute therefor ---of---; |
| Column 110, Line 47, CLAIM 164 | After "landings" insert ---, (a comma)---; |
| Column 114, Line 27, CLAIM 184 | Cancel "drivng" and substitute therefor ---driving---; |
| Column 115, Line 5, CLAIM 189 | Cancel "providng" and substitute therefor ---providing---; |
| Column 116, Line 36, CLAIM 200 | Cancel "moitoring" and substitute therefor ---monitoring---; |

UNITED STATES PATENT AND TRADEMARK OFFICE

CERTIFICATE OF CORRECTION

PATENT NO. : 3,961,688

DATED : June 8, 1976

INVENTOR(S) : John T. Maynard

It is certified that error appears in the above-identified patent and that said Letters Patent are hereby corrected as shown below:

| | |
|---|---|
| Column 118, Line 13, CLAIM 212 | Cancel "form" and substitute therefor ---from---; |
| Column 119, Line 34, CLAIM 216 | Cancel "malfunctionings" and substitute therefor ---malfunctions---. |

Signed and Sealed this

Twenty-fourth Day of May 1977

[SEAL]

*Attest:*

RUTH C. MASON
*Attesting Officer*

C. MARSHALL DANN
*Commissioner of Patents and Trademarks*